United States Patent [19]

Bayer

[11] Patent Number: 4,586,299

[45] Date of Patent: May 6, 1986

[54] BUILDING SYSTEM OF INTERCONNECTED BLOCK ELEMENTS

[76] Inventor: Helmuth Bayer, Liliencronstr. 8, 1000 Berlin 41, Fed. Rep. of Germany

[21] Appl. No.: 247,563

[22] PCT Filed: Jul. 9, 1980

[86] PCT No.: PCT/DE80/00100

§ 371 Date: Mar. 16, 1981

§ 102(e) Date: Mar. 16, 1981

[87] PCT Pub. No.: WO81/00271

PCT Pub. Date: Feb. 5, 1981

[30] Foreign Application Priority Data

Jul. 19, 1979 [DE] Fed. Rep. of Germany ..... 2929197

[51] Int. Cl.[4] ..... E04B 1/348; E04B 5/57; E04G 21/14; E04F 15/024

[52] U.S. Cl. ..... 52/79.7

[58] Field of Search ..... 52/236.7, 283, 79.1, 52/283, 79.14, 79.7, 79.8

[56] References Cited

U.S. PATENT DOCUMENTS

| | | | |
|---|---|---|---|
| 1,205,465 | 11/1916 | Maguire | 52/236.7 |
| 2,724,261 | 11/1955 | Rensaa | 52/283 |
| 3,568,380 | 3/1971 | Stucky | 52/79.1 |
| 3,783,565 | 1/1974 | Hughes | 52/283 |

FOREIGN PATENT DOCUMENTS

| | | | |
|---|---|---|---|
| 1434495 | 11/1968 | Fed. Rep. of Germany . | |
| 2209025 | 6/1974 | France . | |
| 2263358 | 10/1975 | France . | |
| 2395367 | 1/1979 | France . | |
| 626097 | 7/1949 | United Kingdom | 52/283 |
| 1119161 | 7/1968 | United Kingdom . | |

OTHER PUBLICATIONS

Stache P. Raumzellen im Wohnungsbau, Wiesbaden und Berlin, 1974, Bauverlag GmbH, S.62–65.

Huth Steffen, Bauen mit Raumzellen, Wiesbaden und Berlin, 1975, Bauverlag GmbH, S.92 u. 112.

Sebestyen Gyula, Leichtbauweise, Koln-Braunsfeld, 1978, Verlagsgesellschaft Rudolf Muller, S.291.

*Primary Examiner*—John E. Murtagh

*Attorney, Agent, or Firm*—Wenderoth, Lind & Ponack

[57] ABSTRACT

An open skeleton-frame building system comprising a plurality of interconnected block elements. Each block element includes six sides, eight corners, and a rectangular base. Four column base plates are placed within four interior angles of the rectangular base. Four upstanding columns are placed on top of each of the four column base plates and serve as lateral supports for side walls. A lower load-bearing beam rings the perimeter of the rectangular base, interconnecting bottoms of the four upstanding columns, and serves as a bottom support for side walls. A lower outwardly projecting beam is attached to the outside edge of the lower load-bearing beam and serves as a bottom retainer for either an outer building wall or an interior fire wall with a block element interconnected at a lateral side. A lower inwardly projecting beam is attached to the inside edge of the lower load-bearing beam at the same height as the lower outwardly projecting beam and serves as a support for one of a floor and a ceiling/floor combination with a block element interconnected at a bottom side. An upper load-bearing beam is positioned above the lower load-bearing beam at a height of the side wall therebetween, interconnecting tops of the four upstanding columns, and serves as a top support for side walls. An upper outwardly projecting beam is attached flush with the top of the outside edge of the upper load-bearing beam and serves as a top retainer for either the outer building wall or the interior fire wall with the block element interconnected at the lateral side. An upwardly projecting beam is attached flush with the bottom of the inside edge of the upper load-bearing beam, is spaced a short distance vertically from the upper outwardly projecting beam, and serves as a support for either a ceiling/roof or a ceiling/floor combination with the block element interconnected at the top side. Four column cap plates are placed on top of the four upstanding columns.

10 Claims, 56 Drawing Figures

(ELEMENTS 1-10)

(ELEMENT 2)
Fig. 4
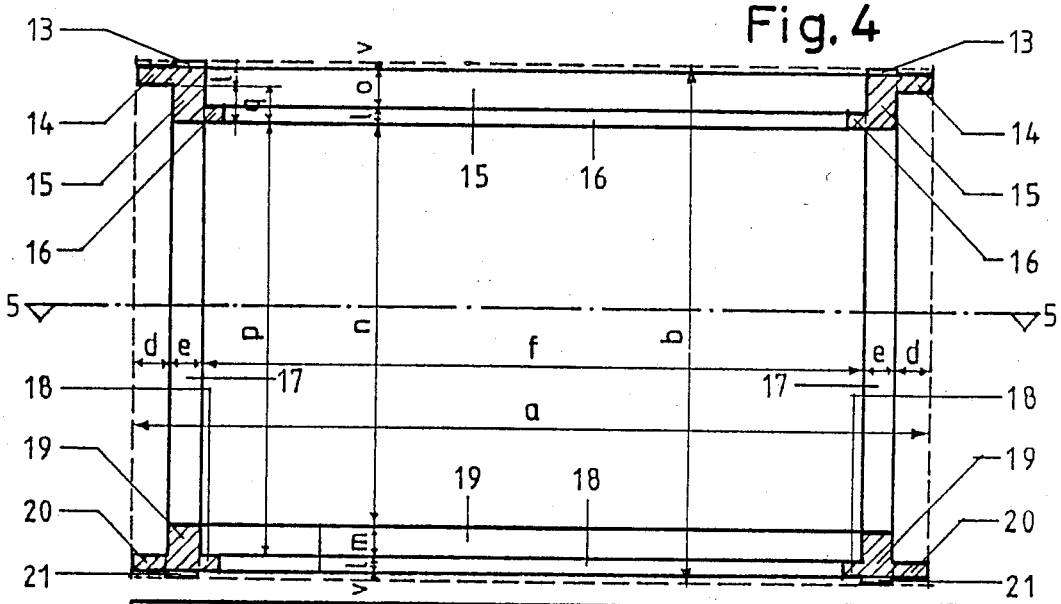
Fig. 5 (ELEMENT 2)
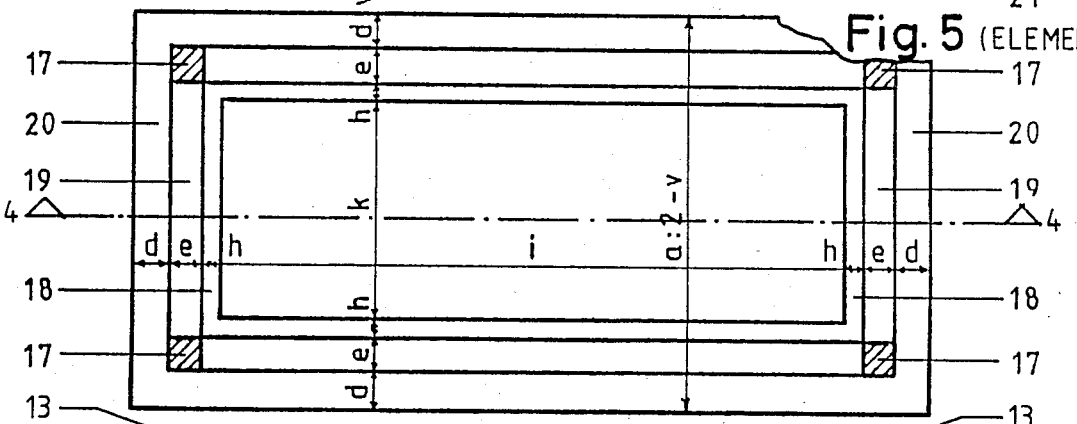
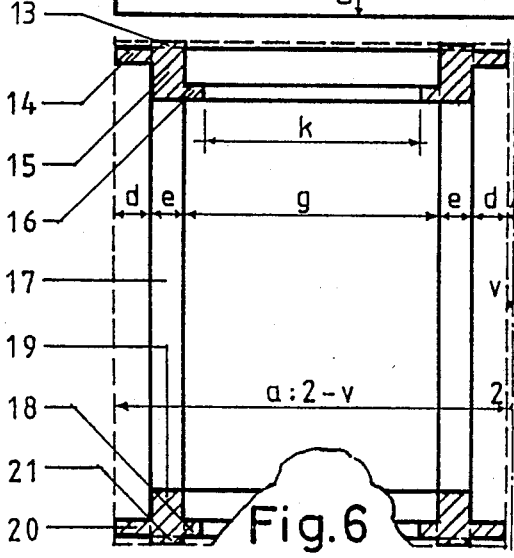
Fig. 6
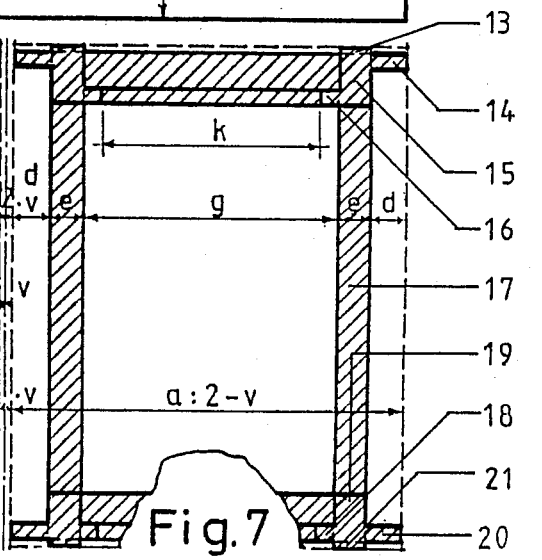
Fig. 7

(ELEMENTS 1 AND 4)

(ELEMENTS 1 AND 4)

(ELENENTS 6 AND 9)

(ELEMENTS 6 AND 9)

(ELEMENT 3)

(ELEMENT 3)

(ELEMENT 8)

(ELEMENT 8)

(ELEMENT 5)

(ELEMENT 5)

(ELEMENT 10)

(ELEMENT 10)

Fig. 28
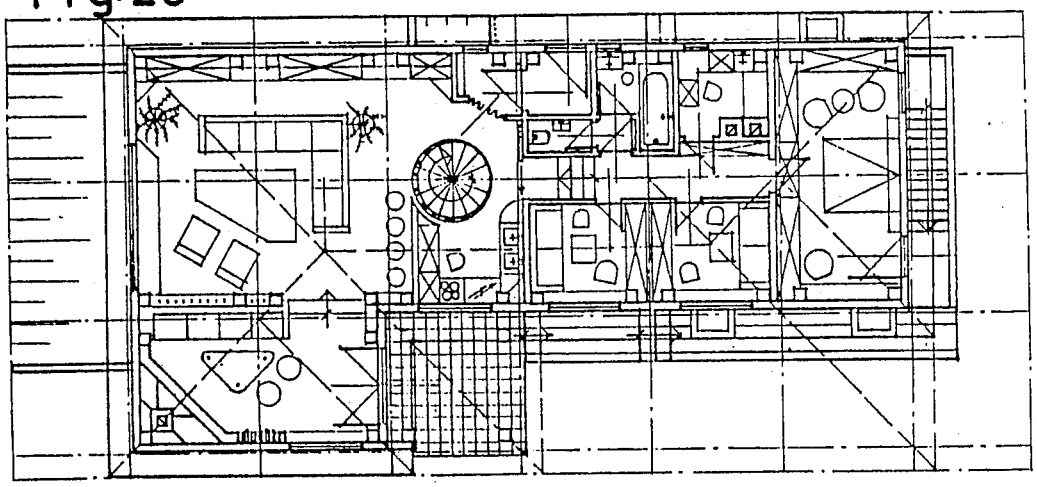
Fig. 28a
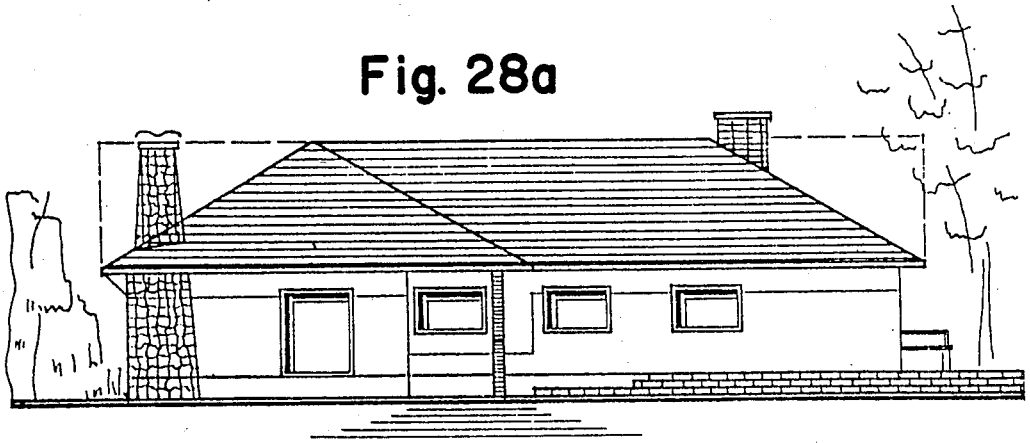
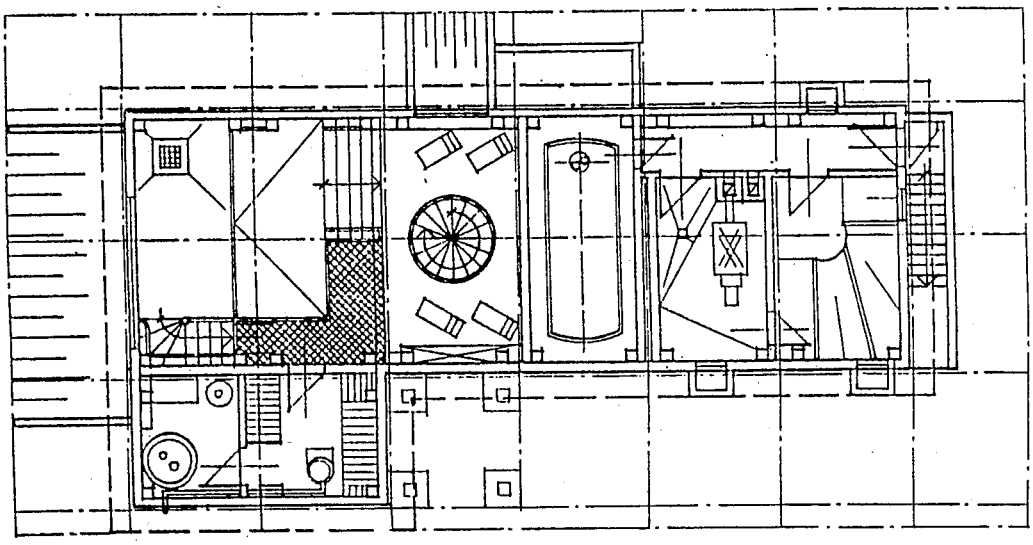
Fig. 28b

Fig. 29
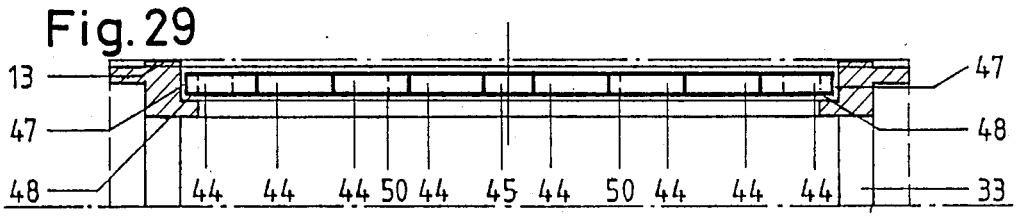
Fig. 29.1
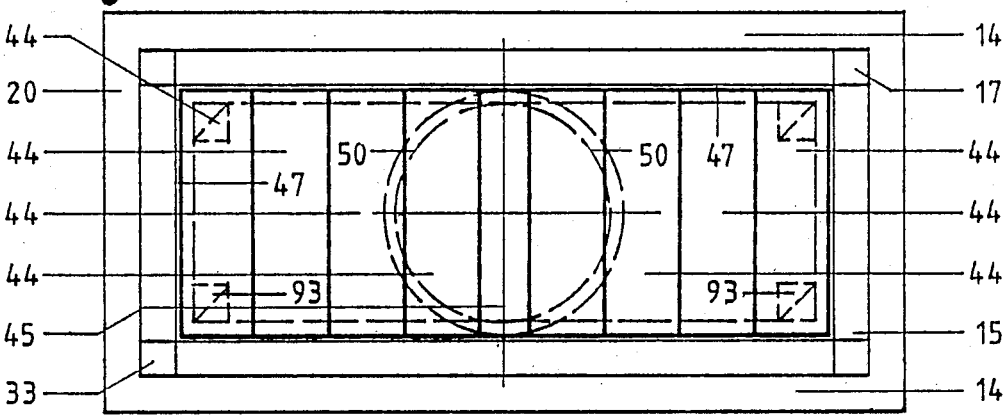
Fig. 29.2
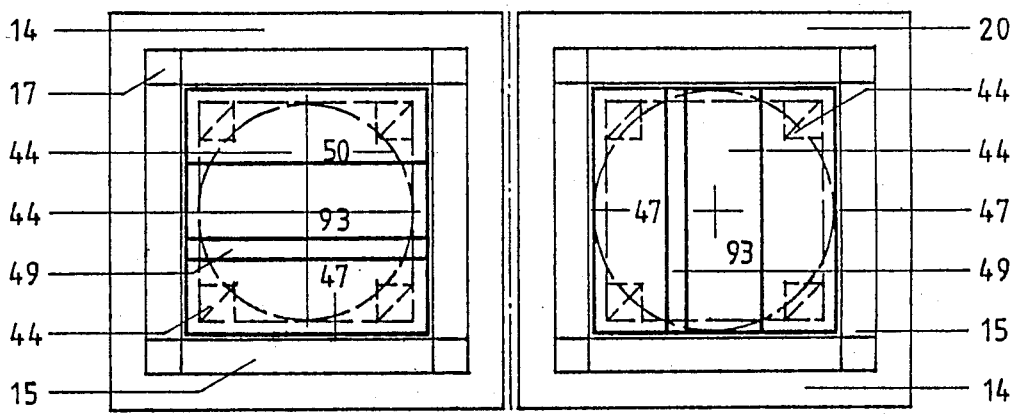
Fig. 29.3
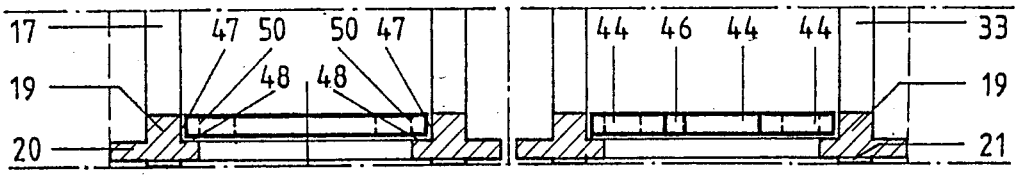

Fig.30
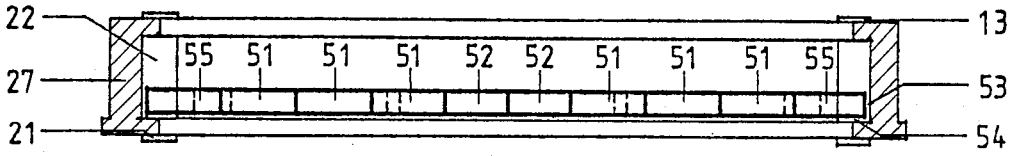
Fig. 30.1
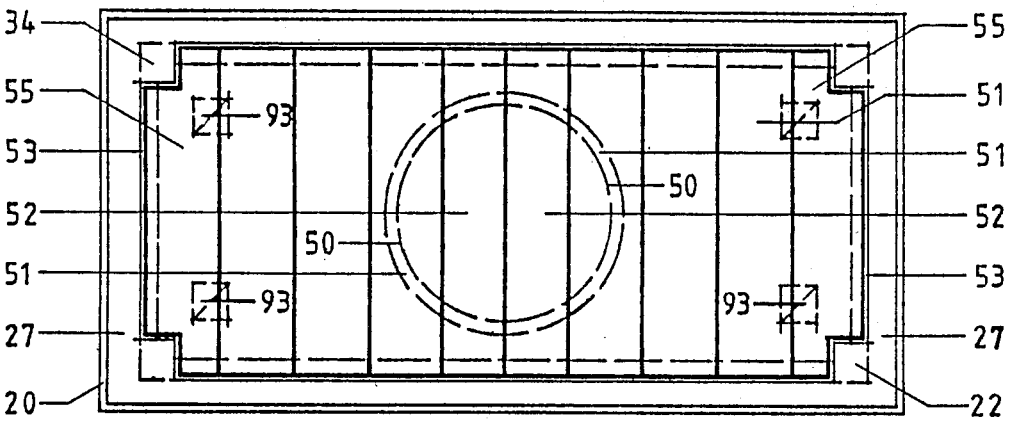
Fig. 30.2
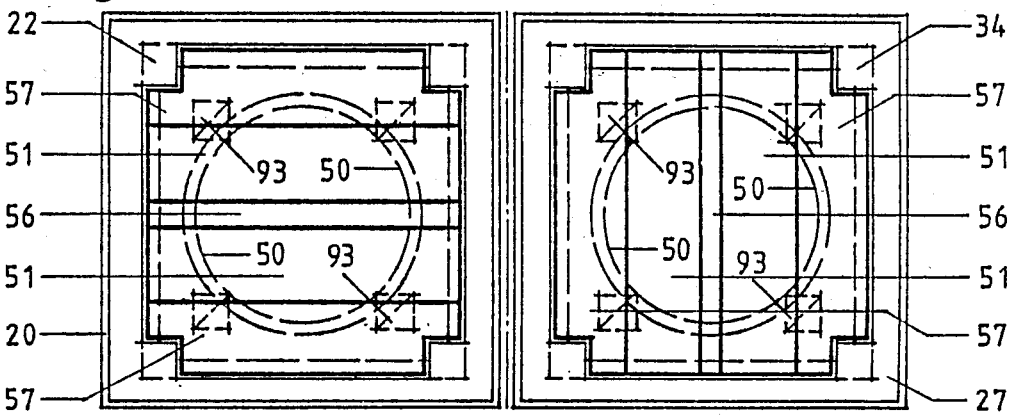
Fig.30.3
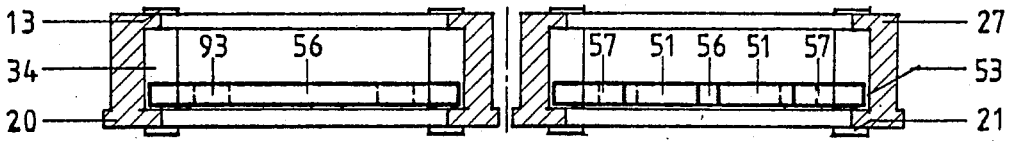

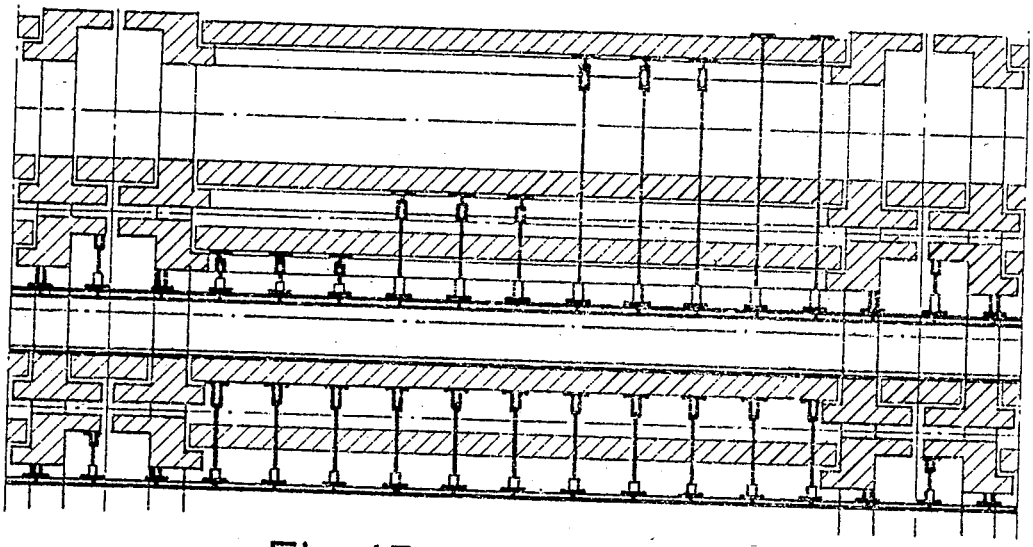
Fig. 45
Fig. 46
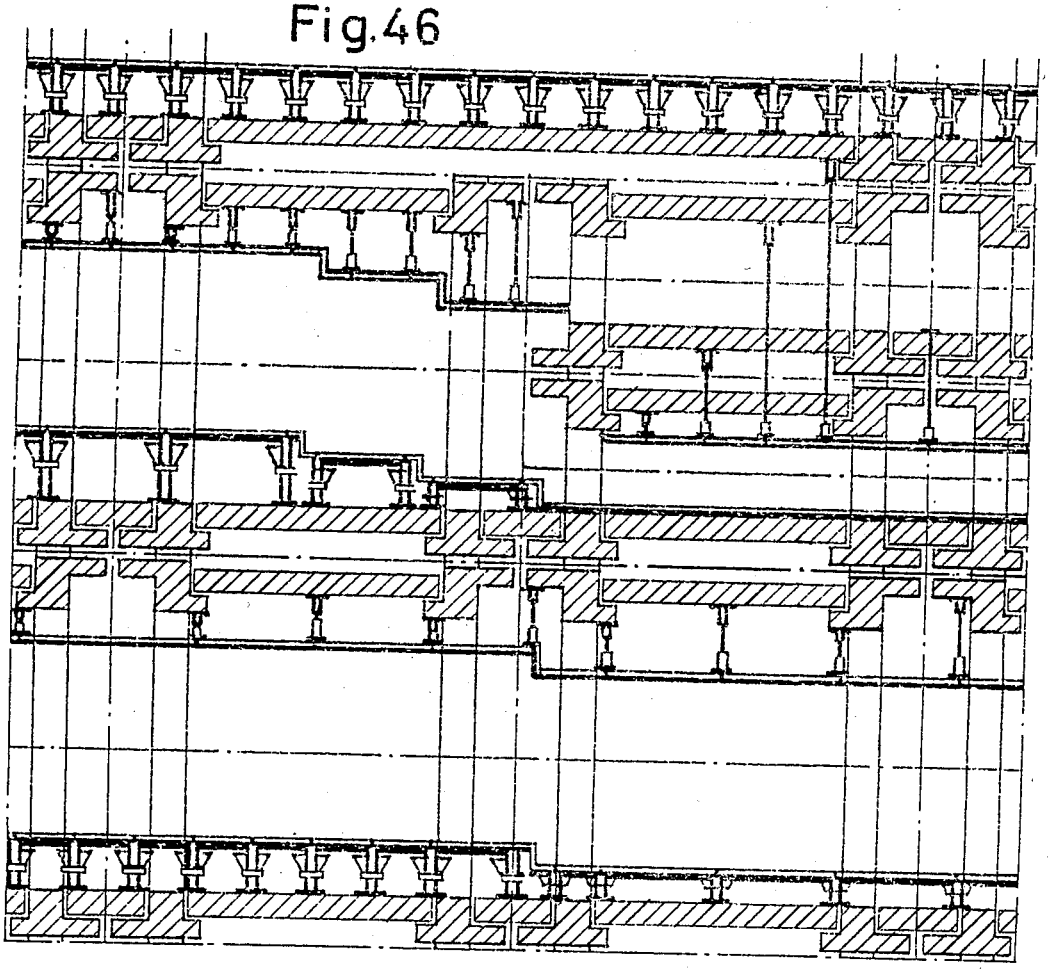

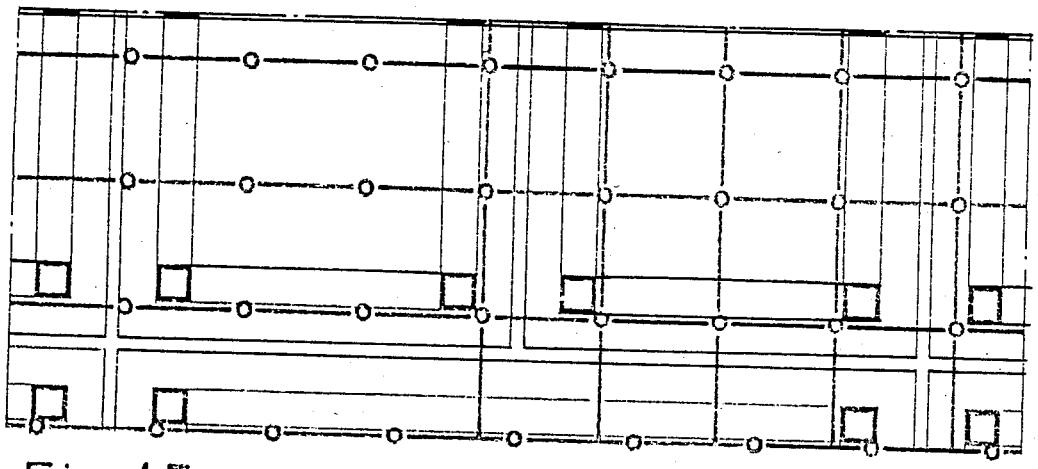
Fig. 47
Fig. 48
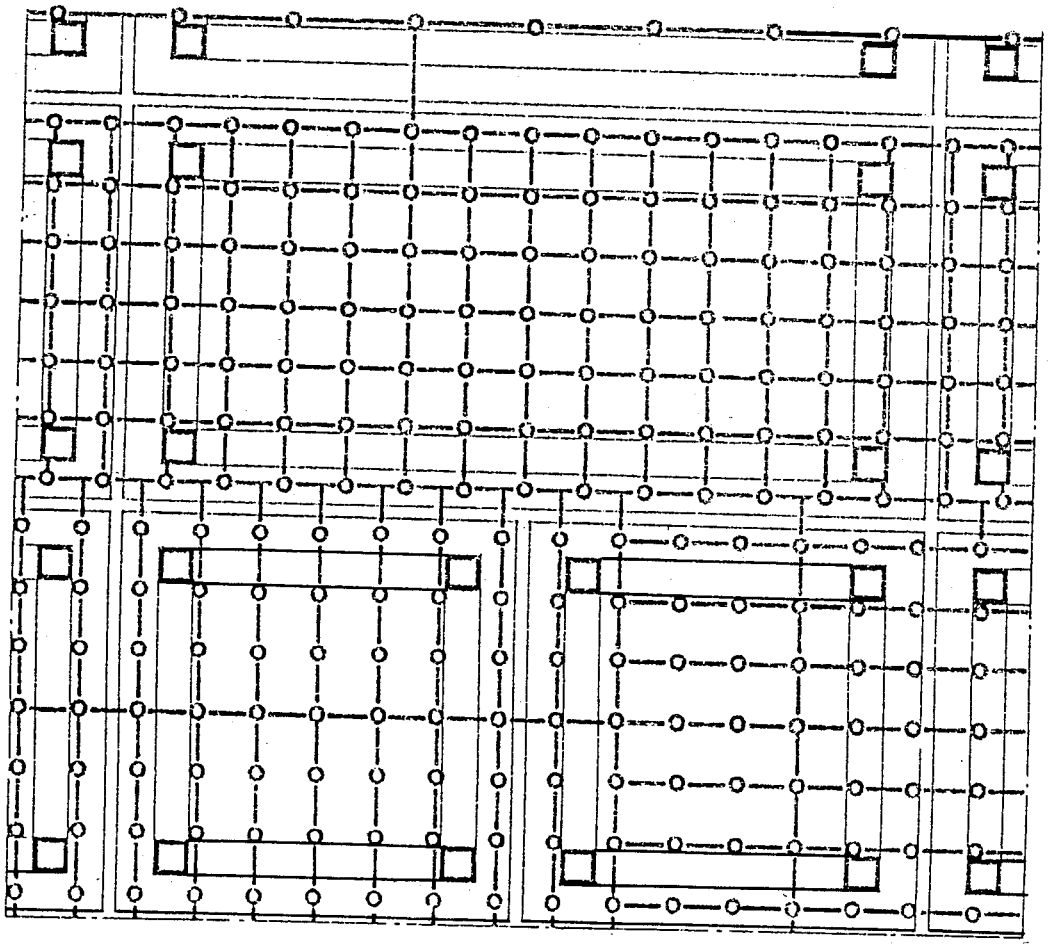

BUILDING SYSTEM OF INTERCONNECTED BLOCK ELEMENTS

BACKGROUND OF THE INVENTION

1. Field of the Invention

By means of the invention the most extensive, respectively true, system-building is achievable for the first time. The invention is based upon the idea of dividing finished buildings, all ready for occupation, turned over for their use and safe—erected according to traditional solid construction—into various cubes or disks of the same size, into long building blocks or disks and to shift this back to industrial prefabrication and to furnish them beyond structural and technical extension work to such an extent that even installations and central facilities for technical installations are provided with objects and even built-in furniture to the extent of lamps and curtains as well as with flat roof construction etc.

2. Description of the Prior Art

Buildings of every description consist of different structural members intended for their respective purpose which ordinarily require a certain gross volume of the total structure.

In the case of *the most simple buildings* and structural members in each case with single foundations without basements, it might be a matter of the following in this connection:

Excavations in the ground and above level of the building site with or without insulation, pergolas, arcades, terraces (roofed over), motor-car parking-places, open—nothing but roofed over—with or without excavations for erection, design of foundation for construction of structural steel works, arcades, green-houses, agricultural buildings and common storehouses etc-.—dismountable and remountable buildings as listed.

In the case of *simple buidlings* it might be a matter of the following:

Detached summer- and appliance houses, station-houses, small buildings and appliance for public and non-public supply systems with and without excavations, sale-pavilions, tank rooms of every description, single garages in a row or stacked, multi-story car parks, smaller industrial- or administration buildings and halls, private swimming-pools and one-family- or apartment houses without special demands, public housing projects, elementary schools, market-halls, dormitories and homes for the aged and other homes for purpose of asylum or reform, buildings fit for handicapped persons, shopping centers, gas station facilities with roofed over driveways, etc.—dismountable and remountable buildings as listed.

In the case of *buildings* with space requirements *in excess of average* and structural- and technical extension work such as: Underground car parks, one-family- and apartment houses with high demands, extensive and huge housing construction projects as private enterprise, multistory buildings for residential and administration use, regular school construction, general public administration buildings, health facilities, meeting halls for the citizenry, penal institutions, kitchens of medium size, supermarkets, public market facilities, medium-sized hotels, town halls, exhibition halls, etc.—also dismountable and remountable buildings as listed.

*Buildings with the highest demands* on all trades, including complete air conditioning, are the following:

Hospital buildings, all structures—also multi-story buildings for industrial instruction and research, college- and university buildings, museums and galleries, public swimming-pools, large kitchens, department stores, large hotel facilities, etc.— these buildings as listed also in dismountable and remountable construction.

SUMMARY OF THE INVENTION

Purpose, Problem and Execution of Work

In order to be able to erect buildings of great variety and with the utmost freedom of architectural designing and for the purpose of meeting requirements for the building and structural members which might be encountered, 10 basic ELEMENTS have been developed according to the invention, which can be completed with any special ELEMENT.

The 10 basic elements and the ideas they are based upon will be illustrated by means of the drawings included which also show their possible operations.

The following aspects have been decisive in the course of determination of dimensions and selection of materials for the elements:

(a) Length and width, however especially height shall be such that elements can be moved without development of special transport vehicles.

Width of the road as usually established, height of land lines and other hindrances in the public traffic had to be taken into consideration.

Special permits and escorts (driving in convoy) will be necessary, nevertheless, according to the respective traffic regulations.

BRIEF DESCRIPTION OF THE DRAWINGS

FIG. 4 shows the basic element (2) in longitudinal section taken along line 4—4 of FIG. 5.

FIG. 5 shows the basic element (2) in horizontal section taken along line 5—5 of FIG. 4.

FIG. 6 shows the basic element (7) in one end view of FIG. 1.

FIG. 7 shows the basic element (7) in the other end view of FIG. 1.

FIGS. 28, 28*a*, and 28*c* show three views of an L-shaped model home using full story elements (2) and (7).

FIG. 29 shows a longitudinal section of a roof and floor slab for elements (2) and (3). FIG. 29.1 shows horizontal sections of cover plates for elements (2) and (3).

FIG. 29.2 shows two horizontal sections of roof- and floor slab layers of elements (7) and (8).

FIG. 29.3 shows a longitudinal section of a roof/floor slab for elements (2), (3), (7) and (8) and a cross-section of a roof/floor slab for elements (7) and (8).

FIG. 30 shows roof/floor slabs for elements (1), (4) and (5) in longitudinal section.

FIG. 30.1 shows a horizontal section of roof/floor slabs for elements (1), (4) and (5).

FIG. 30.2 shows two horizontal sections of roof/-floor slabs for elements (6), (9) and (10).

FIG. 30.3 shows a longitudinal section of a roof/floor slab for elements (1), (4), (5), (6), (9) and (10) and a cross-section of plates for elements (6), (9) and (10).

FIG. 45 shows a ceiling structure with a vertical section of suspended ceiling for construction with basic elements of the invention.

FIG. 46 shows the vertical section of elevated floor structures, especially designed for construction with basic elements (2) and (7).

FIG. 47 shows horizontal sections of suspension arrangements.

FIG. 48 shows an arrangement of elevated floor piles.

DETAILED DESCRIPTION OF THE PREFERRED EMBODIMENTS

Figure 1:
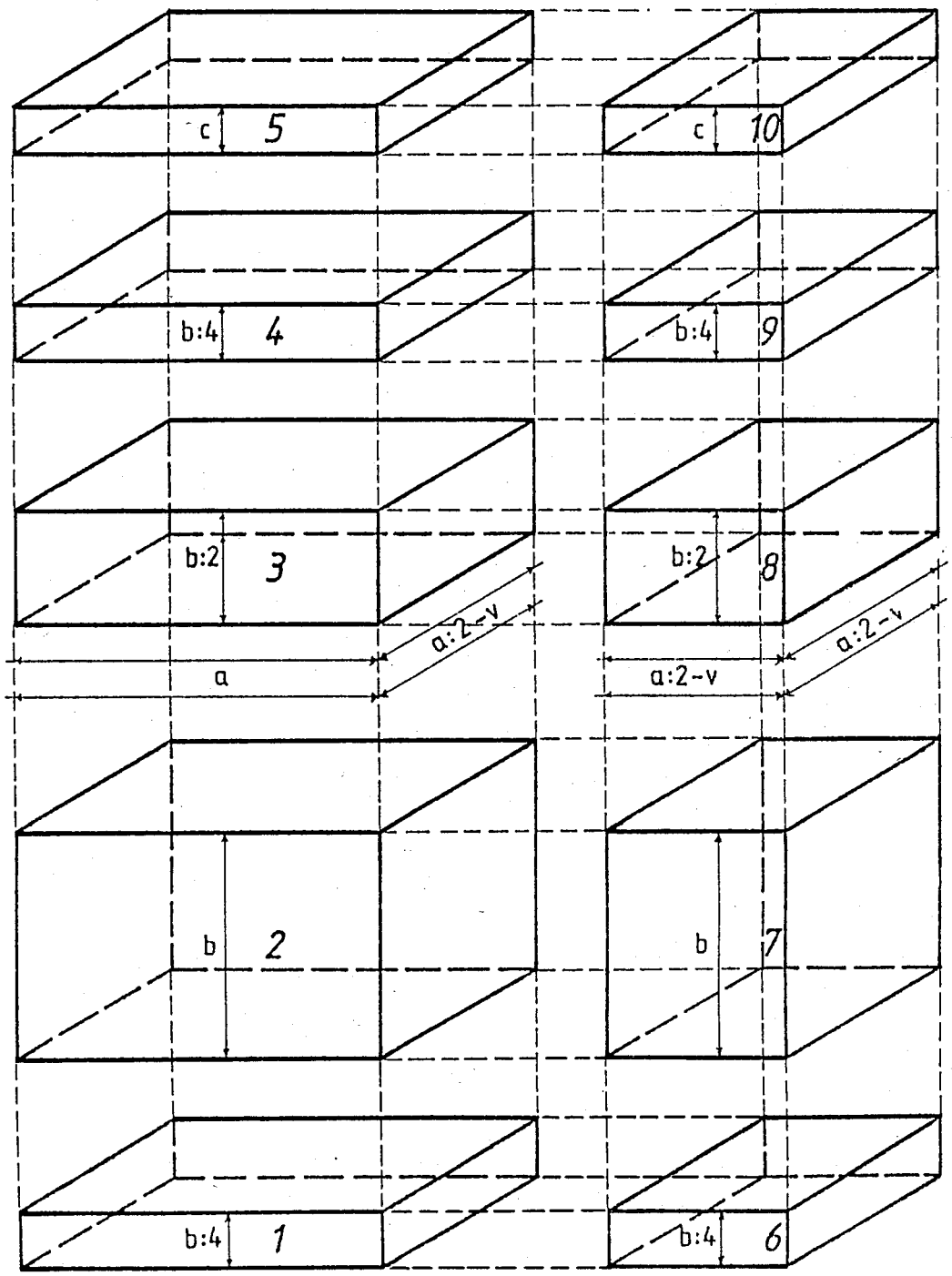
FIG. 1 shows that elements (1) to (5) and (6) to (10) can be stacked on top of each other.

Of the 10 elements designed, the elements (1) to (5) have a rectangular base and the elements (6) to (10) have a square base of such measurements that, with due regard to the central joint, two elements (6) will fit into the element (1) in each case, two elements (7) into the element (2) in each case, two elements (8) into element (3) in each case, two elements (9) into the element (4), and two elements (10) into the element (5).

FIG. 1 shows that elements (1) to (5) can be stacked one on top of the other. This also applies for elements (6) to (10).

Figure 2:
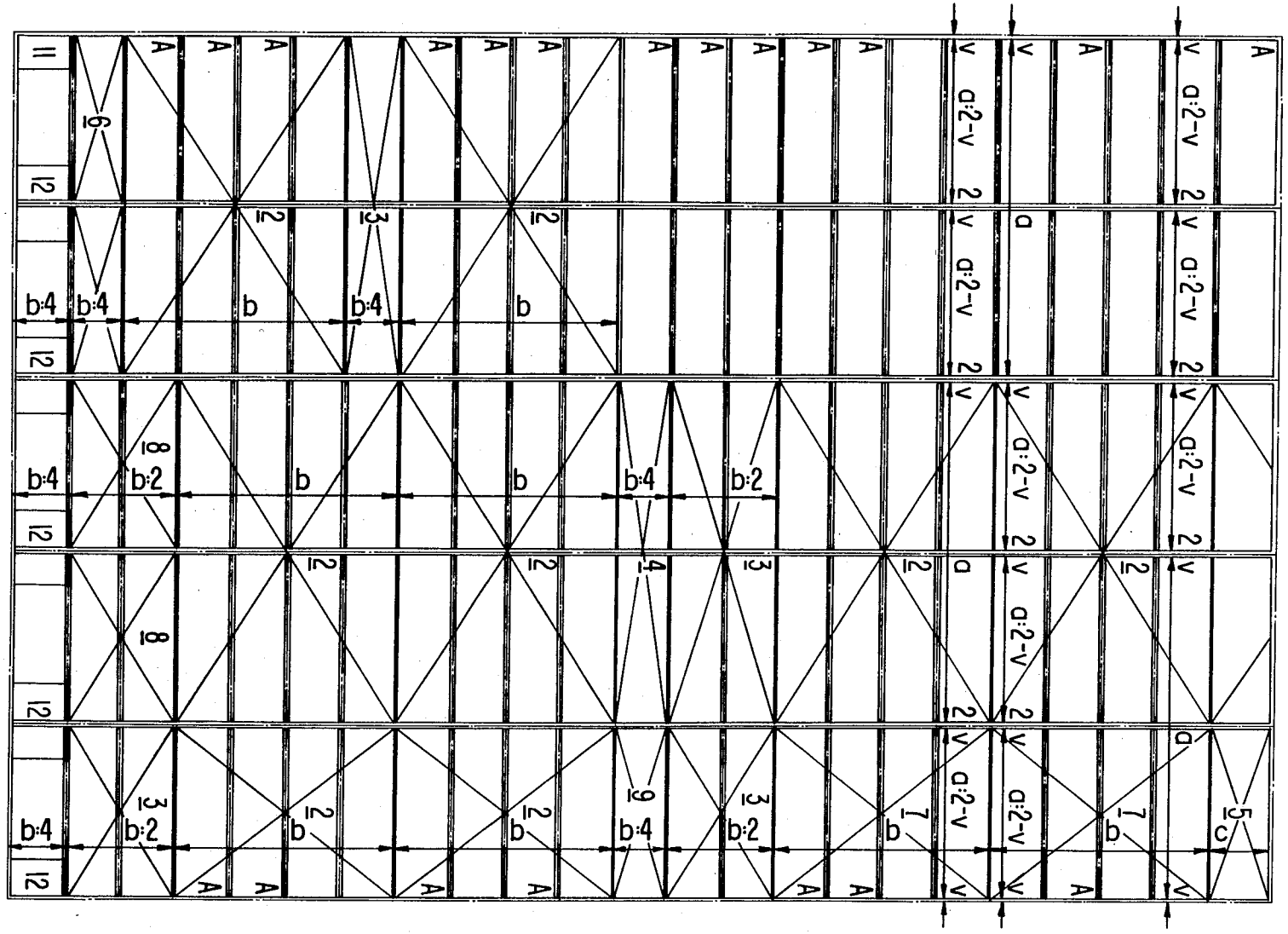
FIG. 2 shows the stackability of the elements (1) to (10).

FIG. 2 shows that in consideration of static requirements which cause changes only in the interior of the elements in the area of columns and supporting beams, stackability of the elements (1) to (10) and consequently the height of the buildings (also if formed into terraces) constructed with these elements is only limited by operational features of transport equipment with respect to the vertical line (crane systems).

FIG. 2 shows that not only can elements with square bases, e.g. elements (6) underneath element (1) or elements (7) underneath element (2) be arranged in the lower stories, but the same is the case e.g. for two elements (8) underneath one element (2) or (3) or (4).

Figure 20:
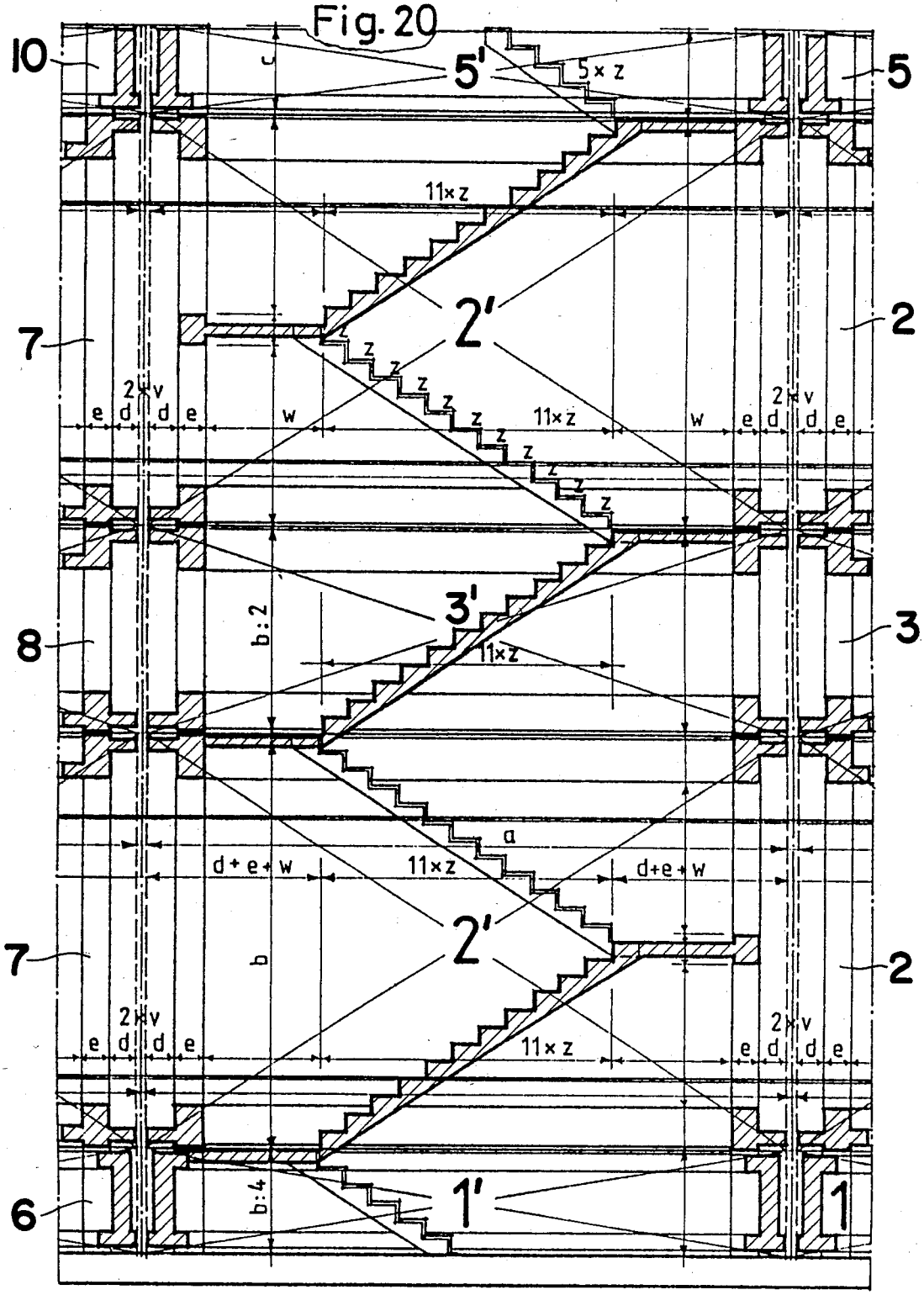
FIG. 20 shows staircase elements (1') to (5') for connection of basic elements (1) to (5) with basic elements (6) to (10).

In coordination with the statics for the building to be constructed in each case according to soil condition, it is possible to install single foundations as the foundation as shown in FIG. 2 under (11) and (12) or in situ-concrete constructions e.g. foundation sole plates as shown in FIG. 20 might be required.

Figure 31:
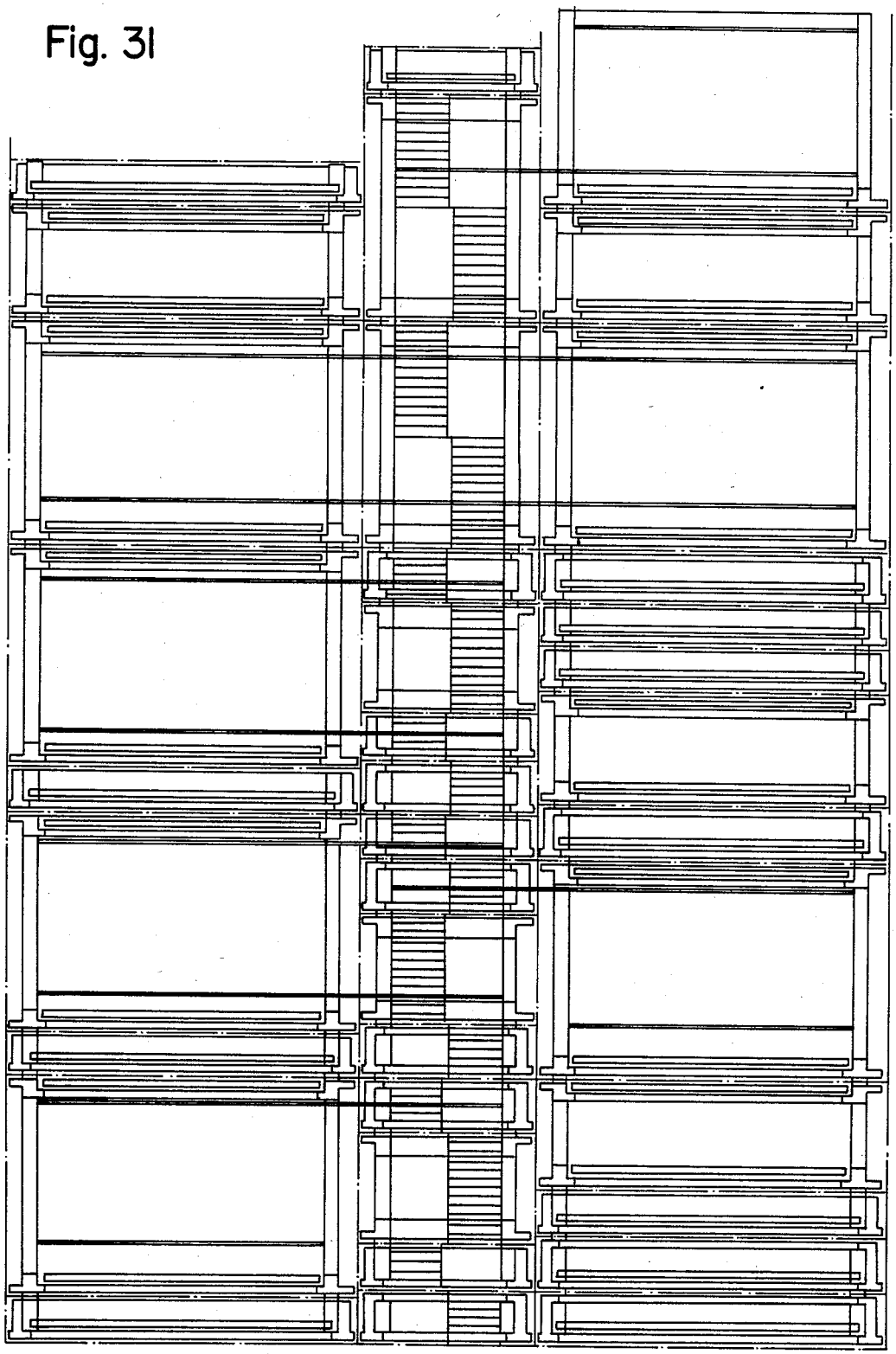
FIG. 31 shows possible roof/floor slab layers in vertical section with indiscriminate arrangement of basic elements (1) to (10), one beneath the other.

The modular height grid (A) results from the lowest elements (1), (6), (4) and (9) or (b:4), whose measure of altitude overall (b) is the measure of altitude of elements (2) and (7) overall. Elements (3) and (8) have an overall height of (b:2). Elements (5) and (10) are the only ones to have the special height of (c) overall. The most essential criterion for all measures of altitude even in the case of greatest variation in stacking of elements is that they can be passed through with an unchanged ratio of rise (z). This is shown in FIG. 20 and FIG. 31. Details with descriptions of each single element follow.

Figure 3:
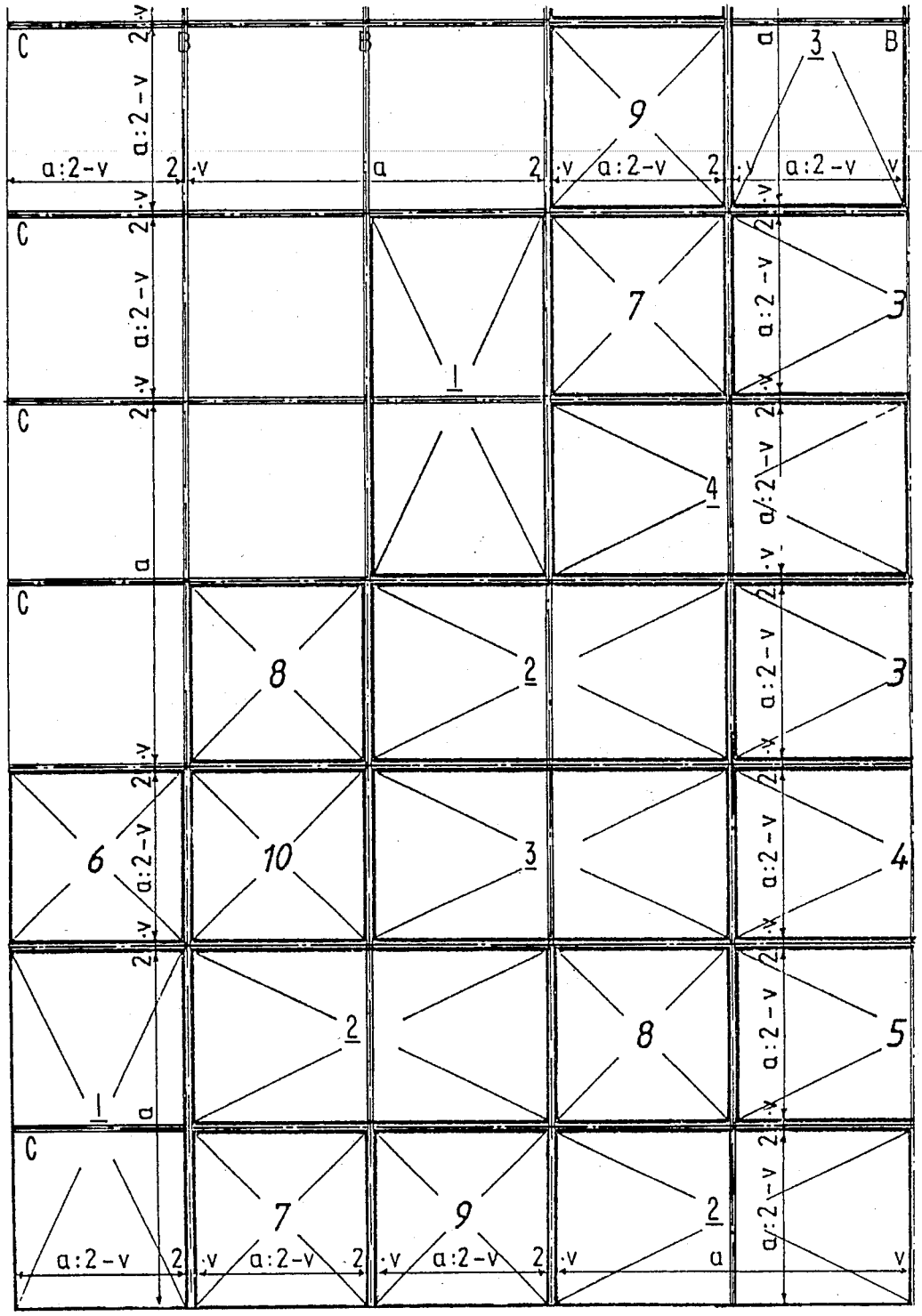
FIG. 3 shows the arrangement of the elements (1) to (10) among one another lengthwise and widthwise.

FIG. 1 and FIG. 3 show the length (a) and the width (a:2−v) for the base of elements (1) to (5) and for length and width of elements (6) to (10) a measure (a:20v). FIG. 3 shows that the arrangement of elements (1) to (10) among one another is unlimited and therefore all conceivable building outlines are possible within the limits of a modular length grid (B)=(a:2−v) and a modular width grid (C)=(a:2−v).

(b) Since elements are prefabricated in shell with structural extension work and complete technical extension work up to 90% and will then be transported and erected at site, the principal aspect for selection of materials shall be to keep the dead load of the shell structure, of the extension materials and all facilities as low as possible.

This applies especially to the full story element (2), which contains an operative heating installation ready at site if necessary, placed into a basement or a complete central ventilating system, placed as the final upper story.

In extreme cases of full story-elements completed and furnished according to function, a total dead weight of up to 20 tons is expected, however.

On the other hand, an element for an underground car park (basic element (2)) might definitely have a 0.50 m column cross section if required by statics and 0.50 m width of the floor beam and might be constructed with reinforced concrete, e.g. B 350.

A basic element (2), however, which only contains one fully completed part of a room for continuous residence of persons might also have column cross sections of just 0.25/0.25 m and floor beam width of 0.25 m according to statics and constructed with a prestressed light concrete design.

Selection of materials will therefore always conform to the intended purpose of the room elements as shown in the overall planning of the building project.

With regard to the three-dimensional elements (1) to (10), lines steel-, reinforced concrete-, prestressed reinforced concrete-, reinforced light concrete-, as well as prestressed concrete designs can be considered for the supporting beam- and column designs in all six levels.

For the design of bare ceilings and roofs with heavy loads the above listed materials can be used. Apart from these materials, only light concrete sheets for the roof and the ceiling will be installed. The thickness of the ceiling construction shall not exceed 0.20 m.

Main walls are basically not required in the context of the industrialized building system applied for. Also outer walls, partition walls between buildings, fire walls and all other interior partition walls can be manufactured with light building materials, solid or multishell up to 0.30 m thickness as approved.

ELEMENTS (1) to (10) in Detail

Elements (1) to (5) and (6) to (10) are not only overall with respect to their outline as shown so far, but also identical in construction of their essential structural features.

The basic element (2) is shown in FIG. 4, longitudinal section, FIG. 5 horizontal section.

It consists of 4 square columns (17) with a cross-section (e/e), a bearing upper ring beam (15) with cross-section (e/1 and 0), a bearing lower ring beam (19) with cross-section (e/1 and m), a top projecting ring beam (14) at exterior perimeter with cross-section (d/1), a lower projecting ring beam (20) at interior perimeter with cross-section (d/1), an upper floor ring beam (16) at interior perimeter with cross-section (1/h), a lower floor ring beam (18) at interior perimeter with cross-section (1/h), four cap plates (13) on the columns and at cross-section of the columns with height (v), four floor structures (21) underneath the columns and with height (v) at cross-section of the columns, and four continuous anchor rail rings (94) (set into all inner sides of the columns, in each case in center, into all bottom sides of the upper bearing ring beam and into all top sides of lower bearing ring beam).

The overall measurements:

(a) for length, (a:2−v) for widths and (b) for height have already been explained. (n) indicates the clear height for the columns of the full story.

It has been determined that, in case of use of element (2), e.g. at housing construction with due regard to specified height of the living rooms, usage of suspended ceilings and elevated floors (each continuous at the same level) with the advantages for installation will result from this construction.

The basic element (2) can still be used as a full story on the basis of the choice of (n), even if the height of the rooms for offices or place of work is required to be different.

Because of the choice of clear space between columns (f) in the longitudinal direction, the basic element (2) will be of perfect use even for large assembly halls, in the course of which (f) becomes the width of the room and the required length of the rooms can be achieved by means of joining of the basic elements (2). In this case spacious installations must be sacrificed in this element or completion by means of raising the building with one of the basic elements (3) or (4) will be necessary.

The basic element (2), with concrete floor inlaid at the bottom and cement—or industrial cast plaster floor on top and also covering the lower bearing beam (from one element to the next), might then also be fully utilized for construction of industrial facilities, underground car parks, etc.

E.g. in the case of small buildings two basic elements (2) with required exterior wall portions and complete flat roof design erected next to each other will form a 2-car-garage. One element by itself will form a garage with storage room with its four walls and a complete flat roof as well as a built-in gate between clear width of the columns (g).

The above examples make clear that the basic element (2) is the most important element for full stories with regard to space and for the purpose of constructing buildings that have been listed as examples for application above.

There is shown in FIG. 20 the longitudinal section of the special staircase element for full stories (2') and for completion of the basic element (2). It is of the same construction as basic element (2) when used for one-family or two-family houses and has an additional dog-legged stair with twelve steps twice (ratio of rise (z)), two stair heads and one supporting beam for the stair head in the width between the columns. These prefabricated parts will be installed at the plant in the course of the construction of the framework of the basic element (2).

Figure 21:
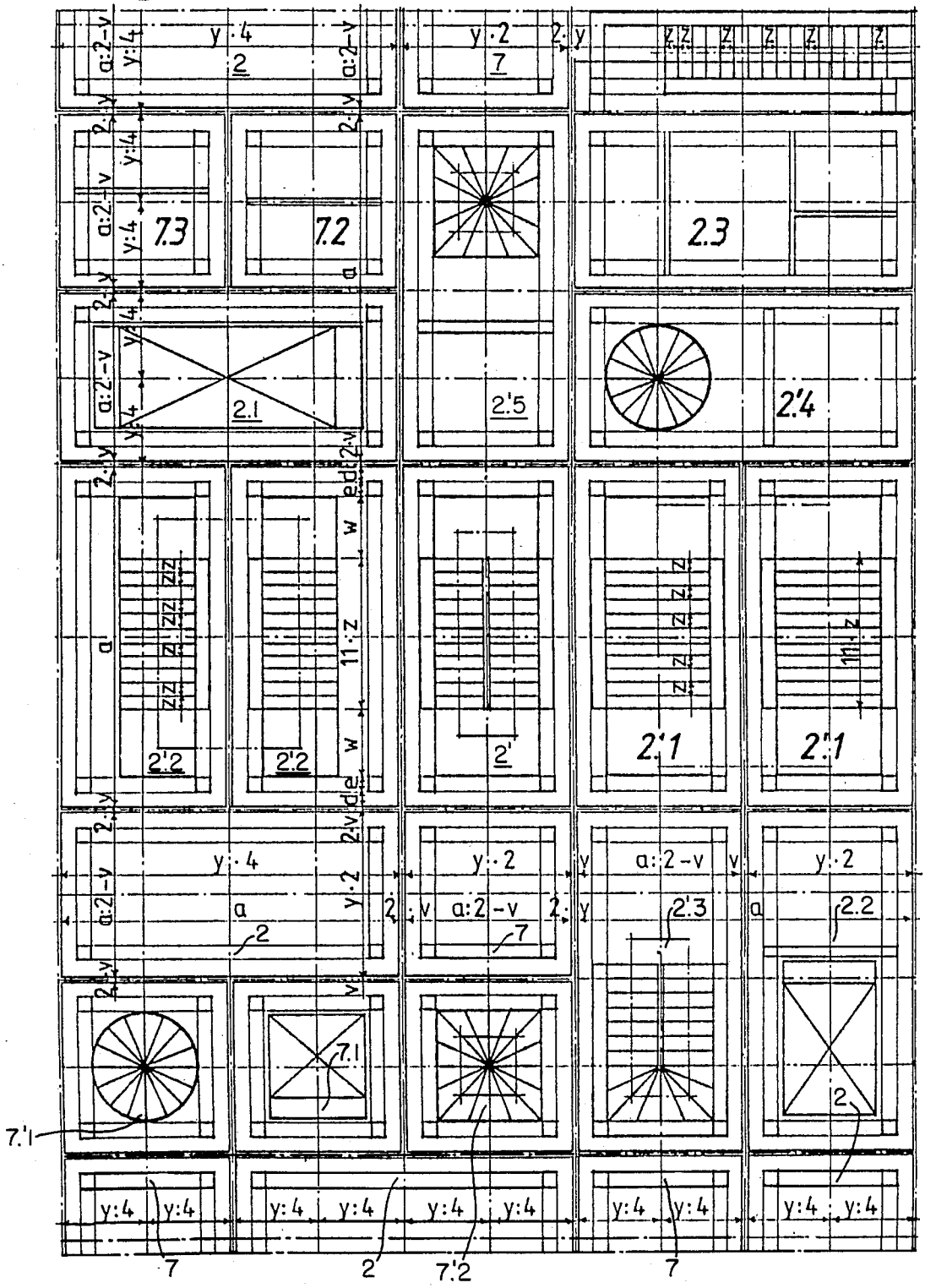
FIG. 21 shows various staircase and elevator elements.

There is shown in FIG. 21 the plan of special stair case element (2') in dead center. This staircase element has wider flights because of elimination of the upper and lower supporting beams for roof and ceiling and these are fixed-in into cross walls between the columns in longitudinal direction and therefore the element can be used in regular domestic buildings.

Stair heads and other structural parts as specified for the full story elements (2) and (2').

There is also shown in FIG. 21 in center left two special staircase elements (2'.2). In this case only one flight has been attached to the cross wall between the columns for the purpose of achieving even wider flights per element. As result of mirror-inverted coordination and closing of the stair heads from one element to the next, a staircase will be formed, which can be incorporated into buildings with a large number of visitors.

Likewise, there is shown in FIG. 21 in center right two special staircase elements (2'.1). The special features of these are that they only have straight stairs with one flight, whose flights take the total clear width between two columns lining the width are are clamped between two cross walls in longitudinal direction. Two of these elements side by side and with or without connection of stair heads, form staircases for the heaviest traffic by the public.

FIG. 21 also shows at upper left the special elevator element (2.1) for a lift with large cabins, which takes the total clear between the four columns with respect to length and width.

There is also shown in FIG. 21 at lower right the basic element (2.2) with a partition wall of the same width as the element and an elevator shaft accordingly smaller.

At lower right of FIG. 21 the basic element (2'.3) is represented with a staircase for residential buildings with wheeling steps of 180 degrees. This staircase facility is set into three cross walls on the outside.

There is shown in FIG. 21 at upper right a staircase element (2'.4) with a partition wall across the width of the element and with overhanging circular stairs, also round on the outside.

FIG. 21 at upper center shows the basic element (2'.5) with a partition wall of the same width as the element and circular stairs which are square on the outside.

At upper right of FIG. 21 the basic element (2.3) is represented with possible partition into rooms by means of small cross walls (three).

There is shown in FIG. 21 at lower left the special elevator element (7.1) for a lift with small cabins, which takes the total clear between the four columns with respect to length and width.

FIG. 21 represents at the utmost lower left the staircase element (7'.1) with circular stairs, also circular on the outside.

At lower dead center, FIG. 21 shows the staircase element (7'.2) with circular stairs of square outline.

FIGS. 6 and 7 also show cross-sections of the basic element (7) at both ends.

But FIGS. 6 and 7 also show that all elements (1) to (10) are installed and erected with (2·v) space of open joints one underneath the other.

Figure 8:
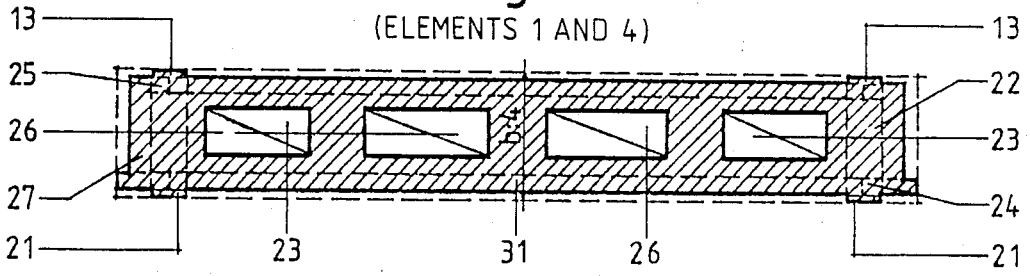
FIG. 8 shows the basic elements (1) and (4) in longitudinal front section taken along line 8—8 of FIG. 9.
Figure 9:
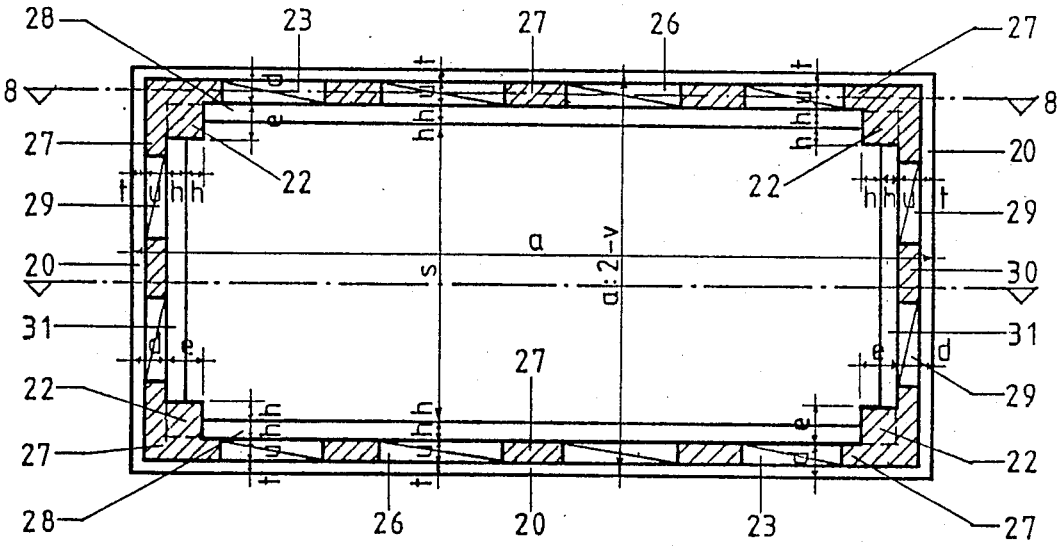
FIG. 9 shows the basic elements (1) and (4) in horizontal section.
Figure 10:
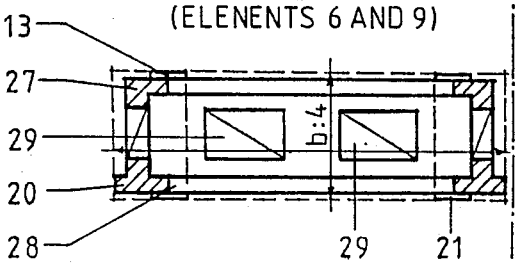
FIG. 10 shows the basic elements (6) and (9) in an end view.
Figure 11:
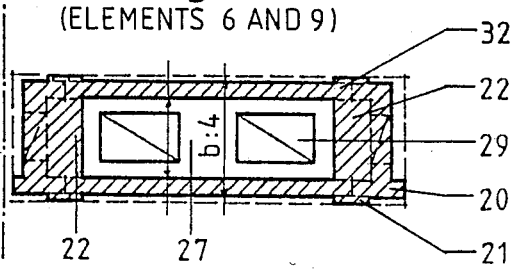
FIG. 11 shows the basic elements (6) and (9) in cross-section.

FIG. 8 shows the basic elements (1) and (4) for foundations in longitudinal section, FIG. 9 shows the horizontal section of elements (1) and (4) and FIGS. 10 and 11 the cross-sections of elements (6) and (9).

These elements have the following identical structural parts as the basic element (2);

Cap- and foot plates (13) and (21) and the lower exterior projecting beam (20) at the perimeter.

They are different with respect to the following features:

The four columns of identical profile and position (22) only have a height of (b:4) ./. (2·v); above the projecting beam the columns span continuous cross walls at all four sides—longitudinal walls including breaks of the wall in longitudinal direction (27) and cross walls (30) in dead center of the cross-section (thickness of walls chosen is (u)); for the solid cross walls a recess for installations will be provided, closed with light building materials for breaking through according to requirements of various size (23), (26) and (29); upper supporting beams for roof and ceiling are engaged between the columns and the wall disks (25) and (32); lower supporting beams for roof and ceiling as specified above (24) and (31).

The overall measurements:

(a) for length, (a:2−v) for width and (b) for height have already been explained. In FIGS. 10 and 11 the basic elements (6) and (9) are also shown, e.g. cross-sections of both ends.

Figure 12:
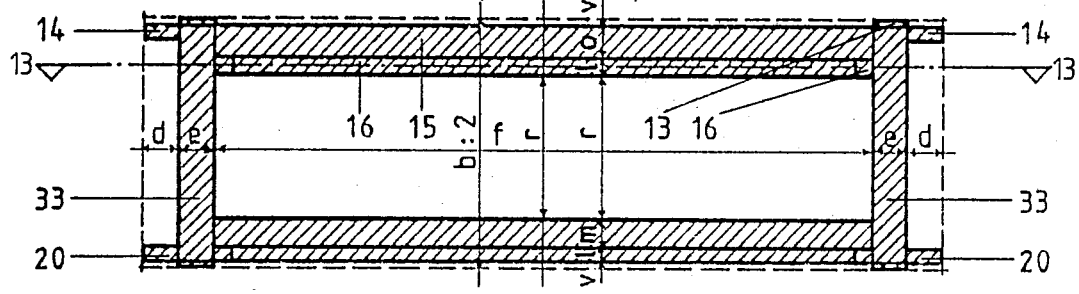
FIG. 12 shows the basic element (3) in longitudinal section taken along line 12—12 of FIG. 13.
Figure 13:
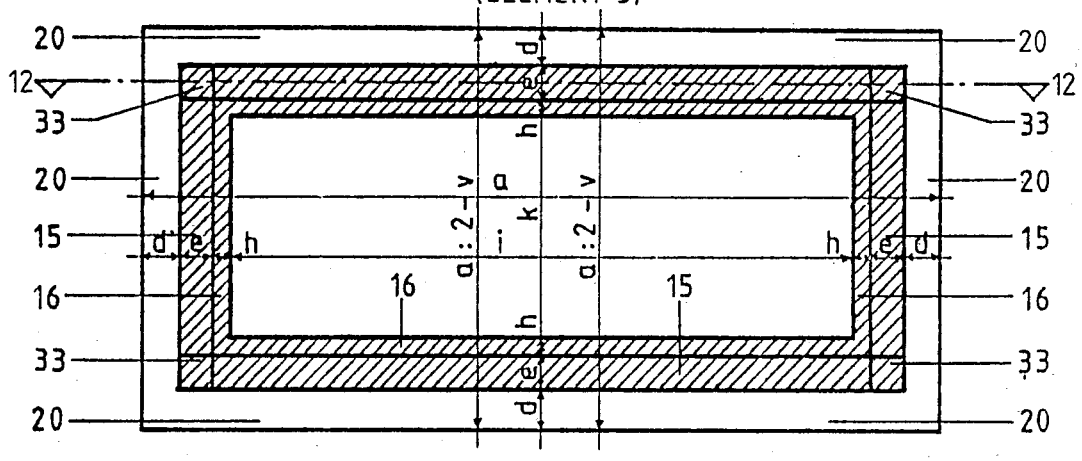
FIG. 13 shows the basic element (3) in horizontal section taken along line 13—13 of FIG. 12.
Figure 14:
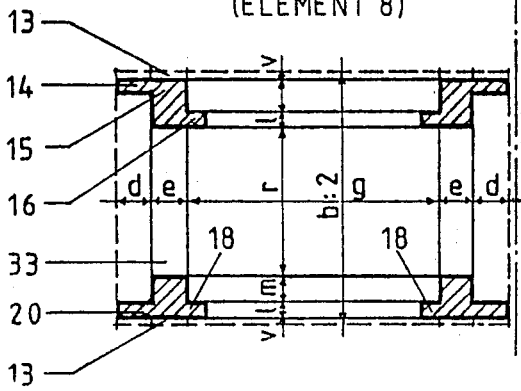
FIG. 14 shows the basic element (8) in an end view.
Figure 15:
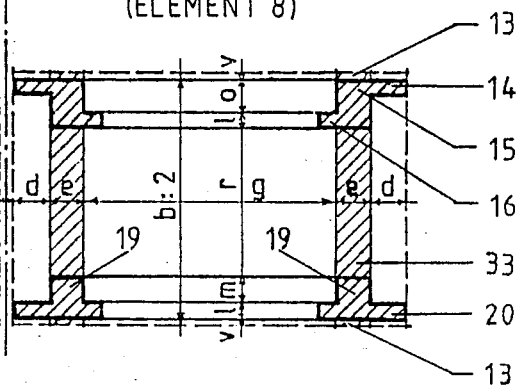
FIG. 15 shows the basic element (8) in cross-section.
Figure 16:
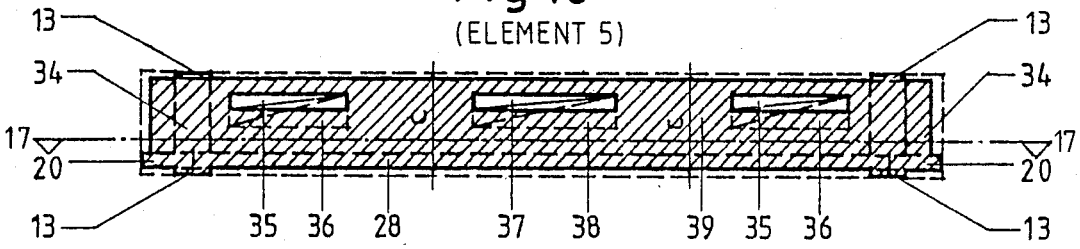
FIG. 16 shows the basic element (5) in longitudinal section taken along line 16—16 of FIG. 17.
Figure 17:
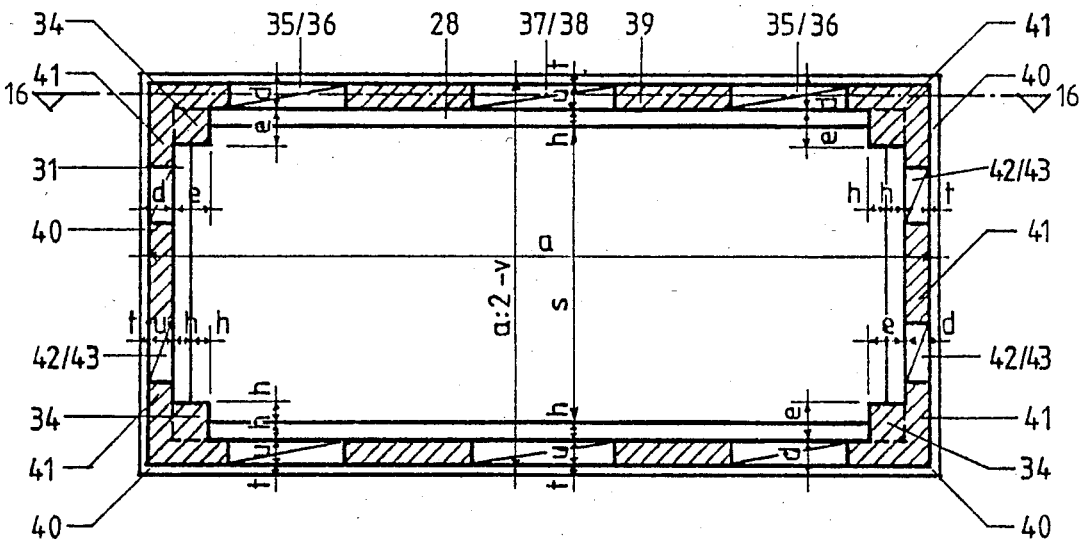
FIG. 17 shows the basic element (5) in horizontal section taken along line 17—17 of FIG. 16.
Figure 18:
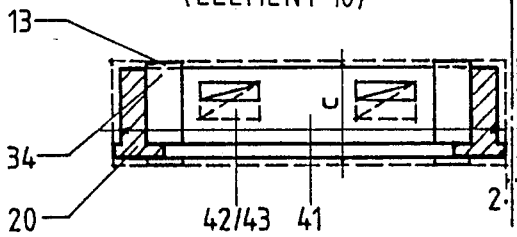
FIG. 18 shows the basic element (10) in an end view.
Figure 19:
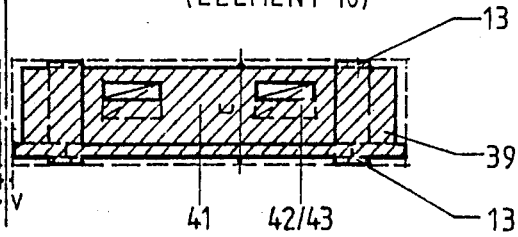
FIG. 19 shows the basic element (10) in cross-section.

FIGS. 12 and 13 show the basic element (3) and FIGS. 14 and 15 show the basic element (8).

Here, FIG. 12 shows the basic element (3) in longitudinal section, FIG. 13 shows the horizontal section of the element (3).

FIGS. 14 and 15 show element (8) in longitudinal-cross-section.

The basic element (3) has the same structural parts (13) to (21), with the exception of (17), as basic element (2).

The same applies for element (8) as compared to basic element (7).

The only difference between elements (3) and (8) is that the columns (17) are exchanged for the columns (33) with a lesser height (r).

The basic elements (3) and (8) are structural members which will generally be used in case high additional requirements with respect to space and technology exist above basic elements (2) and (7). But they will also be required in case that high additional foundation space requirements beneath elements (2) or (7) call for it.

FIGS. 16 to 19 show the basic elements (5) and (10). The basic element (5) is here shown in longitudinal section in FIG. 16, in horizontal section in FIG. 17, and in FIGS. 18 and 19 element (10) is shown in cross-sections of both ends.

With respect to basic elements (5) and (10) there is total identity of construction with basic elements (1) and (4) except for the fact that the four columns (34) are lower and the upper supporting beams for the roof are missing.

The elements (5) and (10) also differ from elements (1), (4), (6) and (9) because of lower continuous cross walls (41) and because of installation recesses as in elements (1), (4), (6) and (9), however of different sizes (35), (36), (37), (38), (42) and (43).

The basic elements (5) and (10) shall always be used when protectors for fascias, balconies and terraces have to be constructed or in case that above or below elements which have already been described small additional space for installations is required in an area of the foundation of technical installations. The fascia is a horizontal board covering the joint between the top of a wall and projecting eaves.

FIG. 20 shows not only elements (2') described above but also the staircase-element (1') for completion of basic element (1), with a stair head and a short single flight, for completion of element (3) it shows the additional staircase element (3') with stair head and a long straight flight (length of flight same as the length of flight in staircase element (2'), and for completion of basic element (5) it shows the staircase element (5') without stair head and a very fhort flight (e.g. for centers on top of a building).

Figure 22:
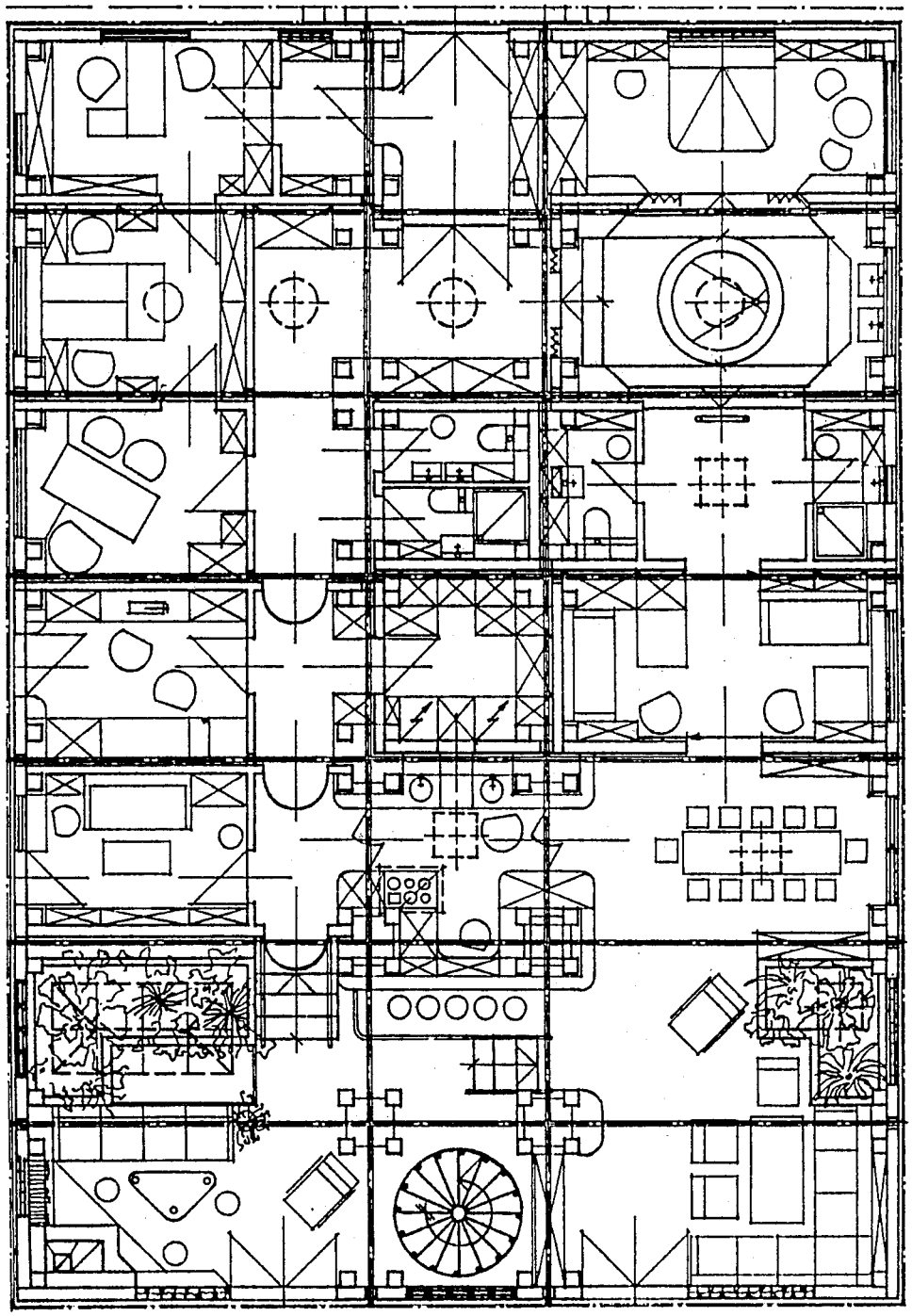
FIG. 22 shows the use of basic elements in a rectangular model house.

FIG. 22 shows use of basic elements in the case of a rectangular model house. Here, the basic elements (7)

are shown in dead center as vestibule, entrance hall, sauna rooms, pantry, kitchen, dining-bar with connecting stairs and circular stairs element with respective share of outer- and interior walls, technical installations and objects and built-in furniture.

On the right from top to bottom, the basic elements (2) are shown for a large bedroom a large bathroom (lowered), for a sports room with sauna rooms on both sides, for a guest-room (two persons), for a large dining-room for living-room space with winter garden and for a further living-room area—in each case with respective portion of outside—and interior walls, technical installations and objects, things built-in and movable furniture—also in complete outfit in which elements can leave the plant.

On the far left from top to bottom the basic elements (2) are shown with all structural-, technical and other installations for an office room with vestibule, each with two office rooms with a portion of corridor, domestic economy rooms with corridor, playroom with corridor area, large winter garden with connecting stairs and a large room with fireplace.

In this example, it is demonstrated that the overall base of elements (2) and (7) meets space requirements in residential- and office buildings specially well.

Figure 23:
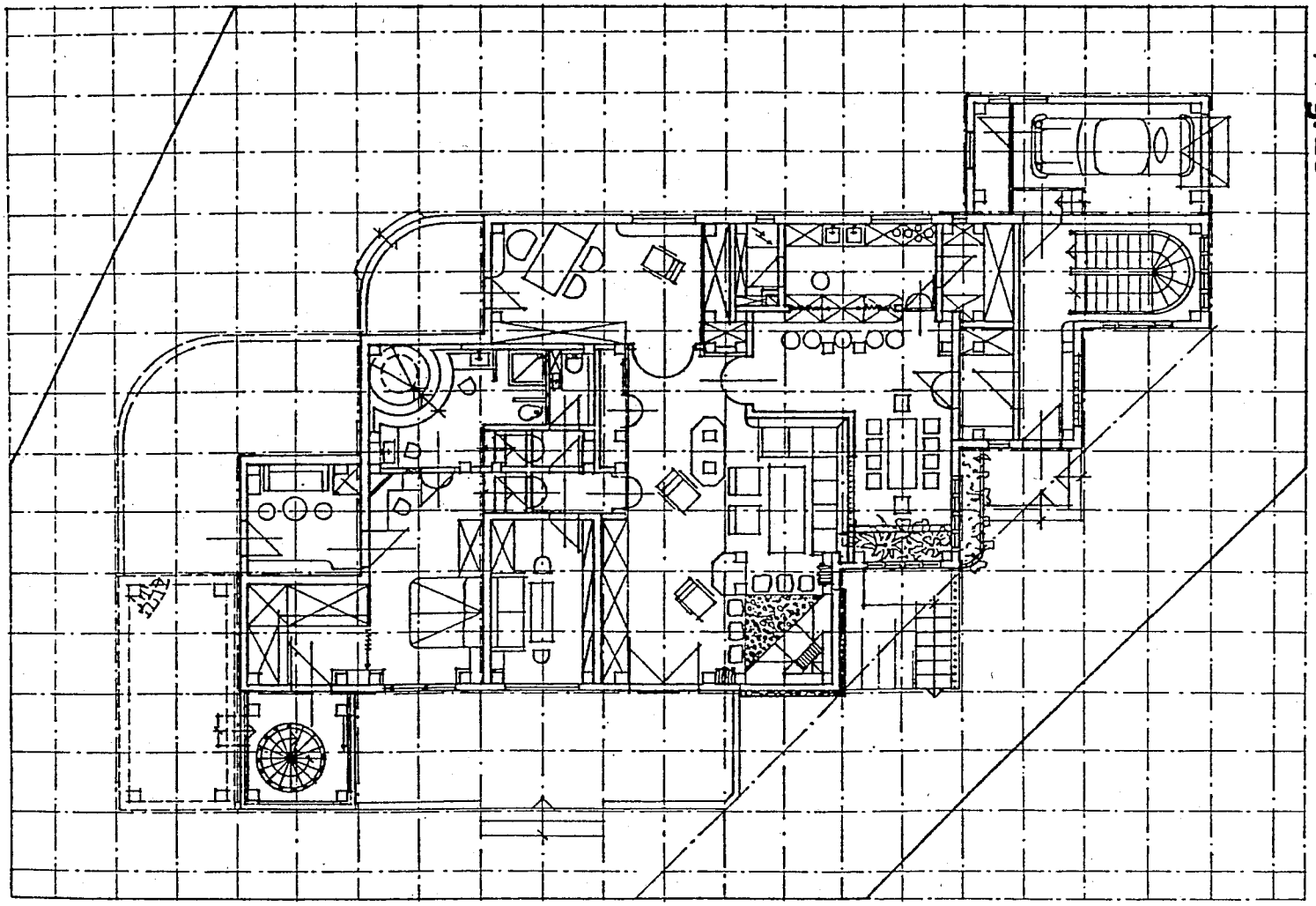
FIG. 23 shows the use of basic elements in a ground floor plan of a model house on an unfavorably cut shape of up to 45 degrees using basic elements (2) and (7).

FIG. 23 shows that in case of use of full story elements (2) and (7) it is possible to cover even properties with an unfavorable cut and making optimal use of it—in this case with premise boundaries with a slope of up to 45 degrees.

FIG. 23 also shows further examples for application of full story elements (2) and (7) in domestic architecture, i.e. an example for application as a model home with graded outline of the ground floor plan.

The full story element (2) is here shown as used for a garage with room for tools and connecting stairs, a dog-legged stair with 180 degrees helix and portion of pantry, dining-room with winter garden, eating-bar and portion of bathroom with shower and bidet—with toilet and anteroom and connecting stairs, wardrobe and ladies' room and swimming-pool which is lowered to upper surface of terrace.

FIG. 23 also shows further full story elements (7) used as:

Vestibule- and hallway element, element for portion of living-room with storage cabinet and staircase element with winding stairs of minimum diameter.

Figure 24:
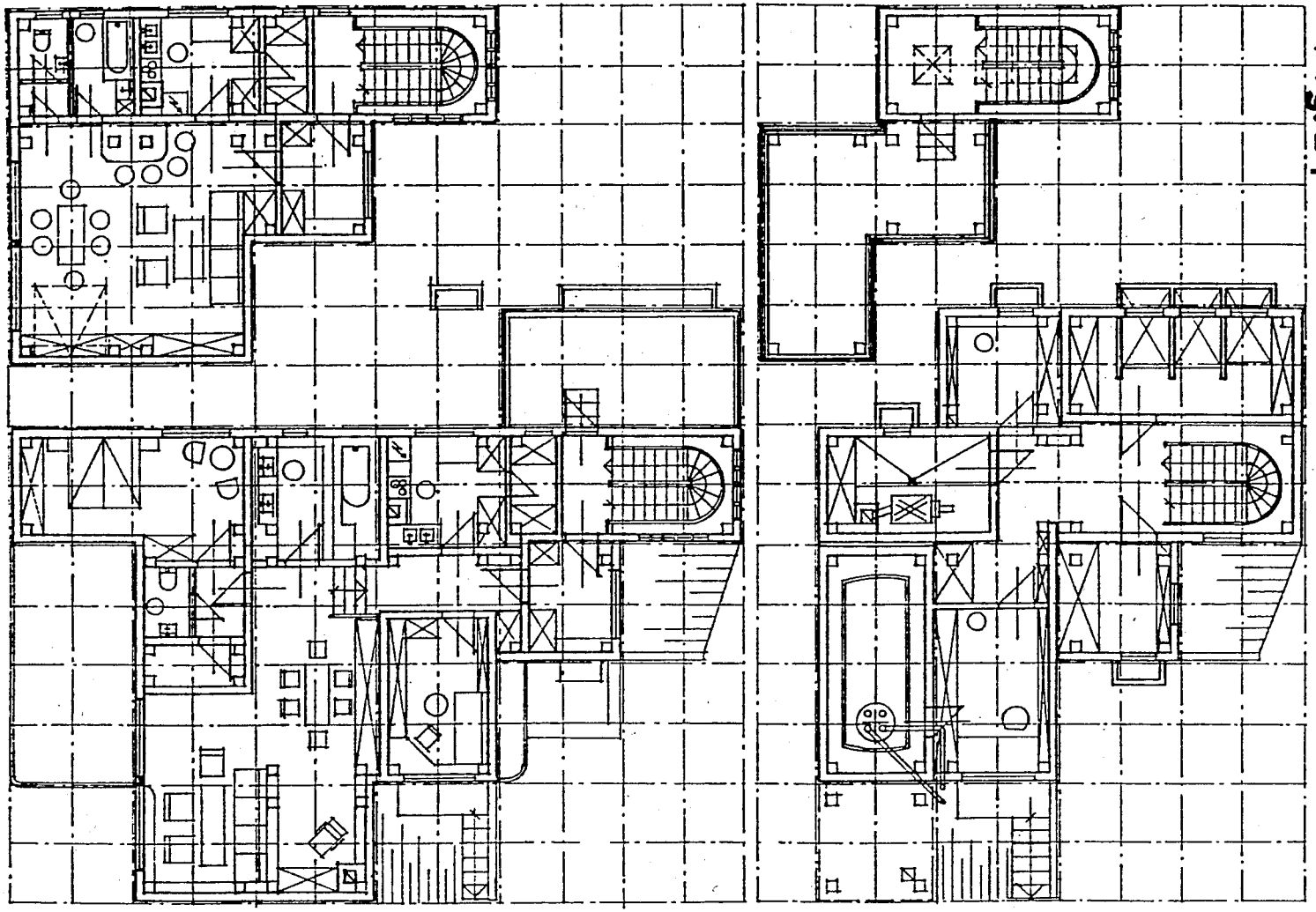
FIG. 24 shows a possible basement or superstructure subsystem for the ground floor plan shown in FIG. 23, using basic elements (2) and (7) in the basement and basic elements (2), (5) and (7) in the superstructure.

FIG. 24 shows a possible basement subsystem with respect to the ground floor plan shown in FIG. 23, using basic elements (2) and (7).

Basic element (2) is here shown in its use as:

Storage room for solid combustibles, furnace room with fire-place and portion of hallway, workroom with portion of hallway and tank room.

Basic element (7) is shown as:

House service connection room and basement housing space.

FIG. 24 also shows a possible subsequent superstructure for the ground floor shown in FIG. 23. Here, the basic element (5) is shown in its use as a balcony on top of the garage with connecting stairs and as a terrace on top of the roof.

FIG. 24 shows further possible superstructure on top of the first floor described above.

FIG. 24 also shows a further possible raise on top of the second floor, displaying a full story element (7) and a full story element (2) in use as terraces for drying of laundry and sunbathing.

Altogether, a building E+3 can be erected in intervals without costs for remodeling.

Figure 25:
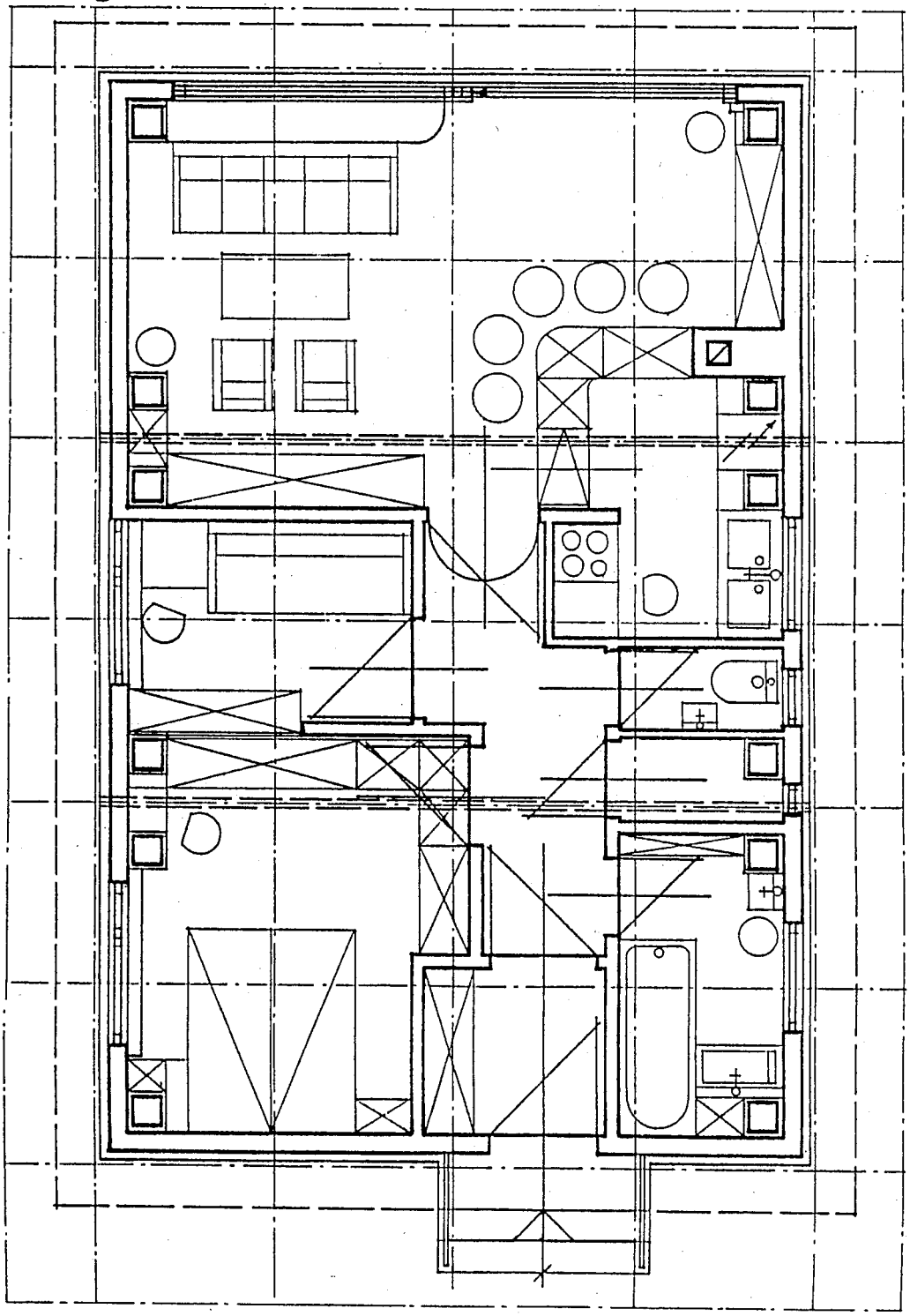
FIG. 25 shows an example of a rectangular model home having a ground floor with a spacious three room apartment.

FIG. 25 shows an example of a rectangular model home that only three full-story elements (2) are sufficient for accommodation of a one-family house having a ground floor with a spacious three-room-apartment.

Figure 26:
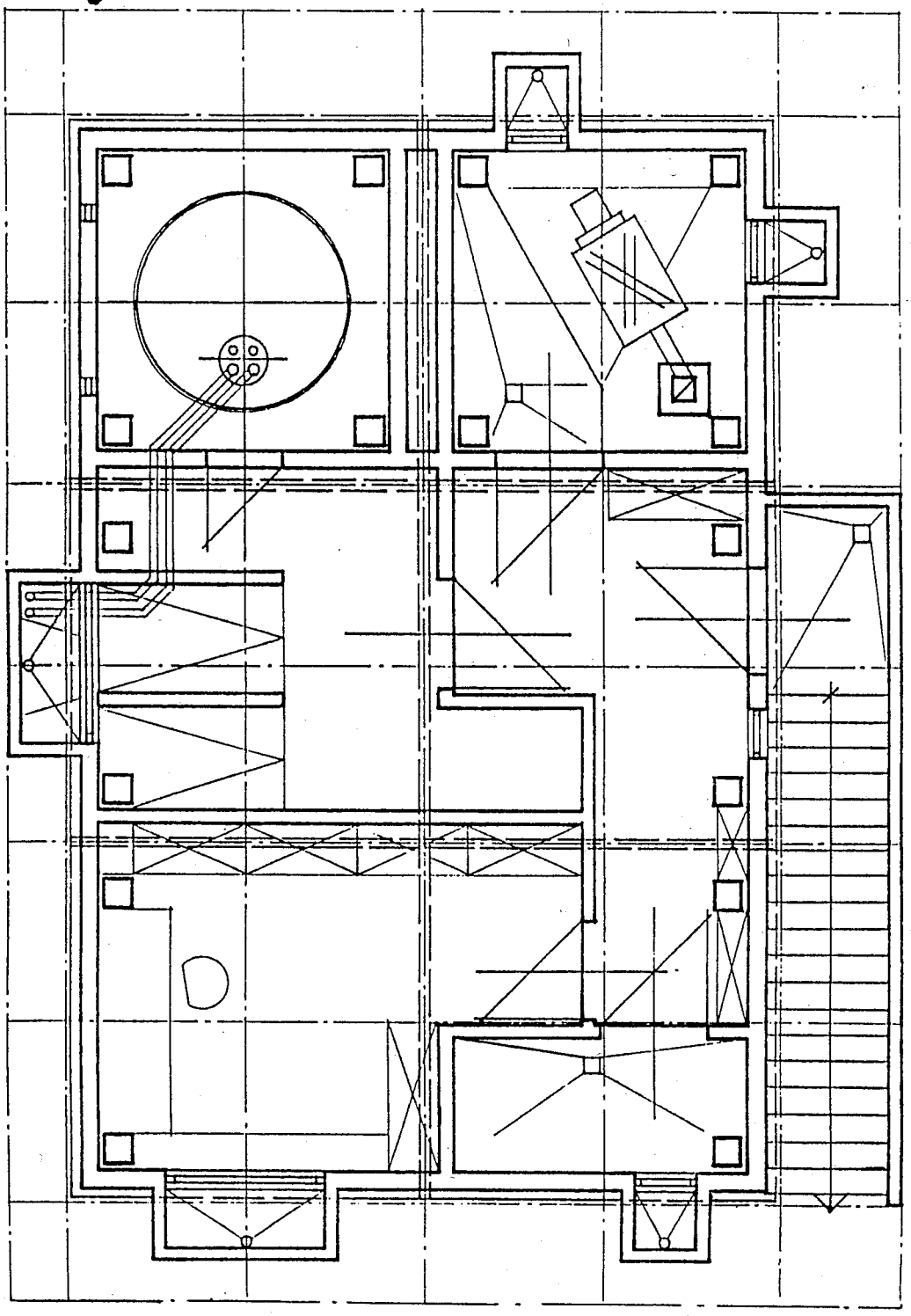
FIG. 26 shows a complete basement for the rectangular model home shown in FIG. 25.

FIG. 26 shows that three additional full story elements (2) are sufficient for a complete basement of the rectangular model home shown in FIG. 25 in order to have space for the following rooms: furnace rooms, room with oil tank, room for solid combustibles, hobby room and house service connection room.

Required day shafts are already connected with elements on site. Exterior basement stairs might be delivered as single elements, or in whole or in parts, also connected with the full story elements at the site.

Figure 27:
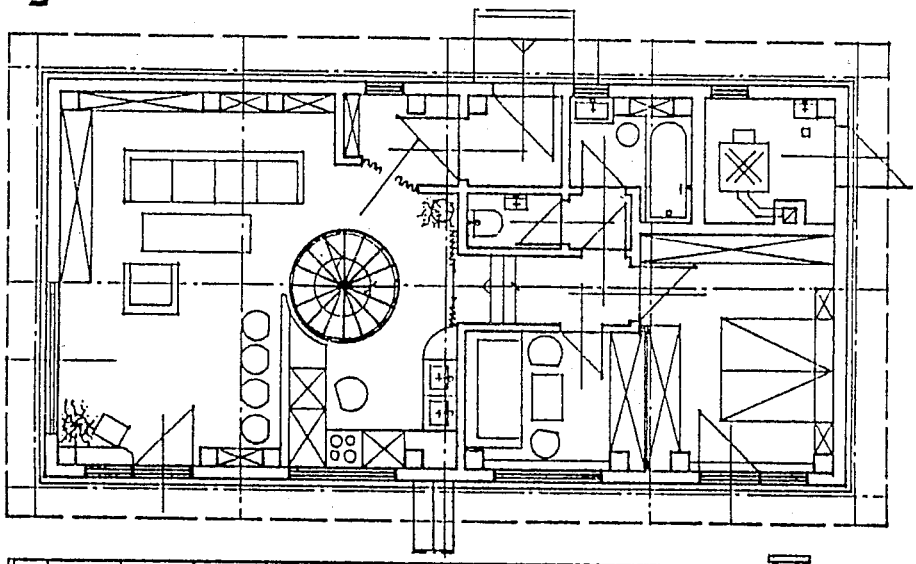
FIGS. 27, 27*a*, 27*b*, and 27*c* show four views of a house without a basement but with circular stairs and a 45° gable roof.
Figure 27A:
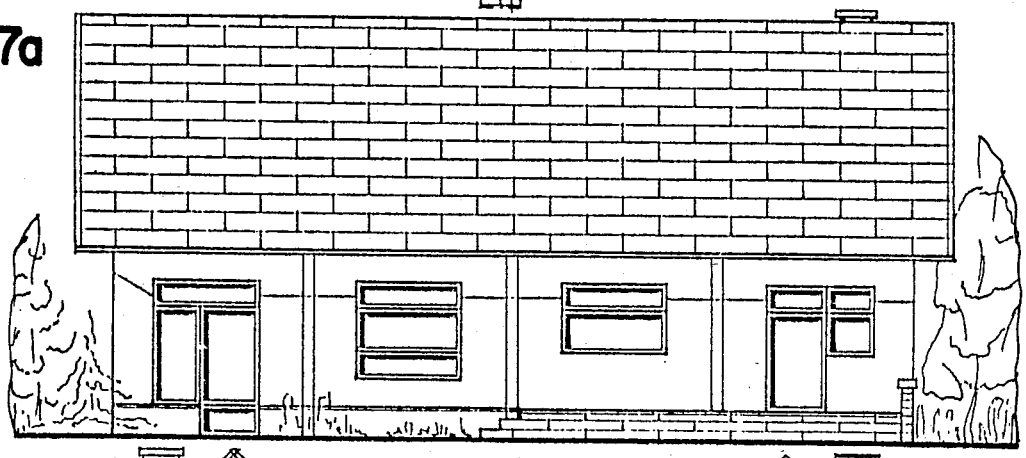
Figure 27B:
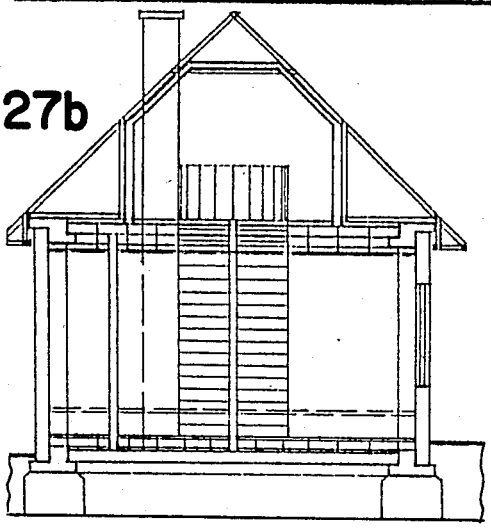
Figure 27C:
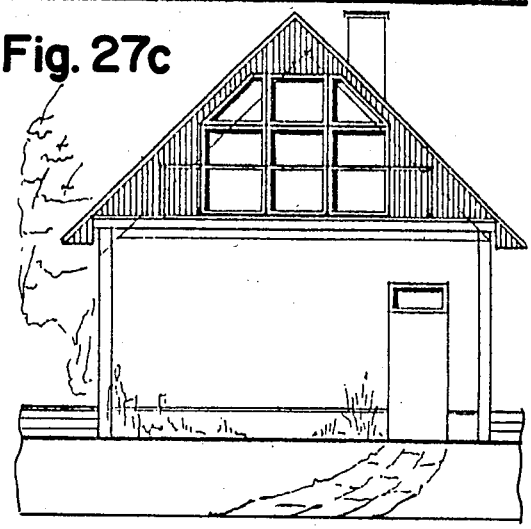

FIG. 27 shows a further example for application of a full-story element (2) as a one-family house with rectangular base but without basement.

FIG. 27 shows sections of the one-family house without a basement across element (2) with circular stairs and a 45 degrees gable roof.

FIG. 28 demonstrates, in an example and angular model home, further use of full story elements (2) and (7), whereby all elements of the example in FIG. 27 are used again with only slight remodeling in some cases.

Thus, use of elements makes it possible to turn a rectangular one-family house without a basement and of medium size with a gable roof into a large one-family house of angular shape with a complete basement and a corner roof.

FIG. 28 further shows three full story elements (2) in horizontal section as used for a large swimming pool facility with sauna and engine room and an element (7) for a terrace in ground floor horizontal section.

FIG. 29 shows a longitudinal section of a roof and floor slab for elements (2) and (3).

In FIG. 29.1, horizontal sections of cover plates of elements (2) and (3) are shown. Four installation recesses with cross-sections (0.30/0.30 m) have been prepared in interior corners of roof construction, e.g. the interior supporting beams for roof- and cover plates (93). Circular cutouts for winding stairs (50) are indicated for a diameter from the inner edge of one floor beam to the inner edge of another floor beam, respectively, the inner edge of one girder to the inner edge of another girder.

FIG. 29.2 shows two horizontal sections of roof- and floor slab layers of elements (7) and (8). These elements also have installation recesses (93) in each of their four corners, prepared with a cross-section of (0.30/0.30 m). Possible circular cutouts (50) in cover plate layers are also indicated here.

FIG. 29.3 shows a longitudinal section of a roof/floor slab meant for elements (2), (3), (7) and (8) as well as a cross-section of a roof/floor slab for elements (7) and (8).

FIG. 30 represents the roof/floor slabs for elements (1), (4) and (5) in longitudinal section.

FIG. 30.1 shows a horizontal section of roof/floor slabs of elements (1), (4) and (5).

FIG. 30.2 shows two horizontal sections of roof/-floor slabs of elements (6), (9) and (10).

FIG. 30.3 shows a longitudinal section of a roof/floor slab of elements (1), (4), (5), (6), (9) and (10) and a cross-section of plates for elements (6), (9) and (10). Circular cutouts for winding stairs (50) and installation recesses (93) with cross-section (0.30/0.30 m) in all four corners of the roof-cover plate-constructions are also indicated in the roof/floor slabs for elements (1), (4), (5), (6), (9), and (10). Cutouts and recesses are exactly above or below those of the elements (2), (3), (7) and (8). However, because of different element construction, they do not touch structural parts of the element itself.

FIG. 31 shows possible roof/floor slab layers in graphical representation (vertical section) with indiscriminate arrangement of basic elements (1) to (10), one beneath the other. FIG. 31 demonstrates, especially in case of the staircase in the center, that the basic elements (1) to (10) have the special feature that they can be passed through without change of ratio of rise. But it also becomes clear that cover plates might be located on any level within the height grid with minimum spacing of 0.85 m within a standard grid with 1.05 m in height. On the other hand it is possible just the same to execute even high towers and shaft facilities merely with a roof slab without any intermediate layers of cover plates.

Figure 32:
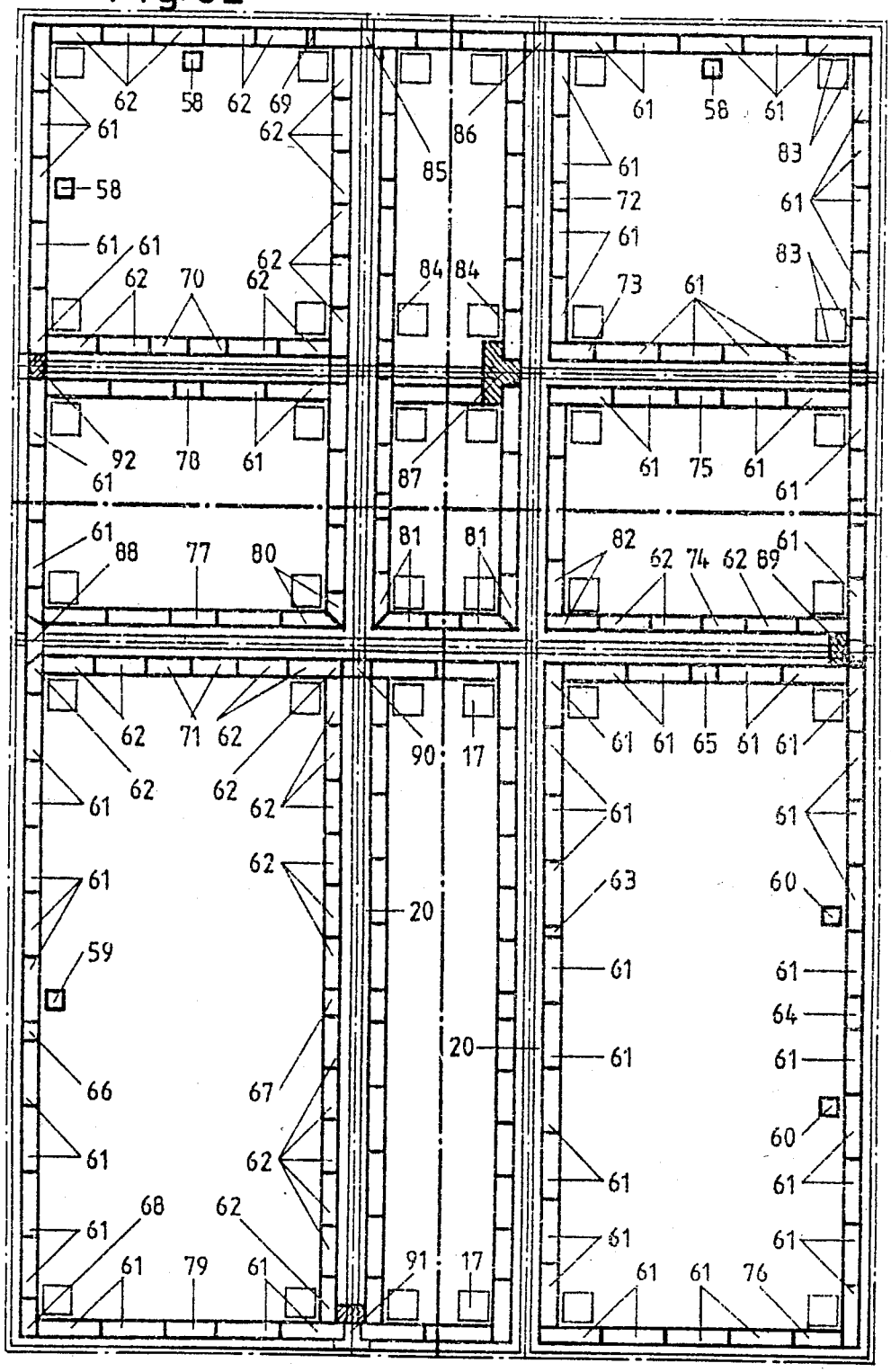
FIG. 32 shows possibilities for the construction of exterior walls using concrete slabs.

FIG. 32 only epitomizes possibilities for the construction of exterior walls using concrete slabs with widths of 50 cm or 62.5 cm and also represents some examples for additional arrangement of auxiliary columns so far as these are required statically.

Special emphasis is on mitred corners of outer walls (80) and (81), since this arrangement is highly advantageous in the course of the installation of outer walls made of concrete slabs for the basic elements (2), (3), (7) and (8) and also on various constructions for closing of the facade between elements, such as outer wall element joint (87) by placing a fitting slab behind from one column to the next, outer wall element joint (88) by placing a fitting slab shaped like a truncated pyramid therebehind, outer wall element joint (89) by placing a fitting slab between two "outer walls", outer wall element joint (91) by placing a T-fitting piece into an exterior corner of moulding and placing a fitting slab between two "outer walls".

Main outer walls will generally not be found in construction with elements of the present invention.

Auxiliary columns (58), of medium height according to requirements, are fixed on bottom in center; auxiliary columns (59), of three-quarter height according to requirements, are fixed on bottom in center, and auxiliary columns (60) are fixed on top and bottom according to requirements and statical analysis.

Figure 33:
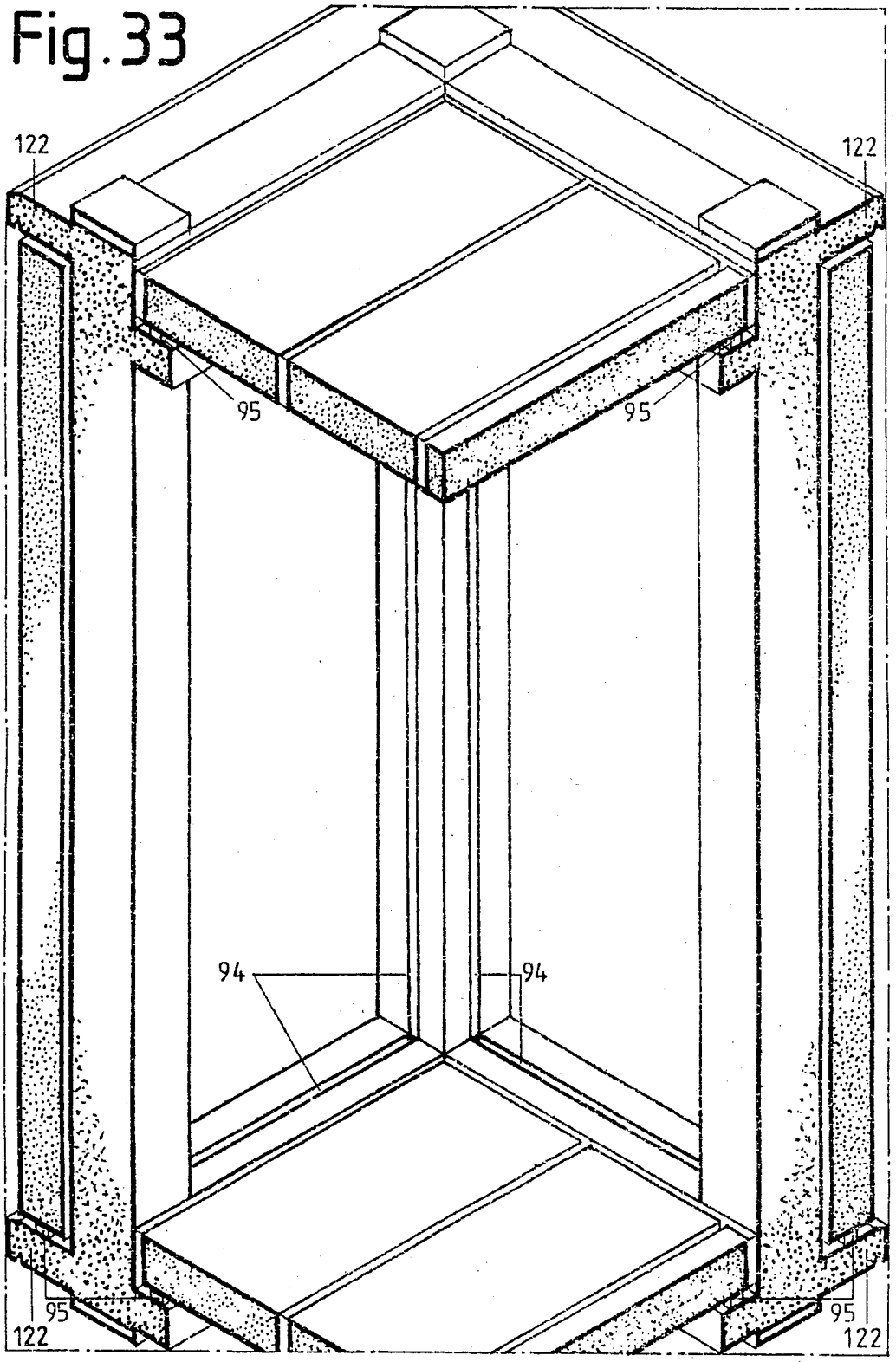
FIG. 33 shows a perspective view with sections of basic elements (2), (3), (7) and (8).

FIG. 33 shows a perspective view with sections of the most important details of the construction of basic elements (2), (3), (7) and (8) which have been described so far with outer walls and roof/floor slabs.

FIG. 33 also shows three additional features for construction using basic elements:

As a general principle, all projecting ring beams on top or bottom are shaped like a window drip (upper bevel and lower drip nose) in outer third.

Generally, all outer and interior walls and all roof/-floor slabs will be carried on PVC- or rubber bedding in dead center of supporting joints and on principle with height (v:2).

Especially for support of outer wall loads the basic elements (2), (3), (7) and (8) will have four sets of continuous anchor rail rings—profiled according to statical requirements—each in the center of inner sides of columns and the top- and the bottom side of bearing beams.

Figure 34:
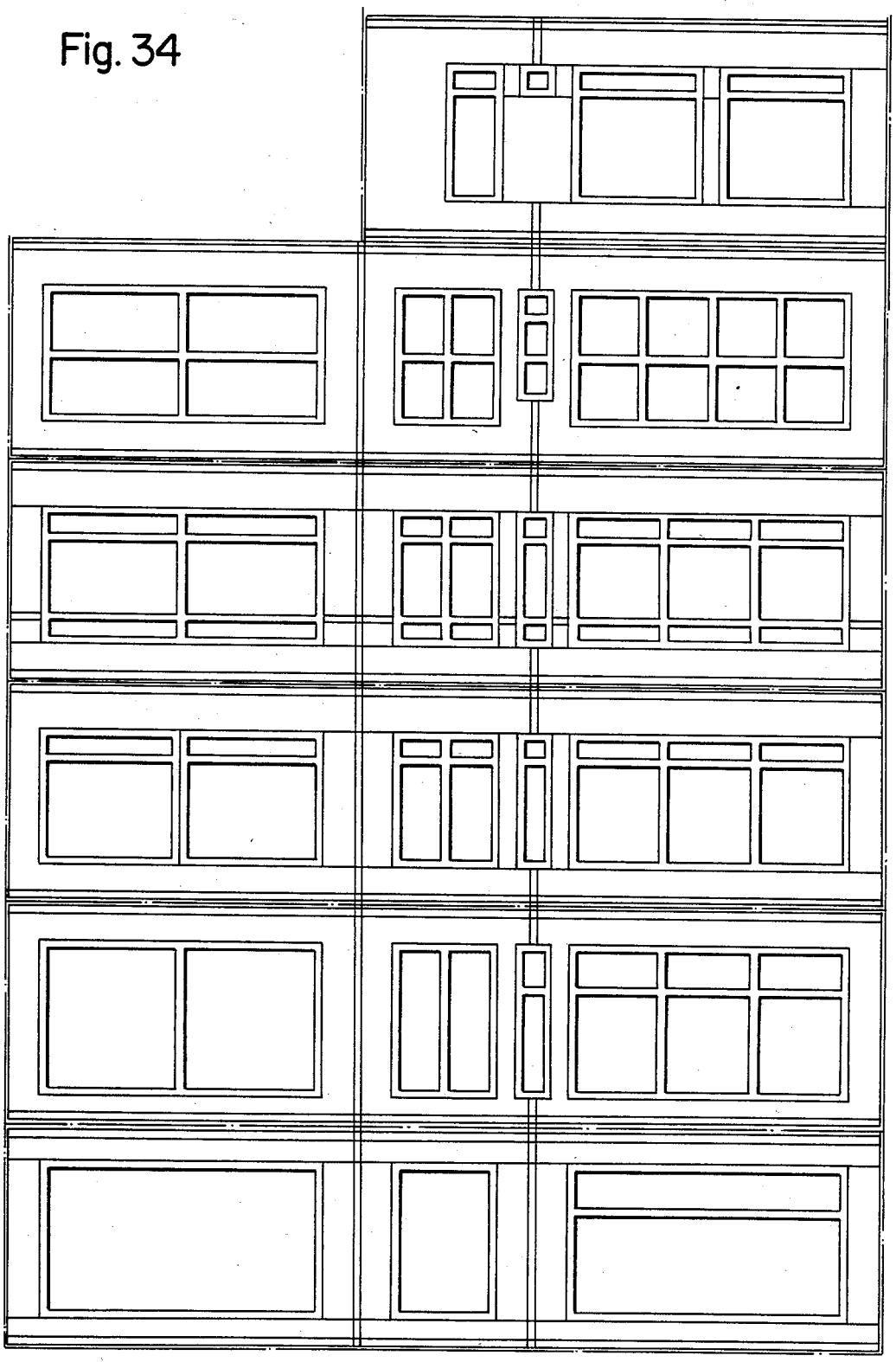
FIG. 34 shows the largest openings possible in the outer walls of basic elements (2) and (7).

FIG. 34 represents the largest openings possible in an outer wall.

Those openings might always extend in an unfinished state (width and length) of basic elements (2) and (7) from one support to the next. Even the small strip between two columns at a transition from one element to the next might be used for creation of openings in an outer wall in total width of space between columns. The clear height depends upon prospective use or upon the degree of extensions at full story elements. However, the total clear height of the interior space might always be the same as the height of outer wall openings to be constructed.

For construction of facades it is possible to utilize the upper or lower projecting ring beam which results from construction of the basic elements (1) to (10) for purpose of accentuation of the horizontal line, as is shown in FIG. 34.

Outer wall joints necessarily exposed will—with restrictions—only occur at joints between elements, and will be spaced according to the overall length of basic elements (1) to (10).

All multishell outer wall systems known can also be installed into basic elements (2), (3), (7) and (8) in addition to use of concrete outer walls with exterior plastic lamination.

In the case of the outer wall constructions mentioned so far, it is also possible to not use element joints vertically and to arrange them differently in other places according to the designer's perception. It is even possible to not use joints and projecting beams in one level at all by choosing a multishell outer wall system with, e.g. an exterior light metal facade shell which will then span across the face of the projecting beams and thus cover even this structural part of basic elements (1) to (10).

Highly varied alternatives of facade styling for design reasons, however, are possible specially with solid wall connections such as:

a wall slab with a truncated pyramidal cross-section (88) (forming two vertical joints spaced wider than the wall slab itself) and the T-shaped wall connecting part—which is even with the projecting beam at the outside—in connection with horizontal element joints and projecting beams.

It must be stated that basic elements (1) to (10) constructed according to the invention leave architectural facade styling open to any option.

Figure 35:
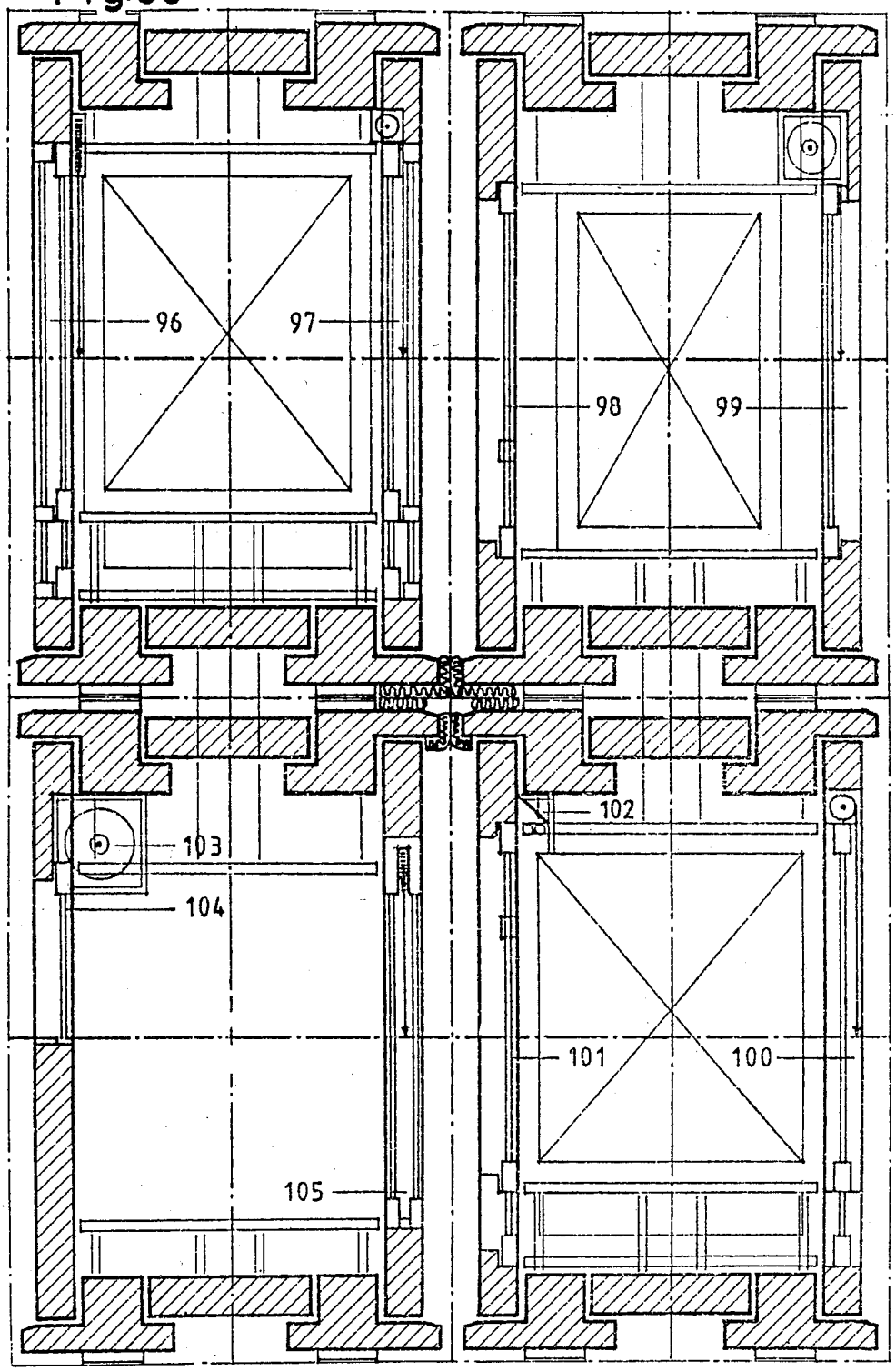
FIG. 35 shows the vertical section of some examples from the number of possible constructions of openings in outer walls.

FIG. 35 shows the vertical section of some examples from the number of possible constructions of openings in outer walls.

Besides, top left of FIG. 35 shows a double window- and door construction with offset interior venetian blinds and with the same height as space between a suspended ceiling and an elevated floor, i.e. a floor covering on top of a bare floor.

On the upper right side of FIG. 35, a double window-door installation (97) is shown in the center with the same height as above and with a small window shade casing for a shade moving between the window constructions.

On the upper right, it is depicted that it is necessary to lower the suspended ceiling and, if necessary, the elevated floor in case of window/door openings with a window shade casing.

On the upper right, left of dead center a door/window opening is shown with a springer (98) at bottom and on upper right a single window/door construction without division with window shade (99) is shown on the outside.

FIG. 35 also shows on the outside of lower left that the largest possible window shade casings (103) for door/window height of approx. 3.00 m always form an exposed casing even below suspended ceilings.

On the lower left side of FIG. 35, a door/window element can be seen in the center, with double shell construction and venetian blinds (105).

On the extreme left side of FIG. 35, a single window (104) is shown, extending only from a lintel, a horizontal member spanning and opening and carrying the load thereabove.

FIG. 35, lower right, shows two more possibilities with respect to the height of door/window constructions in case these extend from a suspended ceiling to an elevated floor or floor construction on top of a bare floor.

On the lower right side of FIG. 35, a single door/-window element with divisions for a springer on top and bottom (101) and a casing for indirect lighting (102) at the lintel is shown in the center.

A single window/door combination with only one springer and a window shade casing (100) installed above is shown on the lower right.

Figure 36:
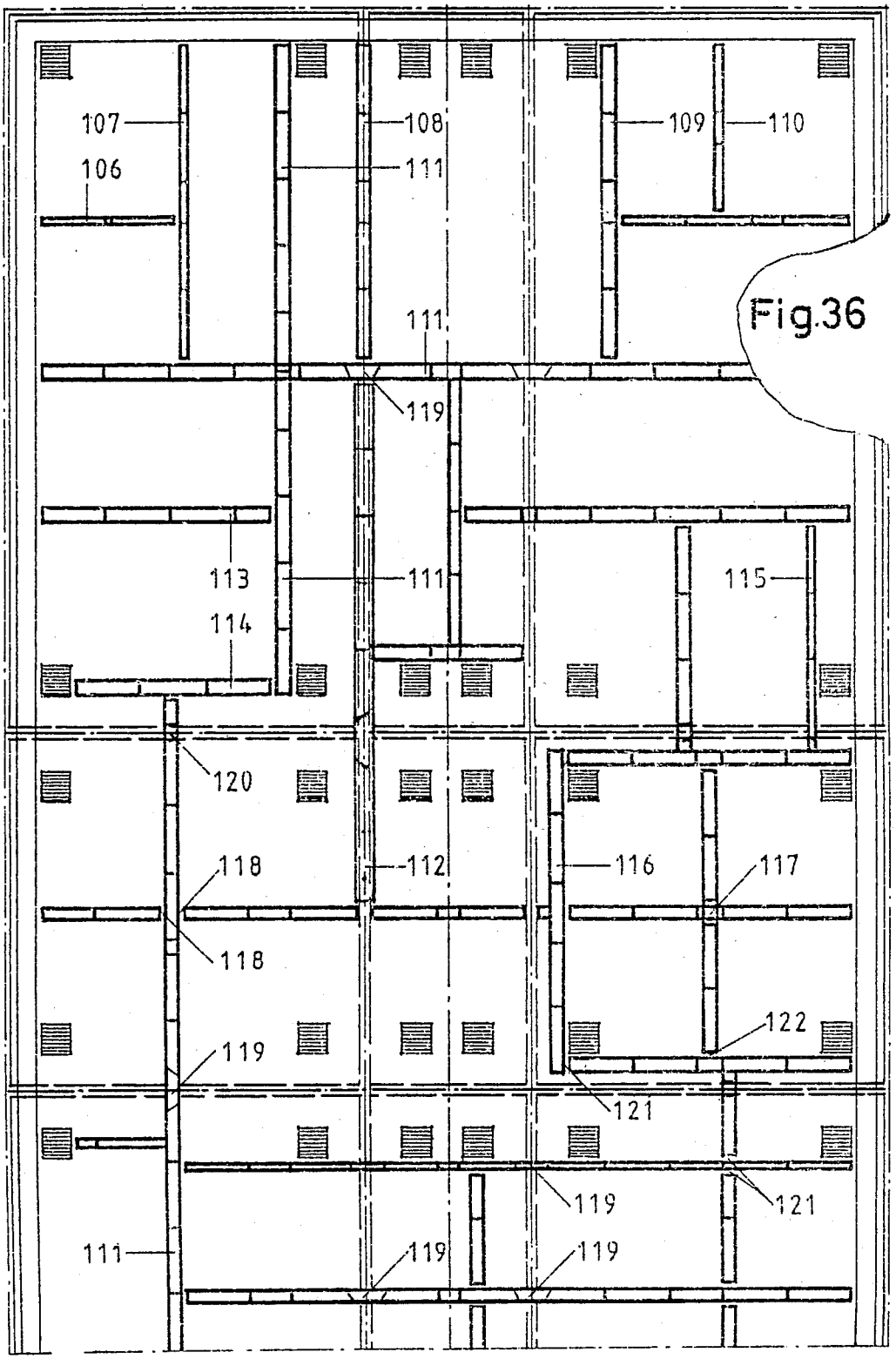
FIG. 36 shows a few examples of interior walls, solidly joined together with concrete slabs.

FIG. 36 shows interior walls. Generally, these are not main walls in case of construction with elements of the present invention. Interior walls can be erected within full story elements (2) and (7), in thickness commonly used for this purpose and even in thickness like outer walls and at any place within the overall element base (except only total width of joints between elements).

Out of an immense number of variations possible according to the layout, FIG. 36 shows just a few examples of interior walls, solidly joined together with concrete slabs. Interior walls can generally also be furnished for light portion walls in all known multishell wall systems.

If necessary, special connection parts required for closing of gaps between interior walls at joints between elements shall be produced. FIG. 36 shows a concrete slab with a truncated pyramidal cross-section (119) or a rectangular, but joined slab strip (120) for this purpose.

For framed door openings in interior walls of any size it would be appropriate to use only well-known telescopic frame elements (if necessary, with slight adjustments to fit).

Figure 37:
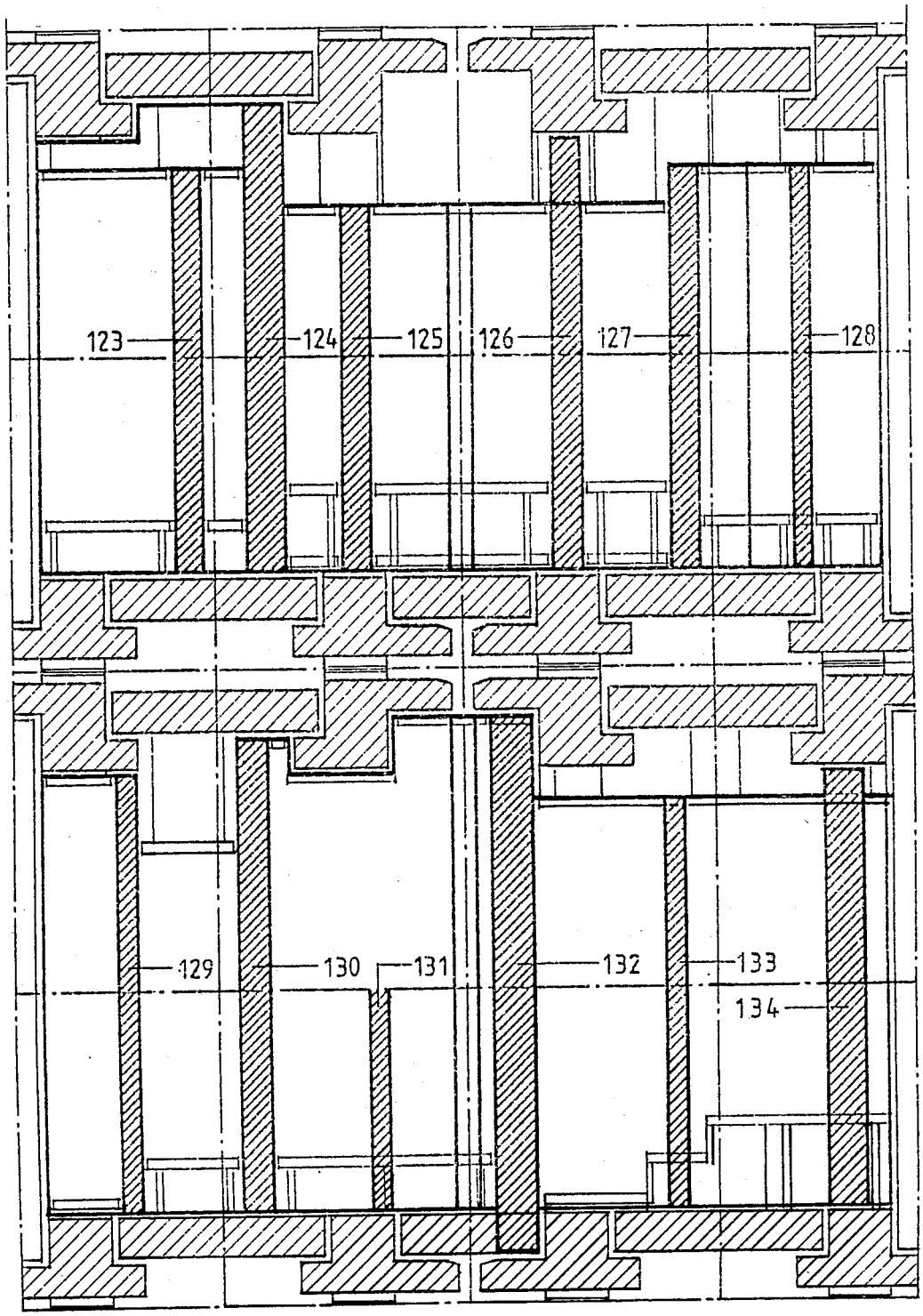
FIG. 37 shows interior walls in vertical-section at various heights.

FIG. 37 shows interior walls in vertical cross-section at various heights.

The following interior walls are depicted in FIG. 37, upper left to right:

A light partition wall (123) with 15 cm thickness, top terminating within a suspended ceiling, a fire wall/partition (124) between apartments or buildings with 20 cm thickness, extending up to the top edge of interior bearing beam, a lower interior partition wall (125) terminating in a suspended ceiling, an interior wall (126) of 15 cm thickness height from top surface to bottom surface of bearing beam, an interior partition wall (127) with 15 cm thickness extending up to the higher ceiling of two suspended ceilings at different levels and the thinnest interior partition wall (128) (10 cm thicker) of medium height, terminating at the upper side of a suspended ceiling. Since generally there will be no interior main walls in case of construction with elements of the present invention, it holds true for interior walls, light partition walls, partition walls between apartments and buildings—as described above and below—that they might completely be produced as lightweight construction. FIG. 37 altogether shows only solid walls, assembled with concrete slabs.

The lower left to right views of FIG. 37 show sections of additional interior walls with respect to height such as:

Thinnest partition wall (129), only 10 cm thick, up to the bottom side of a running upper interior floor beam, an interior wall (130) 15 cm thick, constructed from a top edge bare floor to a bottom edge bare ceiling, an interior wall (131) through an elevated floor but with height less than the room, the fire or partition wall (132) for apartments or buildings best suited for construction with elements, 20 cm thick, having a height from the top edge of lower projecting beam to the bottom side of top projecting beam (like an outer-wall), a partition wall (133) only 10 cm thick, terminating at the top side of the suspended ceiling, and another fire- or partition wall (134) between apartments with 20 cm thickness, however, having a height extending only from lower to an upper bearing beam.

Apart from the only exception where interior walls might have the same height as outer walls, all various kinds of interior walls will be erected on the top side of a bearing beam or on top of lower cover plates with joint spacing (v:2), as a matter of principle.

Figure 38:
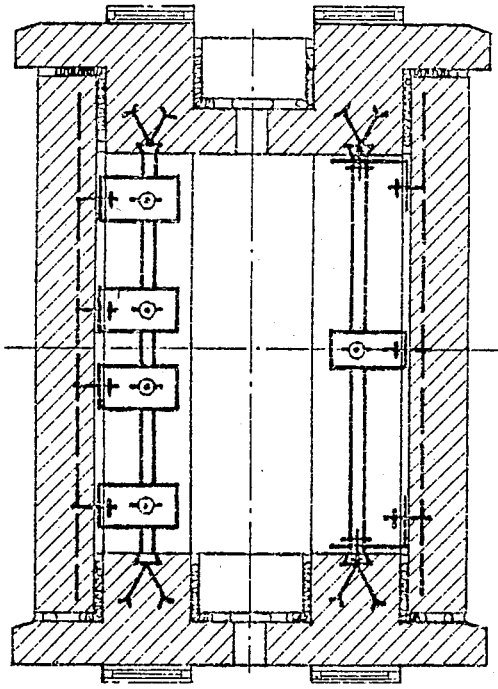
FIG. 38 shows steel connecting angles for fastening of outer walls in continuous anchor rails.

The upper left side of FIG. 38 shows construction and erection details such as joints, anchors, and supports for ceilings and walls.

The right side of FIG. 38 shows the following features:

Outer wall elements made of contrete have threaded bolts connected to the reinforcement. The front surfaces of the bearing beam receive an adhesive heat insulation. The outer wall will be erected on rubber—or soft PVC profile (v:2) high, at the exterior of lower projecting ring beams. The threaded bolts will be anchored by means of steel angle plates and aligned in the anchor rails which are imbedded in the center of the supports. The resultant joints (v:2) between the outer wall slabs and upper and lower projecting beams as well as upper and lower bearing beams will be padded with heat insulation material and sealed at outer ends for permanent elasticity. Outer wall loads will not burden the lower projecting beams in case of the specific method of construction with elements. Ceiling- and cover plates made of heavy- or light concrete will also be carried high on interior bearing ring beams on top of rubber- or soft PVC joints (v:2). The resultant running vertical and horizontal joints will either be filled with plastic material or stuffed with heat insulation material and completely sealed elastically, if required, and made to last.

Note on Principle

All exposed steel parts used for construction with elements of the invention will basically be coated in such an manner that rust formation will be prevented for the long-term.

FIG. 38 represents steel connecting angles whose size and quantity for fastening of outer walls in continuous anchor rails depends on statical analysis. This also applies to arrangement of mounting angles. FIG. 38 shows on the right the possible method of erection, already described above, with respect to outer walls by means of fastening in the lintel area against the lower side of an upper bearing beam or fastening of the outer wall base area against a top side of a lower bearing beam and only one medium-size mounting angle against the support.

Figure 39:
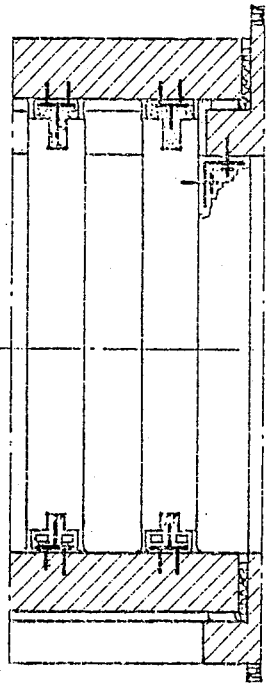
FIGS. 39 and 39*a* show two views of the formation and erection of fire walls.
Figure 39A:
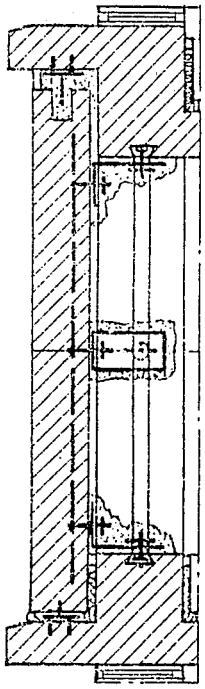

FIG. 39 shows the formation and erection of fire walls as an element-frame and as a ceiling with joints, anchor- and bedding connections in each case.

FIG. 39 shows a fire wall at left of its left half which closes from the top side of a lower cover plate up to the bottom side of an upper ceiling. For erection of a wall a steel T-profile with a short standing web will be fastened to the lower cover plate. On the left and on the right of this web, a joint filling agent made of rubber or soft PVC will be glued on. In order that the fire-wall is held against the bottom of the upper ceiling, there is also a steel T-profile attached but with a longer standing web. The concrete slabs for fire walls shown have a groove on top and bottom, the top one deeper than the one on bottom. While erecting the wall, the lower web-, bedding construction will be embedded in cement- or plastic mortar, the wall slab will be lifted with its upper groove up to catch above upper web and will be let down on lower web and bedding profiles. An upper groove and joint at the ceiling will be closed with pure cement mortar or short-time plastic mortar. The joints at top and bottom cover plates, closed in such a manner, will then finally be jointed at both sides elastically, and made to last. Instead of mortar joints it is possible to close with cement-asbestos fibre material.

FIG. 39 shows at right of its left half, the erection of a fire wall, however, its top is arranged against the front of a bearing ring beam. In this case, the alternative or additional method of fastening by means of a mounting angle made of steel, against the bottom side of a bearing beam and towards the surface of the fire wall, presents itself. This angle and its steel mounting parts shall be coated with a well-known fireproof material.

On the right side of FIG. 39, a fire wall is depicted which is equivalent to an outer wall with respect to the height and its arrangement in connection with the shell of an element frame. This wall, to begin with, can be erected with the same means as described above and can be mounted as a fire wall, against the front of an upper and lower bearing beam and towards the projecting beams. However, this wall will be held and supported by the three steel mounting angles. These angles must also be coated—however, in this case including anchor rails—with well-known fireproof materials.

FIGS. 38 through 41 show generally the formation and mounting of interior partition walls of light construction with joints, anchors and bedding.

Figure 40:
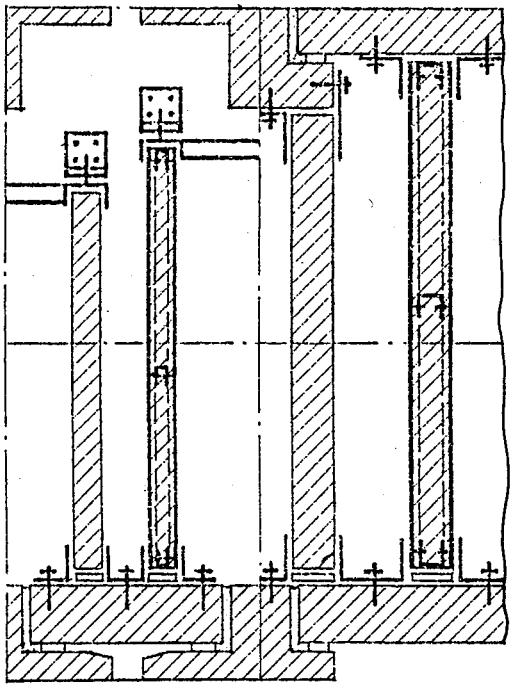
FIG. 40 shows the mounting of interior walls.

FIG. 40 depicts in the outer left half view, the mounting of interior walls—e.g. made of solid concrete—with the top against part of the shell of elements of the invention. These walls will be embedded in a shaped joint tape, (v:2) high, between two continuous steel angle rails on top of the bare floor. The top of these walls will be held by means of channel steels laid over it and mounted against solid outer wall slabs by means of steel angle plates.

On the right of the left half side of FIG. 40 a two-shell light construction partition wall is shown, which also does not extend in height up to solid parts of the shell frame, and thus will be mounted with all parts as described above.

FIG. 40 shows in its right half interior walls with their mounting parts in case, where the top of these walls connects to shell parts (element frame or cover plates). In this manner, e.g., a wall made of concrete slabs, which is flush with the front of the shell part and which will only be held by means of a flat steel strip and a continuous steel angle, will be mounted on the other side.

Extreme right side view of FIG. 40 also shows the mounting of two-shell light construction partition walls against a solid cover, also on top.

Figure 41:
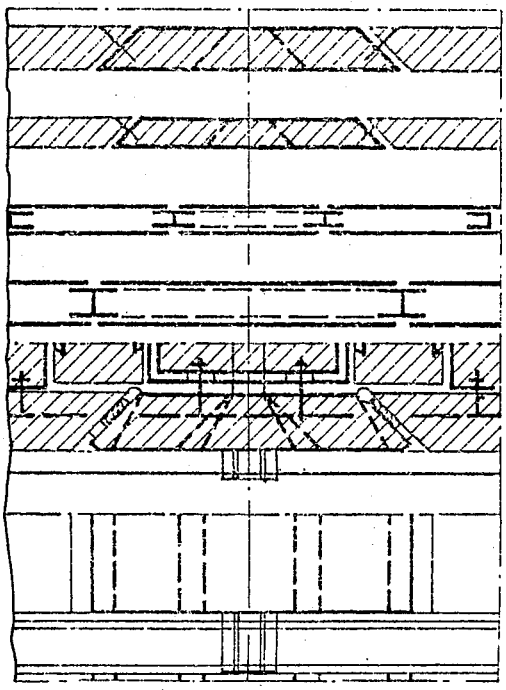
FIG. 41 shows horizontal sections of outer and interior walls with their wall connections extending from element to element across element joints.

FIG. 41 shows horizontal sections of outer- and interior walls with their wall connections extending from element to element across element joints and at the very bottom the position of vertical outer wall joints in front of a facade.

At the very top of FIG. 41 the connection of solid concrete interior walls of 15 cm thickness, by means of wall slabs shaped like a truncated pyramid, is shown. Below, FIG. 41 shows the same connection, however, with a concrete interior wall only 10 cm thick.

Below, FIG. 41 depicts a wall connection in the case of a two-shell light construction wall, 10 cm thick, by means of planking on both sides against an H-shaped post profile. Again below the same wall connection is shown, however, with a light two-shell partition wall of 15 cm thickness.

In its lower half, FIG. 41 shows wall slabs, formed like a truncated pyramid, for closing of elements at the front of the facade and below that, it shows in projection, how selection of connection slabs of various width influences the position of vertical facade joints. As already described in the case of outer walls in FIG. 38, threaded bolts also project from the outer walls slabs, shaped like a truncated pyramid. Prior to mounting, these connection slabs for the elements will be provided with heat insulation strips on their small angular front and in front of this, as well as behind, they will receive joints running all-round, permanently elastic. For the purpose of fastening in the outer wall, channel steel straps made of rectangular tubes and with round openings are fastened in the vertical anchor rails of the columns, between two supports from one element to the next. The threaded bolts of the wall slab with a shape like a truncated pyramid will be pushed through these openings. By means of tightening of the nuts, these wall slabs will be squeezed in, flush on the outside, between the outer wall ends of two elements.

Figure 42:
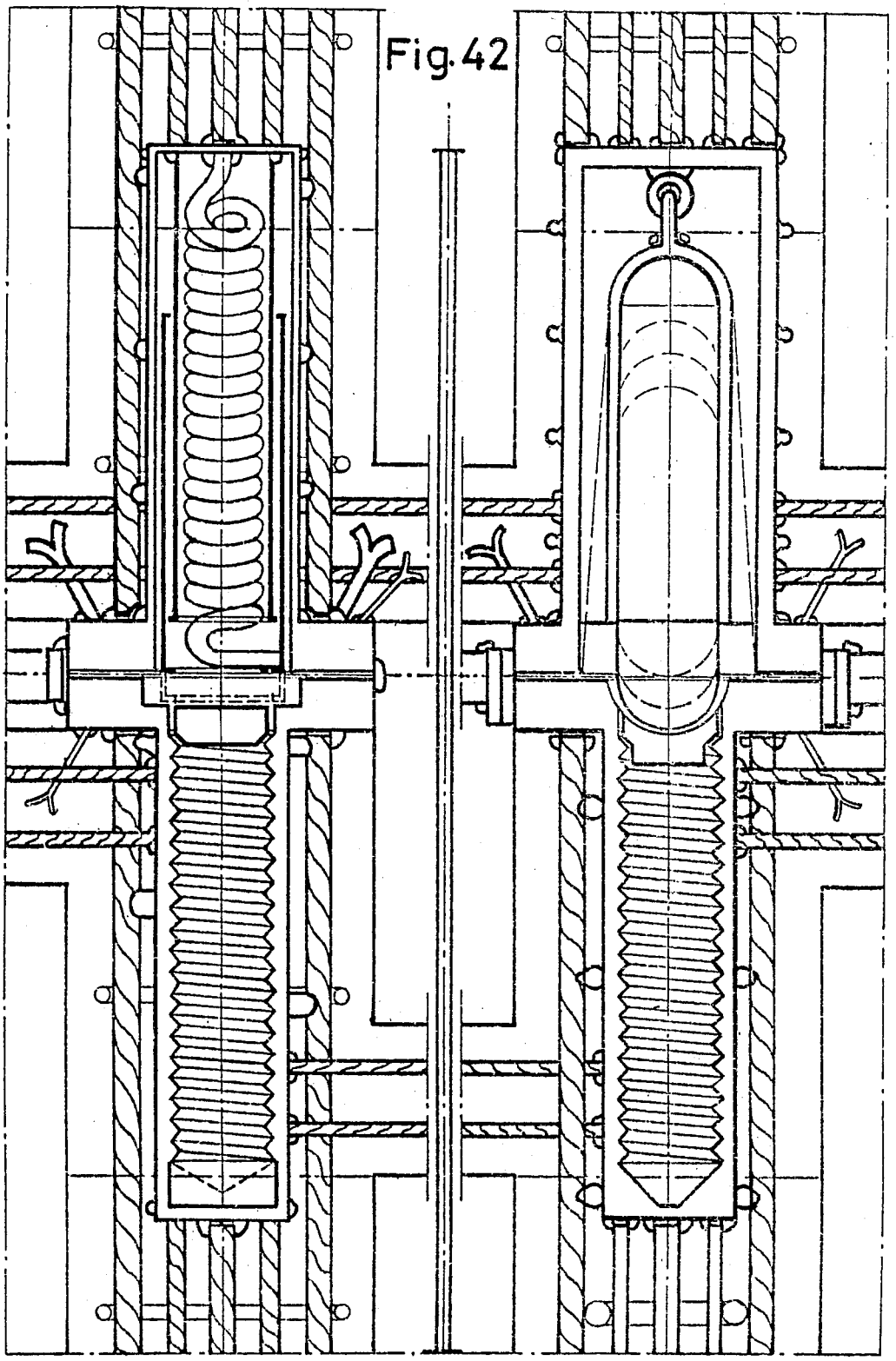
FIG. 42 shows possible formations of cap and base plates.

FIG. 42, left half, shows possible formation 'A' of cap- and base plates and possible cap- and base plate formation 'B' on the right.

The formation of cap plates shown, developed according to the invention, will primarily be used for vertical transport of basic elements (2), (3), (7) and (8) (as represented) and for transport of elements (1), (4), (5), (6), (9) and (10) in smaller construction.

Formation of base plate has been invented in size as shown, in order to guarantee that basic elements (2), (3), (7) and (8)—completed up to 90% with respect to construction and technical details—as well as other installations—can be set down as soft as possible after vertical transport during completion on site, as well as in the process of stacking basic elements one upon the other during mounting on site.

In order to avoid hard touch down of basic elements (1), (4) (5), (6), (9) and (10), there will also be formation of a base place according to 'A' or 'B' for these elements, however, it will be applied in a smaller and weaker form.

'A' formation of the base plate consists of a solid steel plate with thickness (v) and a base according to the cross-section of respective element columns. The cap plate is pierced in the center and has an upper round opening at a height of (v:2) and a lower round opening, which is of small diameter but also at height (v:2). Underneath the solid steel plate a steel tube with interior thread is attached. This tube has the same inside diameter as the lower, smaller circular opening in the cap plate and is also closed by means of a metal plate. For vertical transport of the elements, cap screws with eyes will be inserted into the four threaded tubes.

Dimensions of 'A' and 'B' formations of cap plates will be shown in the course of statical analysis with respect to a shell of the element frame, including anchors. The size of the cap screws with eyes and the diameter of the tube will be determined according to this analysis. Immediately after completion of deposition at site, the cap screws with eyes will be removed and the open threaded tube will be closed by means of the insertion of metal plates.

The four formations of base plates of respective elements have the same solid steel plates as base plates, with height (v), as the cap plates, with an opening in the center, the same as the largest diameter (interior) of the steel tube directly mounted on top of the base plate with an upper cover. According to statical analysis and with respect to the extent of completion of the basic elements in each case, heavy steel springs of a special type cover the steel tube described above. These springs are, among others, designed in such a way that they will only unbend, to such a degree during transport of the elements that an outer steel tube to which they are connected at its lower end, is still guided in a surrounding steel jacket, the outermost cylinder, and the opening in the base plate. The steel spring itself can only move within the innermost steel tube with the smallest diameter, which is fastened to the cover of the steel tube with the largest diameter.

FIG. 42 shows at upper right the base plate in fromation 'B'. It consists of a solid steel plate with a shape and dimension as described above, however, it has a circular opening with a maximum diameter. This maximum diameter, at the time, is the inner diameter of the steel cylinder above it which is connected with the base plate and covered on top. In the center of the steel plate which closes the top of the tube cylinder, there is a special shock absorber (if necessary, to be designed and built brand-new by an expert) above two eye constructions, and within the inner casing of the surrounding steel cylinder.

For the base plate, the basic elements below must be equipped with formation 'B' of the cap plate. These elements show segmental openings—i.e. upper diameter larger than the catching end of the special shock absorber—in the center of the cap plate and the cover lock above the threaded tubes.

FIG. 42 also shows connections to cap and base plates in the left and right half views, one beneath the other. In the center of the far left side, cap and base plates are welded together by means of a flat steel strip overlapping the joint between the plates. On the right of the left half view, merely a weld joint is shown in the center at the transition between a cap and a base plate. On the right half view, there is a loose connection by means of a square flat steel ring which encloses the cap and base plates of the columns at a certain distance so that some free motion is possible between the lower- and upper element, e.g. in case of an earthquake. These flat steel rings will be welded together horizontally by means of a flat steel strip and from element to element. The connection work described above will be performed within the joints resulting from stacking of basic elements and with (2·v) height of working room.

Figure 43:
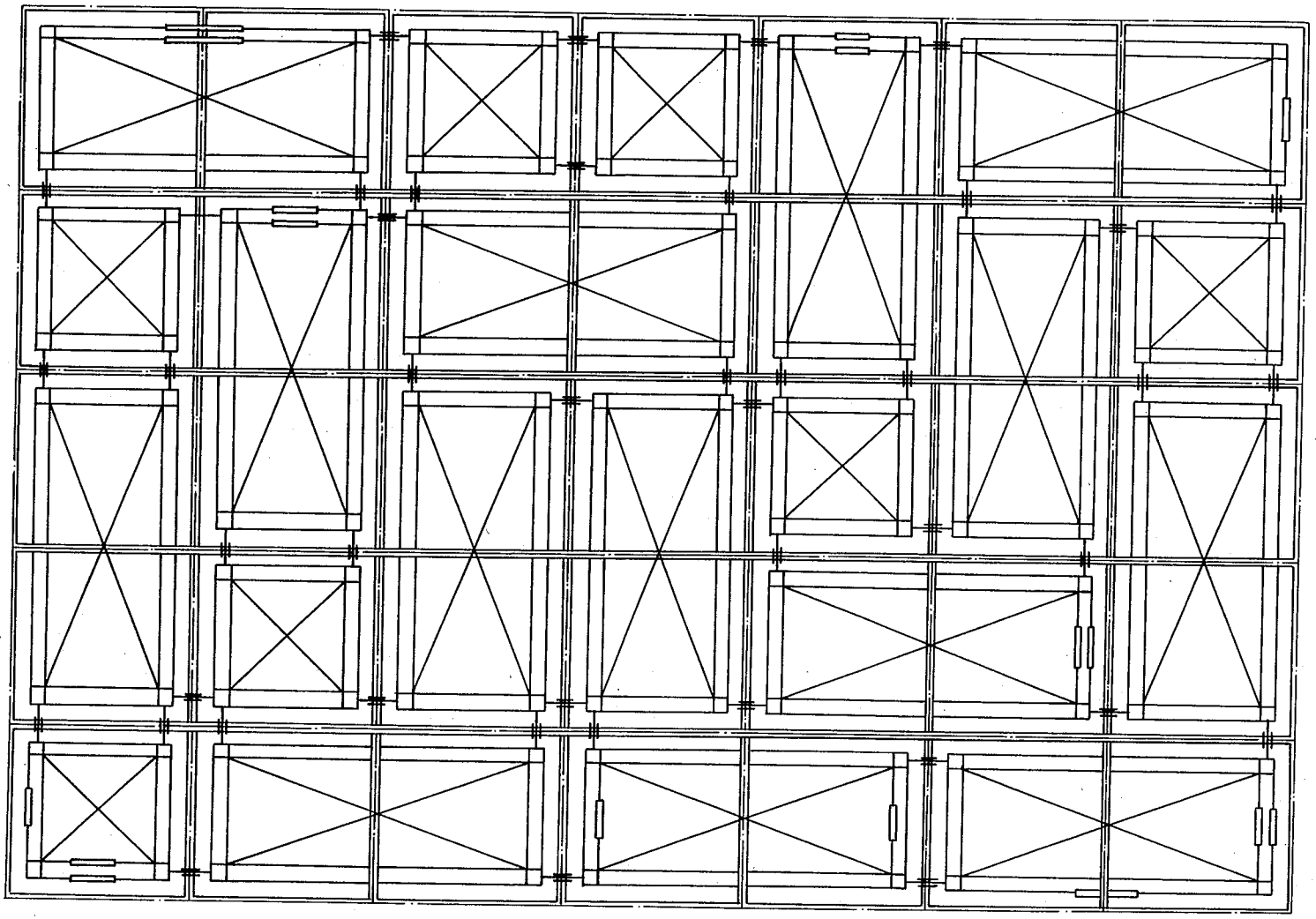
FIG. 43 shows possible anchor connections in both the vertical and the horizontal plane.

FIG. 43 shows possible anchor connections in vertical- and horizontal plane. Various connections between or within basic elements (2), (3), (7) and (8) are shown indiscriminately. The exact kind of these connections within, i.e. between the elements, will always depend upon static analysis according to circumstances. This also applies for the total measurement of all single parts.

FIG. 43 shows transversal stay connections which can be installed diagonally in the vertical plane according to requirements, between supporting members of the basic elements (2), (3), (7) and (8) themselves or in the space between elements. This might be done within the above named areas or between two elements, crosswise to all four corners.

FIG. 43 also shows horizontal anchor connections which always connect the base and cap plates of the columns of two elements, to be mounted side by side, in the area of element joints. This connection will take place in the area of the horizontal element joints which result from stacking of the elements. Above these horizontal anchors, it is possible to create element connections, one below the other, with all basic elements (1) to (10) constructed.

Figure 44:
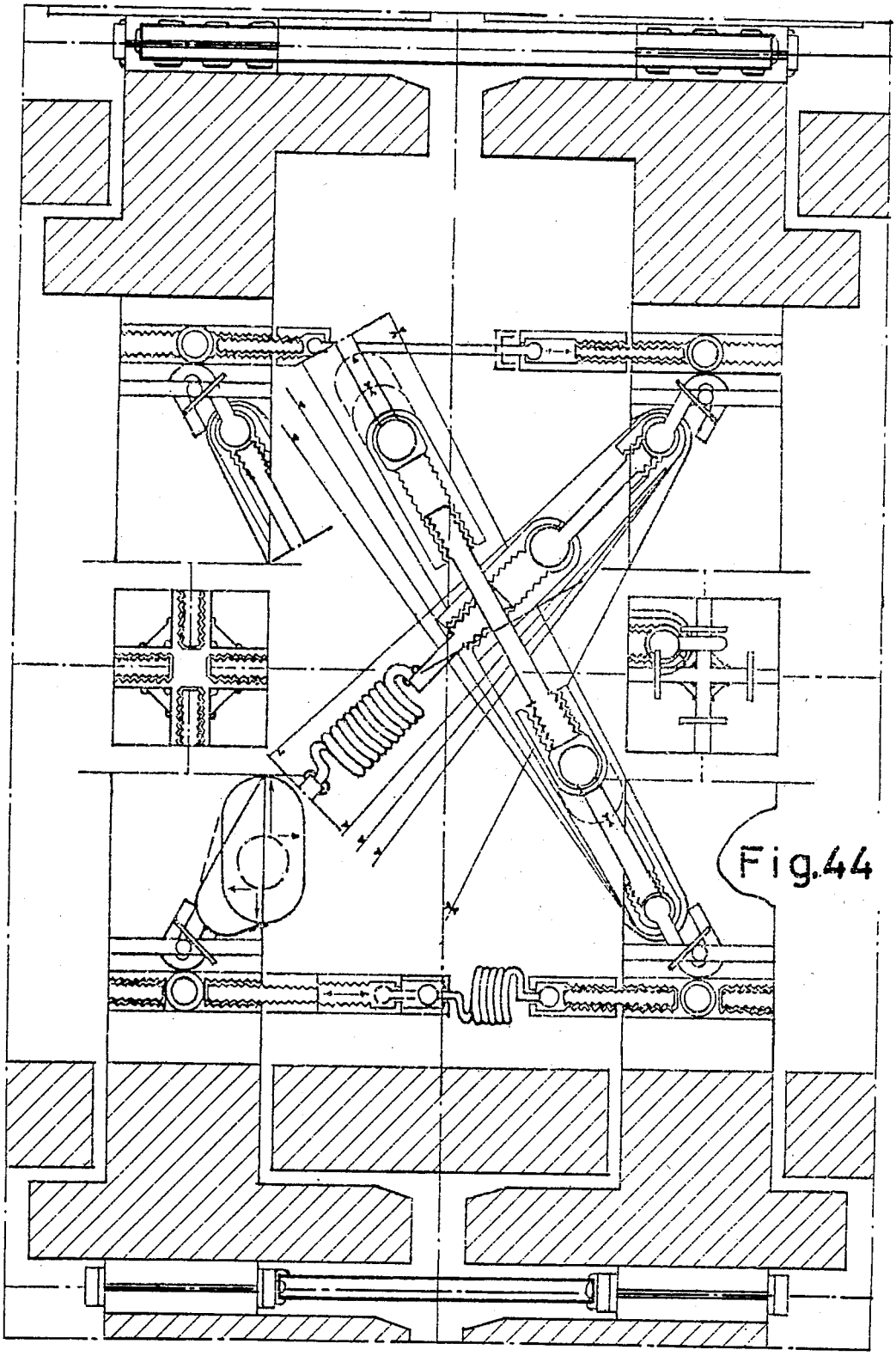
FIG. 44 shows transverse stay connections in the vertical plane and anchor connections in the horizontal plane.

FIG. 44 shows transversal stay connections in vertical plane and anchor connections in horizontal plane.

FIG. 44 represents anchor connections in rigid structures as well as in mobile structures by means of springs. These will be used with preference if construction will take place in seismic areas.

FIG. 44 shows by means of vertical sections of columns directly below the cap plate, i.e directly above the formation of the column base—as has been shown in FIG. 42—that four threaded tubes, arranged crosswise, are fitted into the columns, presenting connections for horizontal anchors at all four sides of the columns.

For fabrication of rigid horizontal anchor connections, threaded steel pieces projecting from the columns will be screwed into two opposite threaded tubes made of steel.

For manufacture of the connection, flexible heads will be at both sides of a steel bar. By means of this connection, it is possible to level small permissible variations, which result from stacking of basic elements one upon the other. A short threaded tube, whose depth is according to length of thread of the threaded steel pieces projecting from the column, is put over a flexible head. Above the flexible head at the other end of the bar is a tube, accordingly longer, which is only threaded in its front half and of such a length that it can be screwed tight into the threaded steel piece projecting from the other column. By tightening of the larger connection tube, an anchor will be produced which forms a rigid connection between two elements.

A horizontal anchor connection by means of the same structural parts as described above, is shown in lower half of FIG. 44. For the manufacture of mobile, but still tight connection, the rigid steel bar has in this case been exchanged for a strong spring which also has flexible heads at both ends.

Further horizontal element connections are shown at the very top and bottom of FIG. 44, each above its cap and base plates. These have also been shown in FIG. 42 and have been described in this context. It must be added that these connections can be produced by use of structural parts designated above, each according to requirements, either with bars or springs.

FIG. 44 shows in the center transversal wind anchors in the vertical plane, but possible also crosswise. In addition to the illustration, these anchors can also be fixed laterally reversed within the basic elements (2), (3), (7) and (8).

The horizontal section of the round steel cross, with the possibility of providing anchor suspension at all four sides of the column, is shown in the center of FIG. 44 to the right. The vertical sections show that these round steel crosses are always positioned directly below the upper cross tubes or directly above the lower cross tubes in the columns. Devices intended for transversal wind anchors within the columns—whether for elements (2), (3), (7) or (8)—shall always be prepared in the same style within the columns on top and bottom. These devices will therefore be formed as follows:

Steel hooks with flexible heads at their ends and directed to top or bottom, will be laid over round steels of the round steel crosses.

Threaded steel tubes will close behind these flexible heads. A sheet metal hood which closes flush with the outside of the columns and forms an oval moving space for different transversal wind anchors to be installed in the column—as shown on lower left—is positioned around the round steel of the hook and above the tubes.

Steel rods, which have flexible heads at the other end with respectively long threaded tubes placed over them, will be screwed into the threaded tubes positioned within the columns. These structural features are also shown by the anchor devices of the opposite columns, positioned at top or bottom. They only differ with respect to shorter threaded tubes which are positioned above their flexible heads. Finally, rigid transversal wind anchors will be provided between these devices, facing each other above and below, by means of screwing a round steel bar with thread at its ends in opposite direction completely into the shorter tube, while also being able to screw it into the longer tube and to tighten it.

A mobile, transversal wind anchor which, nevertheless, can be tightened, will be produced by removing a center piece of the round steel bar described above and installing a special steel spring into the gap.

According to the arrangement shown in FIG. 44, the position of the transversal wind anchors between elements, within the longitudinal extent of elements (2) and (3) or else within elements (7) and (8), different linear dimensions will be measured diagonally. These differences between measurements will fundamentally be bridged over by use of shorter or longer round steel bars in the center, with the thread in an opposite direction, i.e. by means of shorter or longer spring-bar-designs also with the thread in an opposite direction at the end of the bars. All exposed single steel parts of the designs described above shall be manufactured from nonrusting materials, or shall be protected long-term against rust formation by means of a proper coating.

FIG. 45 shows ceiling structure (suspended) with a vertical section of suspended ceiling as designed for construction with basic elements.

Here, it is shown from top to bottom that adjustments will be made by means of proportionately long suspension bars corresponding to different levels of solid ceilings.

In case of very heavy suspended ceilings and solid ceilings made of concrete, it is possible to penetrate these with the suspension bars and to create cross anchorage.

Suspended ceilings will anyway be suspended resiliently because of the elastic supporting joints of the solid ceiling, however, in addition to this the suspension bars will be fastened at their upper ends by means of springs which will add to the flexible suspension of the ceiling. The formation of suspended ceilings is fundamentally also possible in graduation.

Installation of all well-known mounted ceiling systems (from time to time also without any alteration) is guaranteed.

In order to be able to complete—with respect to elements for transport—up to 90% of construction of suspended ceilings produced at the factory—if these elements do not have their own solid ceiling—steel T-rails will be mounted in latitudinal direction of elements according to the distance of the suspension design, i.e. from ceiling/roof (floor) beam to ceiling/roof (floor) beam and the suspension design described above will be completed with them.

The suspension designs of suspended ceilings, developed for construction with elements of the invention stand out since, for the first time, suspended ceilings will be prefabricated up to 90% at the factory and for each element and that, after erection of elements at the site, it will be possible to level slight tolerances in height between elements by means of lifting or lowering, according to requirements in each area, without disassembly of the ceiling.

FIG. 46 shows the vertical section of (elevated) floor structures, specially designed for construction with basic elements (2) and (7).

Their design also makes subsequent leveling of slight tolerances in height between elements possible and thus opens up the possibility to complete construction of full stories at the factory up to 90%, as is the case with the suspended ceilings.

By means of use of elevated floor piles with different height, it is possible to produce graduations also within the floor space as far as this is permitted with respect to the clear height of the rooms to be observed. Especially in the case of use as an installation floor, additional space for technical extensions will be secured, which can also be completed up to 90% at the factory in case of construction with elements of the invention.

For heavy-duty flooring materials (e.g. in industry) and for floors in wet rooms, it is necessary to fall back upon customary floor constructions.

Horizontal sections of suspension arrangements are shown in FIG. 47, and an arrangement of elevated floor piles is shown in FIG. 48.

In this respect, as is shown in FIG. 47 it is of special significance in the case of construction with elements (2) and (7) that also large sized plates of up to 1.00×1.00 m and larger can be laid for ceiling and floor tiles which size is not the case with customary suspended ceiling and installation floor systems.

During the arrangement of ceiling suspensions and elevated floor piles, it must be taken care that these tiles are made flush at the outside with running shell parts of the elements, in order to guarantee running blocks of completed ceiling and floor space for transport of each element.

As it is further shown in FIGS. 47 and 48, it is possible not only to link connections between ceiling suspensions and connections between elevated floor piles one with another square across all four corners, but also to link them in strips in both directions with only individual stiffenings in opposite directions.

Elevated floor constructions will also be elastic just because of the bedding of bare floors on top of a rubber or soft PVC covering. Elasticity of an elevated floor can be increased for use by means of placing soft-PVC underneath the base plates of the elevated floor piles.

Figure 49:
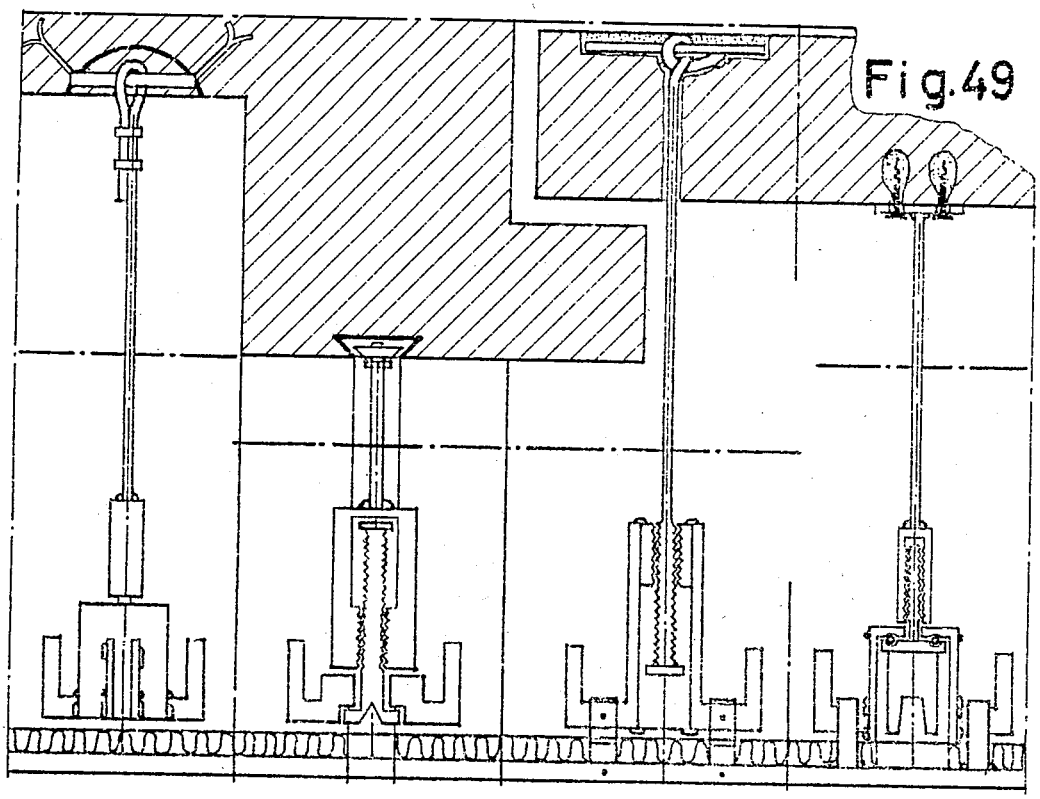
FIG. 49 shows detailed sections of the ceiling suspension constructions, especially designed for use with elements of the invention, including anchors.

FIG. 49 shows detail sections of the ceiling suspension constructions—from right to left—specially designed for construction with elements of the invention, including anchors:

An end plate is connected to the bare ceiling made of light building materials by means of two concrete plugs and special screws. A round steel bar is fastened in the center of the end plate. The length of the bar depends upon the height of the ceiling to be suspended. A tube is fixed with the upper cover in the center of the steel bar.

By means of the fastening of L-shaped steel plate angles crosswise against the outer jacket of a steel tube, four U-shaped hooks will be formed for the ceiling to be suspended. The piece of steel tube will be closed with an upper steel cover, which has a round opening of corresponding size in the center. A solid steel cylinder will receive a large, deep indentation towards the bottom and a round end plate towards the top, the diameter of which shall be somewhat smaller than the interior diameter of the steel pile. Small ball bearings are inserted into the top of this end plate and a threaded steel bolt is fixed in the center. This bolt will be bolted into the threaded tube through the opening of the steel pipe cover so that one third of the length of thread remains unused. In this way it is possible to readjust the bolt at any time through the small square or round opening within the suspended ceiling and the indentation in the steel cylinder.

A ceiling suspension construction is shown in center right, FIG. 49, whose round steel suspender is held over a crossbar by means of a loop in the surface of a light concrete ceiling and has a threaded piece at the lower end with a small base plate. A longer piece of steel tube will receive a threaded insert in its upper third. The steel tube will be bolted over the threaded insert up to the upper end with the threaded piece of the round steel suspender. The scope of the suspension of the ceiling is the same as in the case of the ceiling suspender shown on the right side. For readjustment, however, the ceiling shall be detached, in order to be able to turn the steel tube with four hooks altogether.

FIG. 49 shows in center left a ceiling suspension construction, which is attached to a heavy concrete structural member by means of an anchor rail. The round steel suspender is attached to this rail. A threaded tube will be inserted into a steel tube, open at both ends, up to one third length of the lower part. A threaded bolt, which has been straddled to form a notch and will receive a surrounding edge of support, will be bolted into the piece of steel tube completely and receives a small end plate which will limit downward rotation of the threaded bolt. Prior to this step, a steel ring—shaped like an L turned upsidedown—has been slid over the threaded bolt with the hooks for suspension of the ceiling. Unhindered readjustment through small round or square openings of completed ceilings will also be possible in case of this ceiling suspension construction.

FIG. 49 shows on the far left a projection of the ceiling suspension construction shown on the far right, however, with anchoring in a heavy concrete structural member by means of a segmental shell with a crossbar and an open bottom. In this case, the round steel suspender has been bent and secured against opening below the shell at the round steel. A section also shows that two small flat steel plates can be attached to the steel tube with space between. These plates might then serve as support for T-steel rails (similar to FIG. 50 in the upper right corner) in case crossheads are required across wide ducts above the suspended ceilings.

Figure 50:
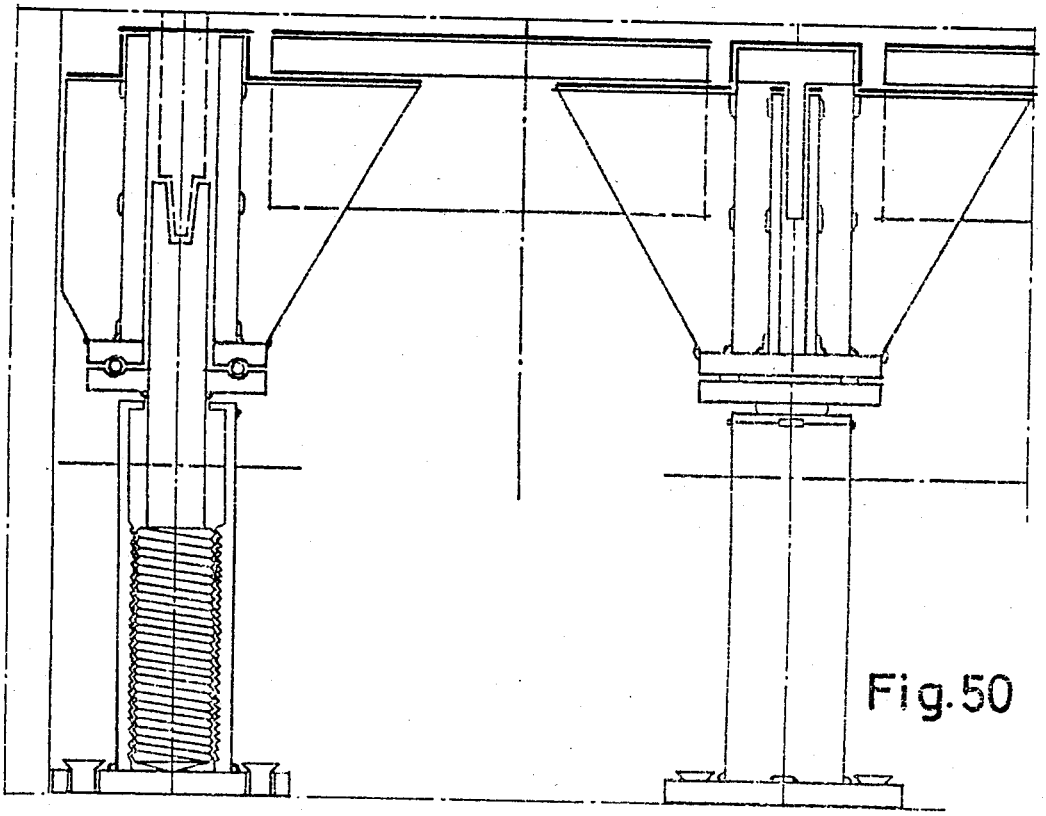
FIG. 50 shows vertical sections and one partial view of an elevated floor construction.

FIG. 50 shows vertical sections and one partial view of an elevated floor construction, in the lower half, specially designed with respect to elements of the invention.

On the left it is shown that the elevated floor piles consist of the following parts described below according to function:

A square steel base plate with openings for screws in two corners diagonally opposing each other or in all four corners for attachment at the bare ceiling by means of screws (with plugs) or stone anchors.

A soft PVC pad can be laid between the flush bare ceiling and the base plate is necessary.

A steel tube will be placed on top of the steel base plate with interior thread up to $\frac{2}{3}$ height of the tube. A long, round steel bolt with thread in its lower part, according to thread in the tube, and with a smooth upper part with a deep indentation at its end, will be bolted from above. The steel tube will then be closed around the bolt on top by means of a steel ring cover, and a steel plate ring will be attached to the smooth part of the bolt above. Ball bearings for easy turning of the top and for the upper ceiling with heavy loads are located in this steel ring—otherwise, the upper surfaces of the steel rings will be made smooth and sliding. Another steel plate ring with the same diameter and with the same hollow space for a ball bearing (or ground smooth only on the bottom surface) will be laid unassembled from above. Another piece of steel tube, which remains open on top, will be fastened on top of this steel plate ring.

FIG. 50 shows in section on the right side, directly in front of ring plates, that between this plate described above and the outer surface of the steel tube, there are inserted always two in the upward direction conically shaping supporting steel-plates, arranged crosswise and equally spaced.

T-steel rails for formation of arrangement in layers of the base plates will be placed and on top of these supporting plates. The supporting plates are attached to the upper part of the tube, reduced in height according to the thickness of the T-steel rails. For prevention of impact sound, the T-steel rails will will not reach the outer surface of the upper tube and the top of supporting plates and T-rails as well as the tube will be lined with a hood made of rubber or soft-PVC. The rubber- or soft-PVC lining on top of the supporting plates and T-rails will be in strips.

Height of the elevated floor construction will depend upon the distance between the upper ceiling and the bare ceiling.

In accordance with this construction, the lower tube and the complete bolt must be finished shorter or longer. Through very small round or square jogs in the corner joint of four base plates, it is possible to readjust floor surfaces installed at the factory fast and without problems through the indentation of the bolt, this feature being for the purpose of height adjustment between elements at the building site. All parts of the ceiling suspension and the elevated floor construction will be designed according to static analysis in each case. All of the structural steel parts will be made of stainless steel or coated resistant against rust formation.

SPECIAL ELEMENTS

In order to realize adequate architecture for low-density housing and to satisfy demands with respect to style of the interior of a building, it is possible to obtain special elements in addition to the basic elements (1) through (10) described above by means of only slight modifications.

The following special elements are listed here:

The special element (1") as a balcony element. In this case, a projecting concrete slab is connected in full length with the lower beam, located in the longitudinal direction of element (2). The concrete slab has a width of ((a:2−v):2).

The special element (2") has a concrete slab along one of the side walls, also connected with the lower bearing beam but with a segmental base and a gauge for bore holes of ((a:2−v):2).

The special element (3") is shaped like basic element (7), however with an additional rectangular balcony slab—of the same depth as described in the case of element (1")—which is fixed to the lower beams in longitudinal- or latitudinal direction.

The special element (4") differs from special element (3") in that the attached balcony slab is not shaped rectangular, but semicircular.

The special element (5") is shaped like special element (1"), however, it is completed with an additional balcony slab, as described above, along its latitudinal side.

The special element (6") consists of the special element (2"), however, also completed with an additional balcony slab at its latitudinal side.

The special element (7") is shaped like element (3"), however, it has an additional balcony slab attached and angled across.

The special element (8") consists of special element (4") and has an additional balcony slab angled across.

In case of the special elements described above, it is also possible to erect high outer walls as elements instead of balcony parapets or balustrade and to add the space gained to the adjacent rooms behind.

In any case where architectural considerations lead to the incorporation of supporting members into an overall design of a building, the basic elements (2), (3), (7) and (8) can be constructed with modifications to form special elements (9"), (10"), (11") and (12"), i.e. also with round columns and upper bearing beams rounded on the bottom.

This is only a small fraction of possible, nearly inexhaustible modifications of basic elements (1) through (10)—in the course of which principal construction features of basic elements of the invention will always be maintained.

DIMENSIONS

Dimensions are listed in FIGS. 1-50 by means of identification letters. The identification letters (A) through (C) and (a) through (z) are all specified in a list, according to the metric system.

Since change of only one of these dimensions will mean the loss of one of the advantages of the building system developed and deviation from some of the dimensions will jeopardize the functionality of the industrialized building system shown altogether, all dimensions listed shall be essential for the overall invention.

COURSE OF MANUFACTURE OF ELEMENTS AT PLANT AND ERECTION OF BUILDINGS AT SITE

After architectural design of shell and interior works and projection of technical installations in accordance with modular dimensions shown in grid—i.e. length, width and height of basic elements and their structural members—and based upon statical analysis of the building, it can be assumed that each steel- or concrete works with factory installations for massive system-building construction will be able to manufacture basic elements (1) through (10).

A concrete plant for prefab units would present ideal preconditions for erection of concrete shell-framework-construction and additional interior works and technical installations up to 90% of overall finished fabrication if it fits the following description:

An industrial plant of 100.00 m length and 60.00 m width, with a gable roof in the longitudinal direction and approx. 10.00 m above ground at both eaves, has a longitudinal aisle storage space in the center where reinforcement constructions can be prepared. A central concrete mixing plant with silos or storage bins for aggregates can also be positioned here. The concrete required might also be delivered as ready-mixed concrete.

Two production lines of oval shape will lead around the aisle storage space. The long, straight lines of these production lines lead through the four gates at each of the end walls of the hall to the storage areas approx. 100.00 m prior to and behind the industrial plant. A travelling trolley construction with suspended square, special-type traversing saddles, which shall have the capacity to easily lift basic elements.

Elements with up to 90% of interior works completed and a weight of up to 20 tons and to transport them horizontally, will be positioned above the two oval production lines in the hall and their straight extensions to the outside areas. The two production lines to the right of the aisle storage area are used for production of element shells. Transport of steel moulds, of other steel construction members, aggregates for preparation of concrete as well as all wall- or cover plates required for elements, will take place through the two front gates of the building. To the right of these shell production lines on the ground floor and in the extreme front of the first floor will be the business premises and behind these lines, one after the other, will be the storage- and workrooms of all companies with succession of trades according to the course of shell production. Finished shell elements can immediately subsequently be hauled to the left production lines for further extension work or can be transported through the two back gates on the right of the hall and deposited in an outside intermediate storage area. The shell elements will be protected outdoors by means of transparent foil covers.

For further completion, elements will be taken through the left back gates to the two production lines for extension works. To the left of the shell production lines, on the ground floor as well as the first floor and in the longitudinal direction of the industrial building, there are storage- and workrooms of all companies required for interior works and technical installations with a succession of trades according to the course of manufacture.

The building elements completed up to 90% will be transported along the straight extensions of the production lines for interior works through the two front gates and will be put outdoors in an intermediate storage area. As far as they do not have four outer walls and a finished flat roof construction, they will be protected against the influence of the weather by means of a transparent foil cover.

In the case of setting up of steel moulds on vibrating plates in the plant, in case of any intermediate storage, and during transport with trailers of heavy trucks, care has to be taken that in the case of the installation of column base plates in basic elements of the invention with a formation according to 'A' or 'B', there will always be free space between the lower edge of the lower bearing beam and the supporting surface, approx. 0.30 m spacing, so that damper construction will not be stressed prior to the mounting of elements at the location of use.

The preliminary work required at a site as well as the run of structural erection of basic elements of the invention has already been pointed out in the description of a possible application and will be shown in detail with the description of advantages in case of construction with basic elements, contained in the paragraph below.

It must be pointed out here that the prefabricated parts, required at the site for shell, interior works, and technical installations and which will also be needed for connections and closing between elements, will be stored in all basic elements. This will be the case with, e.g., exterior- and interior fitting slabs shaped like a truncated pyramid, cover plates, anchor connections, remaining suspenders and elevated piles with ceiling- and floor slabs, wood lagging prepared for columns, overfeed pipes, and all other technical parts for installation of flexible element connections.

The cellular construction elements of the solid system construction will arrive at the building site according to the designation of their position in the ground plan of the floors and according to the course of erection. The heavy crane systems and assembly gangs required for erection will be ready. Strong eye hooks will be screwed into the column cap plates in the same proportion for suspended transport of the basic elements of the invention. A steel cable will be hooked into each eye hook. The four steel cables will be guided vertically across special type traversing saddles with spacing of corners according to the rectangular base of elements (1) through (5) and the square base of elements (6) through (10). In order to achieve soft lifting of all basic elements, a spring design might be installed in front of the crane hook where the four cables run together at an intersection of the diagonals above the base of the elements.

For the purpose of joining basic elements of the invention together, it is functional to construct a model consisting of 5 square steel tubes which are welded together in such a way that they form a cross. The four outer tubes will have the same height (b) as a full-story element. The core steel tube in the center surpasses the other four tubes by approx. 1.00 m. Eight rectangular steel plates will be welded to the four interior corners up to the top edge of the core tube, with a height of 1.00 m. The suspended elements will be aligned with these extended interior angles and guided by them during lowering. In case of construction in accordance with the invention, the time schedule of construction at the site will be such, as has not been possible generally provided, that basic elements of the invention will be delivered in time and organization will be accordingly tight.

It is thus possible to erect a star-shaped high-rise block with fourteen full stories irrespective of the time of the year within approx. twelve months, turn-key and reliable with all connections.

PURPOSE AND TASK OF THE INVENTION

Development of a system-building with solid construction for all building projects will be accomplished for the first time because of the given features, summarized below:

(1) System-building in accordance with invention means complete elimination of seasonal labor problems in all of the building trades—achieved by means of: Production of shell, interior works, technical installations, structural works, and furnishings up to 90% in an existing plant of the concrete- or steel industry capable of production for an industrialized building and erection of buildings in absolutely dry construction on site, any time of the year.

(2) Dry construction, as a result of any limitation of in-situ concrete, will be held to an absolute minimum, as well in the course of manufacture at the plant, as during erection on the construction site, and will be achievable under the following conditions:

Shell framework elements just built with concrete at the plant will be coated with a strong transparent gauze foil immediately after setting and removal of the casing; further extension works will take place in the plant or outdoors underneath the protective foil; the foil will only be removed after transport and placing of the room element on the construction site. After desiccation of the concrete (down to residual wetness only) and of mortar joints, extension work will be completed by means of dry piece parts. Only earth works and a minimum of in-situ concreting for mounting of elements will be necessary on site during weather permitting it, e.g. such as granular subbases for fill of single foundations or foundation elements (1) through (6), in-situ concrete strip foundations or—slabs, and in-situ concrete waterproof tub designs for construction below groundwater level. After creation of required conditions on the site, erection of all buildings will be done in dry process according to the invention.

(3) Omission of hitherto usually required performances for building site equipment (except roads on site and enclosures) on construction site—also facilities for energy—which will make the following possible: After creation of the above preconditions, the complete erection of buildings will be possible without hitherto required extent of sources of current and water on site. Electricity also required for welding of any kind will be produced by means of movable diesel generating sets. Basically, water will not be needed for construction. Erection of site toilets and lavatories in trailers with water tanks is sufficient.

(4) Premature building on site prior to or during development of the site by the utility company will be possible for the first time because of the advantages in accordance with this invention, as listed under item (1) to (3).

(5) Prefab construction and erection according to the invention also implies reversal of building construction—i.e. disassembly under the most simple and cheapest conditions. With respect to this feature, the following must be listed:

The structural element connections according to the invention and all heating tubes, water, sewage, gas mains, weak current and power lines etc, can be connected flexibly between elements in an area between column exteriors and in an area of joints, horizontally as well as vertically. This means that large scale adjustments with respect to city construction such as evacuation of built-up areas for construction of airfields or storage lakes, demolition of buildings after miscalculation of geologic formations etc. will be possible—provided that building construction took place according to the system invented.

The word "demolition" will become obsolete and meaningless in building activities because of the invention.

(6) Construction in seismic areas of the world—as well as in such areas where required basic materials for concrete are not on hand—will be possible, since prefab cellular elements according to the invention can be sent as structural members or "almost turn-key", as has already been practised by transport operators using "containers", by land and by sea.

Earthquakeproof construction is a result of the design of the individual basic inventive elements which, among others, rule out collapse and breaking through of ceilings and of anchor connections between elements, as designed according to the invention in both horizontal and vertical planes.

(7) Prefab construction according to the invention is: Complete furnishing of elements for part of any room at the plant, even with lamps, curtains and highly sensitive electrical or electronic installations and even with mobile pieces of furniture, glazing, and exterior finishing coat—since protection is intended for outside transport and base plate formation according to the invention will be provided which will guarantee soft placement of finished room elements during transport and mounting.

(8) The buildings listed under "Field of Application" and anything in addition to it—i.e. the whole spectrum—comprising any and all building projects, including multi-story buildings, can only be covered by means of the prefab system shown here.

(9) Saving in costs of amounts not possible up to now can be realized since elements (1) through (10)—specially elements for full stories (2) and (7)—can be produced and stored in large numbers of pieces. Saving of time on site compared with traditional construction can be realized with the shortest time of construction possible. Thus, it is possible to erect and mount the ground floor of a spacious three-room apartment shown in FIG. 25, including a complete basement as shown in FIG. 26 with only six basic elements (2) for full stories and also with only six element mountings in one day. The connections between element shells, for interior works and technical installations including horizontal connection of the chimney as well as connections for water and energy supplies will be installed within four days only. Thus, a three-room one-family house can be occupied after a total of only five workdays, ready for operation and turn-key.

Costs for scaffolding will also cease completely.

(10) Prefab construction using building elements also makes possible subsequent completion of construction on site in any case with maximum utilization of the volume of construction permitted in each case. If, e.g. at the time of construction, only five full stories are permitted on the site above ground—but if, on the other hand, approved construction of multi-story blocks can be expected later as a result of certain development of the construction site—it will be possible to take this factor into consideration during erection of the lower stories by means of the slightest additional measures. After acquisition of adjoining premises, it again will be possible without extensive changes, to turn the original five-story building into a spacious multi-story building using construction elements of the invention. The same will apply for large scale construction and small scale private residential housing—under the condition that planning has been accordingly—so that first of all only one kitchen element (2) and one element for living- or sleeping room (2) will be placed in the center of the site and in the course of some years, (also after a period of ten or more years) this small house will develop into a large, e.g. twelve-room house with enclosed apartment and office space. Should a change of planning occur during this period it will be possible to easily remove e.g. a room element from the center of the layout and to erect it in another position and after slight rebuilding measures it will be available for renewed utilization.

(11) Architecture will be full scope for all buildings conceivable, of any kind, interior and exterior without the slightest limitations, will all facilities, which surpasses anything that has seen the light in terms of prefab construction or with respect to the use of finished building fabrics.

(12) Optimal heat insulation and thus a maximum of energy conservation in construction in case of the use of basic elements (1) through (10) will be realized, if concrete slabs of 20 cm thickness will be installed for for roof- and ceiling construction and if concrete slabs of 20 cm average thickness will be erected as walls.

Low temperature transmission from outside will be impossible, since columns and bearing upper- and lower beams as well as large parts of projecting beams will be covered after mounting of outer walls.

Defective insulation in the horizontal plane cannot occur, since lower elements will already have continuous insulation strips installed at the plant in front of cap plates and on top of projecting beams, with their height in excess of (v). Elements to be placed on top of these lower elements will in each case have lower continuous insulation strips with a thickness in excess of (v), placed outside of column base plates on projecting beams. The above insulation strips will be fastened around all front sides of the projecting beams at all element joints in the vertical direction and also with a thickness in excess of (v) so that all horizontal and vertical element joints will definitely be closed tightly and will be insulated during mounting and joining of elements (1) through (10) without further working cycles.

Sound proofing of any required level is possible, since no solid connections exist between elements of the prefab system invented, which could transmit noise from one element to the next.

An optimum of foot fall sound proofing is also possible by means of the elevated floor construction with its functional characteristics.

Excellent sound level will even be found within elements and between elements, since basically all structural wall parts will be mounted on top of plastic- or flexible joints at shell parts of the basic elements.

Manufacture of structural parts according to the highest standards in terms of sound proofing basic elements will also be possible, since all shell parts and installations can be mounted, even in the cases of heavy building materials.

(13) In case of construction with the ten basic elements designed, it is only possible to install the systems for suspended ceilings and elevated floors shown in accordance with invention, if indicated advantages of prefabrication are to be utilized fully, since only they make it possible to adjust ceilings and floors finished at the plant on site without disassembly and for purpose of leveling slight differences in elevation during mounting of elements by means of readjustment up to the continuous edge strip.

Especially use of a system for elevated floor construction, shown in accordance with the invention, offers highly, attractive but also inexpensive alternatives for installation, technical extension works, and use of materials for floor slab coverings which have not or only occasionally been used for this purpose so far.

Thus, for the first time it will be possible to perform complete installation work without any mortise- and milling work within elements. Underfloor heating installations based upon any known heating system will be possible, installed with any alteration of design. With the exception of sauna rooms, all electric wiring can be laid in ducts on top of the bare floor or in elevated ducts. Electric supply systems which are intended for switches and all further control elements and sources of current to be within the floor can fully be utilized and will offer the advantage that subsequent installation of sockets or switches at other place—with respect to arrangement of furniture—will be a mere child's play.

Of the many fascinating options, only laying of artistic glass floor plates with subfloor illumination and without ceiling light fittings shall be mentioned here.

After completion of erection of the basic elements—with technical installations finished up to 90%—on site, the connection of all technical lines, pipes and ducts between elements will be executed on site by means of flexible parts. For technical installations with larger vertical cross-sections in all of the stories, it will be advantageous to utilize—e.g. for ventilating ducts and soil pipes—the space between the columns of adjacent elements or the square surfaces between four columns in the case of an arrangement of four elements in accordance with technical planning.

These basic 13 advantages of the invention as compared with any other prefab system known to the applicant, reveal the great technological progress which is contained in the total invention.

An additional review of the prevailing standards of technology in the system-building industry will not be necessary.

Basic element (2), designed according to the invention, serves for the enclosure of the gross cubage of a full story (or component) in the case of a rectangular base. It consists of the following structural parts:

(a) Column base plates made of steel, with a formation according to either embodiment 'A' or 'B', will be placed within four invariable interior angles of a rectangular base with sides ((f) and 2·(e)) and ((g) and 2·(e).

(b) Height (v) of the column base plates (21) will always be the same according to the invention.

(c) Horizontal cross-section with both sides (e) an (e) can be larger as well as smaller at inner sides according to invention.

(d) The four formations of column bases will be connected by means of a lower bearing ring beam (19) according to the invention, of which the cross section has the width of (3) and height=(1) and (m), wherey the bearing ring beam (e) at the bottom is variable in length towards the inside with respect to the height.

(e) The bearing ring beam (19) at the level of base plates (21) has a distance of (v) to an imaginary level. The lower projecting ring beam (20) at the outside is attached to the bearing ring beam (19), flush at the bottom, with the same distance to the imaginary level below.

(f) The beam is distinguished by a cross-section with sides (d) and (1) which is invariable, by exterior edges, and determined by an invariable base of element (2) with sides (a) and ((a):2−(v)). Depth (d) has been chosen according to the invention for outer walls or interior fire walls, e.g. floor slabs for covering of elements in the course of erection.

(g) On the floor ring beam (19) there is attached a ceiling bearing support ring beam (18) at the same height as the lower projecting beam (20) at the inner side of the bearing ring beam. According to the invention its cross-section is (h)×(1).

(h) On top of the floor ring beams (18), floor slabs will be laid in the short direction of clamping (k) and joint spacing (v:2), the height of which will be (m), including the joint. Preferably, top surfaces of floor slabs will be flush with upper sides of bearing ring beam (19) because of this arrangement.

(i) The upper bearing ring beam (15) will be positioned exactly above the lower bearing ring beam (19) with a clear distance of (n). It will also have a width of (e), however, it will have a height of (1) and (o), according to the invention.

(j) An exterior projecting ring beam (14) will be attached on top of the upper bearing ring beam (15). It will be placed exactly above the lower projecting beam (20) and shall have the same cross-section, according to the invention.

(k) The top side of the upper projecting beam (14) shall be flush with the top side of the upper bearing ring beam (15). The upper interior floor ring beam for roof/-ceiling (16) will be connected with the upper bearing ring beam (15), i.e. flush with its bottom side. It will be positioned exactly above the lower floor beam and shall have the same cross-section with sides (h) and (l). The distance from (o) is greater than from (m) and will be preferably allow for placing of roof/floor slabs with joint spacing of (v:2) on top of the floor ring beam (16) and for total overall height of a flat roof sealing. With the exception of upper bearing ring beam, all cross-sections and distances will always remain the same. The bearing ring beam (15) will be variable with respect to its width (e) and its depth above the bottom side of the interior floor ring beam (16).

(m) The upper bearing ring beam (15) will be surpassed in height by the column cap formations according to ('A') or ('B') and by the cap plates (13) in the four corners, with difference in altitude (v). The cap plates (13) will have the same cross-section as the basic plates (21). This cross-section can also be larger or smaller than (e) and (e), in each case according to the column cross-section.

(n) The lower horizontal bearing ring beam (19) will be connected to the upper horizontal bearing ring beam (15) by means of four vertical columns of the same length, the position of which shall correspond exactly with the four cap plates (13) and the four base plates (21) and they shall have the same cross-section (e). This cross-section (e) can preferably be larger or smaller towards the inside without causing a change of position of the four outside corners of the columns.

(o) The four columns will have the characteristic feature that their clear height (n) will be the same between the top edge of the lower bearing ring beam (19) and the bottom side of the upper bearing ring beam (15). This height (n) has been chosen by preference so that basic elements (2) will even have the required clear height of living-and workrooms after installation of suspended ceilings and elevated floors in case of use as a full story element.

(p) The top edges of the column cap constructions will be connected by means of an imaginary horizontal line. The total distance between this line and the horizontal level below the column base constructions will result in an overall height (b) for the basic element (2). This overall height will preferably pass through the ratio of rise (z), always invariable, in the case of a staircase installation.

The basic element (2) requires basic element (1) for complementary installation in a foundation ditch below and basic element (4) for additional low demand with respect to room and technical installations above. The basic elements (1) and (4) are of identical construction. According to the invention, they also have the same structural parts (13), (21) and (20), with respect to cross-sections and spacing in the horizontal plane, as basic element (2). These elements preferably differ from basic element (2), according to the invention, in that connecting bearing beams at the top and bottom are missing and will be replaced by continuous cross walls (27) and (30) with thickness (u). Closed installation recesses (23, 26+29) made of light construction materials will be prepared within these solid cross walls. Floor beams exist with the same cross-section as in the case of basic element (2), however, not in the form of bearing ring beams but positioned between the columns. Upper floor beams (24) and (31) are support for roof/floor slabs. The four columns (22) with the same variable cross-section and in the same position facing to outside as in the case of basic element (2) will only have an overall height of ((b):4)./.(2·(v)) from the top side of column cap plate to the bottom side of the column base plate. Without deduction of (2·(v)) the overall height of basic elements (1) and (4) will be ((b):4). This is determined by the fact that it is possible to pass through with always the same ratio of rise (z) in the case of staircase installation, as is true for basic element (2).

Basic element (3) has been designed according to the invention for completion and placement above or below basic element (2). Basic element (3) will meet requirements with respect to additional rooms, technical installations or foundations. Structural parts (13) through (16) and (18) through (21) will preferably be the same as in the case of basic element (2). The only difference in comparison with basic element (2) is that the columns (17) will be replaced by the columns (33) with a lesser clear height of (r).

Basic element (5) is designed for formation of protectors for fascias, balconies, and terraces, as well as for the meeting of a modest demand for additional space with respect to foundations or technical installations, and also for completion and placement above or below basic elements (1), (2), (3) and (4).

According to the invention, basic element (5) will have many of the same structural parts as basic elements (1) and (4). Deviations from basic elements (1) and (4) will be that preferably the continuous cross walls (41) will be lower in this case, installation recesses will be of different given size (35), (36), (37), (38), (42) and (43) and the upper floor beams will be missing. Basic element (5) will also be different from basic elements (1) and (4) because of the fact that the four columns (34) will be lower and will have overall height (c) from the top edge of the column cap plate to the bottom edge of the column base plate.

basic elements (6) and (9) are designed for spacial completion of basic elements (1) and (4). Basic elements (6) and (9) are distinguished from basic elements (1) and (4), according to the invention, only because of the fact that they will have a square base with sides ((a):2−(v)) and ((a):2−(v)).

Basic element (7), designed for spacial completion of basic element (2), will also only be different according to the invention, because it has the same square overall base as elements (6) and (9).

Basic element (8), designed for spacial completion of basic element (3), also will differ from basic element (3), according to the invention only because it has the same square overall base as elements (6), (7) and (9).

Basic element (10) designed for spacial completion of basic element (5), also will only differ from basic element (5), according to the invention, because it has the same overall square base as elements (6), (7), (8) and (9).

THE FORMATION ('A') OF COLUMN CAP AND COLUMN BASE

The formation of column caps, designed according to the invention, will serve for vertical transport of basic elements (2), (3), (7) and (8) and, with smaller size, for transport of elements (1), (4), (5), (6), (9) and (10).

Their use will make soft placement possible in the course of stacking of basic elements one upon the other and with respect to vertical movements. This is important all the more so in the case of basic elements, which have been completed up to 90% with regard to construction, technical installations, and furnishings.

Formation ('A') of the column cap will preferably consist of a solid steel plate with thickness (v) and a base which corresponds to a cross-section of the respective column of the element. The column cap plate will be perforated in the center of the top in a form of a circular opening with height (v:2) and a circular opening at the bottom which has a smaller diameter—height also (v:2). A steel tube with internal thread will be attached below the solid steel plate. It has the same inside diameter as the small circular opening at the bottom of the column cap plate and is closed with a metal plate at the bottom. Cap screws with eyes will be inserted into the four threaded tubes for vertical transport of elements.

The four column base formations of respective elements have—according to the invention—the same solid steel plates as base plates, each with height (v), as the column cap plates with an opening in the center which has the maximum diameter (inside) of the steel tube directly mounted on top of the base plate with a cover on top. According to statical analysis and with respect to the extent of completion of elements (1) through (10), heavy special type steel springs will be fastened in the center of the steel tube cover. These springs are, among others, designed in such a way that they will only unbend to such a degree during suspension of elements that the outer steel tube to which they are connected at the lower end, will still be guided in the surrounding steel jacket, the outermost cylinder, and the opening in the base plate. The steel spring itself will only be able to move within the inmost steel tube with a minimum diameter, which spring will be fastened to the cover of the steel tube with maximum diameter.

FORMATION ('B') OF COLUMN CAP AND COLUMN BASE

The formations of column caps, designed according to the invention, will serve for vertical transport of basic elements (2), (3), (7) and (8) and, with smaller size, for transport of elements (1), (4), (5), (6), (9) and (10).

Their use will make soft placement in the course of stacking of basic elements one upon the other and with respect to vertical transport possible. This is important all the more so in the case of basic elements, which have been completed up to 90% with regard to construction, technical installations, and furnishings.

Formation ('B') of the column cap will, according to the invention, consist of a solid steel plate with the shape and dimensions of the column cap plate. However, it will preferably have a circular opening with maximum diameter. This, at the same time, will be the internal diameter of the steel tube with a cover on top, which will be positioned above and connected with the base plate. In the center of the steel plate, which closes the top of the tube cylinder, there will be a special type of shock absorber above two eye hook constructions within the inner casing of the surrounding steel cylinder.

For these formations ('B'), the basic elements below must be equipped with cap plate formations ('B'). These formations will show segmental openings with an upper diameter larger than the catching end of the special type shock absorber, in the center of the cap and cover plates above the threaded tube.

Wind anchors in the vertical plane and anchor connections in the horizontal plane are to be installed transversally according to FIG. 44.

According to the invention, anchor connections are shown as rigid designs as well as in flexible construction with use of springs. Four threaded tubes in crosswise construction will be fit into the columns, preferably directly below the column cap—or the column base formation, which will provide connections for horizontal anchors at all four sides of the column. For fabrication of rigid horizontal anchor connections in accordance with the invention, threaded steel pieces projecting from the columns will be screwed into two opposite threaded steel tubes. Flexible heads will be arranged at both ends of a steel bar for creation of the connection. By means of this connection, it will be possible to level slight permissible variations which might result from stacking basic elements (1) through (10) one upon the other. A short threaded tube, with depth according to the length of the thread of the threaded steel piece projecting from the column, will be put over a flexible head. Above the flexible head, there will be a tube at the other end of the bar, with length accordingly greater, which will only be threaded in its front half and of such a length that it can be screwed tightly into the threaded steel piece projecting from the other column. By means of the tightening of the longer connection tube, an anchor will be produced which will constitute a rigid connection between two elements. For creation of a mobile but still tight connection in accordance with the invention, the rigid steel bar will merely be exchanged for a strong spring which will also have flexible heads at its ends.

Further horizontal element connections can also be produced with the constructional elements described, i.e. rigid or mobile by means of bars or springs.

Vertical, transversal, and also those wind anchors to be placed crosswise, can also be installed laterally reversed within basic elements (2), (3), (7) and (8).

Preferably, a round steel cross will be arranged within the cross-section of the column with the possibility of providing an anchor connection at all four sides of the column. This round steel cross will always be positioned directly below the upper cross tubes or directly above the lower cross tubes.

According to the invention, steel hooks with flexible heads at the ends and directed towards the top or bottom, will be laid over the round steels of the round steel crosses. Threaded steel tubes will close behind these flexible heads. A sheet metal hood which closes flush with the outside of the columns and forms an oval moving space for the different transversal wind anchors to be installed, will be positioned around the round steel of the steel hook and above the tubes.

Steel rods, which will have flexible heads at the other end with threaded tubes of respective length placed over them, will be screwed into the threaded tubes positioned within the columns. These structural features will aslo be shown by the anchor devices of the opposite columns, positioned at the top or bottom. They only differ with respect to the shorter threaded tubes positioned above their flexible heads. Finally, rigid transversal wind anchors will be provided between these devices, facing one another on the top and bottom, by means of screwing a round steel bar, with thread in the opposite direction at its ends, completely into the shorter tube, while it will still be possible to also screw it into the longer tube and to tighten it.

According to the invention, a mobile wind anchor connection which, however, can be tightened, will be provided by removing a center piece of the round steel bar and by installing a special type of steel spring within this gap.

According to the arrangement of the position of the transversal anchor connections between elements, within the longitudinal direction of elements (2) and (3) or also within elements (7) and (8), different linear dimensions will occur diagonally. These differences between measurements will always be bridged over by use of shorter or longer round steel bars in the center, with thread in the opposite direction, by means of shorter or longer spring-bar-designs also with thread in the opposite direction at the end of the bars.

DESIGN OF SUSPENSION ARRANGEMENT FOR THE CEILING

According to the invention, this arrangement will be connected to the bare ceiling by means of a cap plate. A round steel bar will preferably be fastened in the center of the cap plate. Length of this bar will depend upon the height of the ceiling to be suspended. A threaded tube will be attached in the center of the cover on top of it. By means of fastening of L-shaped steel plate angles, crosswise against the outer jacket of a steel tube, four U-shaped hooks will be formed for the ceiling to be suspended. The piece of steel tube will be closed with an upper steel cover which has a round opening in the center of corresponding size. A solid steel cylinder will receive a large, deep indentation towards the bottom and a round end plate towards the top, the diameter of which shall be somewhat smaller than the internal diameter of the steel pipe. Small ball bearings will be inserted into the top of this end plate and a threaded steel bolt will be fixed in the center. This bolt will be bolted into the threaded tube through the opening of the steel pipe cover so that one third of the length of thread remains unused. In this way it will be possible to readjust at any time through the small square or round opening within. It will also be possible to attach two small flat steel plates to the steel tube with space in between. According to the invention, these might then serve as support for T-steel rails, in case cross-heads will be required across the wide ducts above the suspended ceilings.

Construction of the suspended ceiling, as shown in FIG. 49, will consist of the following in accordance with the invention:

A round steel suspender is anchored at the bottom side of a bare ceiling. A threaded tube will be inserted into a steel tube up to one third of the length of the lower part. A threaded bolt, which has been straddled to form a notch and will receive a surrounding edge of support, will be bolted into the piece of steel tube completely and receives a small end plate which will prevent racing of the threaded bolt. Prior to this step, a steel ring—shaped like an L turned upside down—has been slid over it with the hooks for suspension of the ceiling. Unhindered readjustment is possible through small, round or square openings of completed ceiling suspension construction.

CONSTRUCTION OF ELEVATED FLOOR ACCORDING TO FIG. 50

According to the invention, the elevated floor construction has been designed specially with respect to elements and will preferably consist of the following functional parts:

(a) A square steel base plate with openings for screws in two corners diagonally opposing or in all four corners is attached to the bare ceiling by means of screws (with plugs) or stone anchors. A soft PVC pad can be laid between the flush bare ceiling and the base plate, if necessary.

(b) A steel tube will be placed on top of the steel base plate with interior thread up to ⅔ height of the tube. A long, round steel bolt with thread in the lower part to thread in the tube and with a smooth upper part having a deep indentation at one end, will be bolted from above. The steel tube will then be closed around the bolt on top by means of a steel ring cover, and a steel plate ring will be attached to the smooth part of the bolt above.

(c) Ball bearings for easy turning of the top and for carrying the upper ceiling with heavy loads are located in this steel ring—otherwise, the upper surfaces of the steel rings will be made smooth and sliding. Another steel plate ring with the same diameter and with the same hollow space for a ball bearing (or ground smooth on the bottom surface only) will be laid from above without connection.

(d) Another piece of steel tube which will remain open on top will be fastened on top of this steel plate ring.

(e) Preferably, two supporting steel plates will always be inserted crosswise, equally spaced, and cone shaped in the upward direction between the ring plate described above and the outside of the steel tube.

(f) T-steel rails for the formation of the arrangement of layers of base plates will be placed between and on top of these supporting plates. The supporting plates will be attached to the upper part of the tube, reduced in height according to the thickness of the T-steel rails. For prevention of impact sound, the T-steel rails will not reach the outer surface of the upper tube and the top of the supporting plates and T-steel rails as well as the tube will be lined with a hood made of rubber or soft PVC. The rubber- or soft PVC-lining on top of the supporting plates and the T-rails will be in strips.

(g) Height of the elevated floor construction will depend upon the distance between the upper ceiling and the bare ceiling. In accordance with this construction, the lower tube and the complete bolt must be finished shorter or longer. Through very small round or square jogs in the corner joint of the four base plates, it will be possible to readjust floor surfaces installed at the factory fast and without problems through the indentation of the bolt; this possibility is designed for the purpose of height adjustment of elements on the site.

LIST OF REFERENCE NUMBERS FOR STRUCTURAL PARTS

(1): Basic element for foundations—rectangular base

(1'): Staircase-element for foundations—rectangular base

(2): Basic element for full stories—rectangular base

(2'): Staircase-element for full stories—rectangular base

(3): Basic element for high additional space—required for technical installations or foundations—rectangular base

(3'): Staircase-element for high additional space—required for technical installations or foundations—rectangular base

(4): Element for low additional space—or requirements for technical installations—rectangular base

(4'): Staircase-element for low additional space—or requirements for technical installations—rectangular base

(5): Basic element for protectors of fascias, balconies, and terraces and for foundations of minimum height—rectangular base

(5'): Staircase-element for protectors of fascias, balconies, and terraces and for foundations of minimum height—rectangular base

(6): Basic element for foundations—rectangular base

(6'): Staircase-element for foundations—square base

(7): Basic element for full stories—square base

(7'): Staircase-element for full stories—square base

(8): Basic element for high, additional space—required for technical installations of foundations—square base

(8'): Staircase-element for high, additional space—required for technical installations or foundations—square base

(9): Basic element for low additional space—or requirements for technical installations—square base

(9'): Staircase-element for low additional space—or requirements for technical installations—square base

(10): Basic element for protectors of fascias, balconies and terraces and for foundations of minimum height—square base

(10'): Staircase-element for protectors of fascias, balconies, and terraces and for foundations of minimum height—square base

(11): Block- or angle foundations in area of outer walls

(12): Block-foundations for interior space

(13): Cap plates on top of columns of all elements (14): Projecting ring beam at top edge
(15): Top bearing ring beam
(16): Upper floor ring beam
(17): Element columns (clear height of 3.30 m)
(18): Lower interior floor ring beam
(19): Bottom bearing ring beam
(20) Projecting ring beam at exterior bottom edge
(21): Base plates below columns of all elements
(22): Element columns, 1.05 m high, including cap- and base plates
(23): Installation recess, 0.90/0.40 m cross-section
(24): Lower short floor beam
(25): Upper short floor beam
(26): Installation recess, 1.00/0.40 m cross-section
(27): Longitudinal cross walls in front of columns
(28): Upper long floor beam
(29): Installation recess, 0.65/0.40 m cross-section
(30): (Longitudinal-) and broadside cross walls in front of columns
(31): Lower short floor beams
(32): Upper (long) and short reinforcing beam
(33): Element columns (clear height of 1.20 m)
(34): Element columns, 0.85 m high, including cap- and base plates
(35): Installation recess, 0.15/1.00 m cross-section
(36): Installation recess below, 0.15/1.00 m or 0.30/1.00 m cross-section altogether
(37): Installation recess, 0.15/1.20 m cross-section
(38): Installation recess below, 0.15/1.20 m or 0.30/1.20 m cross-section altogether
(39): Continuous cross walls in front of columns of elements with square base
(40): Projecting ring beam at bottom edge
(41): Continuous cross walls in front of columns of elements with rectangular base
(42): Installation recess, 0.15/0.50 m cross-section
(43): Installation recess, 0.15/0.50 m, below, or 0.30/0.50 m cross-section altogether
(44): Roof/floor slab with standard width, (0.625 m)
(45): Roof/floor adapter slab in center, for rectangular base
(46): Roof/floor adapter slab off center, for square base
(47): Vertical edge joint, 0.025 m thick around roof/-floor slab
(48): Horizontal supporting joint for roof/floor slab, 0.025 m thick
(49): Adapter slab off center, for square base
(50): Circular staircase opening between floor beams, i.e. between bearing beams
(51): Roof/floor slab with standard width (0.625 m)
(52): Roof/floor adapter slab in center, for rectangular base
(53): Vertical edge joint around roof/floor slabs, also around columns, 0.025 m thick
(54): Horizontal supporting joints at columns, interrupted for roof/cover plates, 0.025 m thick
(55): Roof/floor end slab, notched at columns
(56): Roof/floor adapter slab in center, for square base
(57): Roof/floor end slab, notched at both ends, for square base
(58): Auxiliary column, half height according to requirements in center
(59): Auxiliary column, three-quarter height according to requirements in center
(60): Auxiliary column, fixed at top and bottom according to requirements
(61): Outer wall slab, upright, standard width (0.625m)
(62): Broadside longitudinal wall slabs, upright, covering a longitudinal wall, standard width (0.50 m)
(63): Longitudinal outer wall adapter slab, upright at outer wall covering two broadside walls (standard width 0.625 m)
(64): Exterior longitudinal wall adapter slab, upright at outer wall—covering two broadside walls (standard width 0.625 m)
(65): Exterior broadside wall adapter slab at outer wall, between two longitudinal walls (standard width 0.625)
(66): Exterior longitudinal wall adapter slab in center at outer wall, around outer corner and up to middle of element joint (standard width 0.625 m)
(67): Exterior longitudinal wall adapter slab at longitudinal wall, between two broadside walls (standard width 0.50 m)
(68): Exterior longitudinal wall-corner adapter slab at longitudinal wall, around one outer corner and up to middle of element joint (standard width 0.625 m)
(69): Exterior broadside wall adapter slab off center at broadside wall, between outer wall up to middle of element joint (0.50 m)
(70): Exterior broadside wall adapter slabs in center at outer wall placed between two outer walls (0.50 m)
(71): Exterior broadside adapter slabs in center at outer wall, abutting on an outer wall and covering one outer wall (0.50 m)
(72): Exterior broadside wall adapter slab in center at wall between two longitudinal walls (0.625 m)
(73): Exterior broadside wall-corner adapter slab at wall, abutting on outer wall and covering one broadside wall (0.625 m)
(74): Exterior broadside wall-corner adapter slab in center, as described in (73), however with standard width of 0.50 m
(75): Exterior broadside wall adapter slab in center at wall as described in (73), however with standard width of 0.625 m
(76): Exterior broadside wall-corner adapter slab abutting on longitudinal wall and covering one longitudinal wall (0.625 m)
(77): Exterior broadside wall adapter slab in center at wall abutting on outer wall and at mitre corner (0.625 m)
(78): Exterior broadside wall adapter slab in center at wall between two longitudinal walls (0.625 m)
(79): Exterior broadside wall adapter slab in center at wall abutting on longitudinal wall and extending up to outer edge of projecting beam (0.625 m)
(80): Outer wall corner mitred, unequal angles (0.625 m)
(81): Outer wall corners mitred, equal angles (0.50 m)
(82): Outer wall corners, obtuse, made of two standard slabs (0.50 m)
(83): Angle of joint between outer wall slabs and columns
(84): Joint between outer wall slabs and column
(85): Outer-element joint by means of two abutting standard slabs of 0.50 m
(86): Outer wall-element joint by means of adapter slab between two "outer walls"
(87): Outer wall-element joint by means of placement of adapter slab at back of it, extending from one column to the next (88): Outer wall-element joint by means of adapter slab shaped like truncated pyramid (89): Outer wall-element joint by means of placement of adapter slab at back of it between two "outer walls"

(90): Outer wall-element joint by means of placement of adapter slab between two "outer walls"

(91): Outer wall-element joint by means of T-shaped adapter piece up to exterior edge of projecting beam and placement of adapter slab at back of it between two "outer walls"

(92): Outer wall-element joint by means of adapter piece between two "outer walls" extending up to exterior edge of projecting beam (93): Roof/floor-installation recesses, prepared with 0.30/0.30 m cross-section (94): Anchor rails in inside of columns in bottom sides of upper bearing beams and in top sides of lower bearing beams (continuous or in form of ring)

(95): Supporting profiles with thickness according to joints, for roof/floor- and outer wall slabs (96): Double window/door construction with interior venetian blinds (97): Double window/door construction with small window shade casing (98): Single window/door construction with bottom springer (99): Single window/door construction without division and with window shade (100): Single window/door combination with only one bottom springer and window shade casing attached above (101): Single door/window element with divisions for springer on top and bottom (102): Casing for indirect lighting at lintel (103): Maximum size window shade casing for door/-window height of approx. 3.00 m (104): Single window from bottom edge of lintel up to top of parapet (105): Door/window element of double shell construction with venetian blind installed in center (106): Light partition wall 0.10 m thick inside (107): Light interior partition wall panel construction 0.10 m thick (108): Solid interior partition wall, panel construction 0.15 m thick (109): Interior solid partition wall 0.15 m thick (110): Light interior partition wall, panel construction 0.10 m thick (111): Solid continuous interior partition walls, panel construction 0.15 m thick (112): Heavy interior fire wall, panel construction 0.20 m thick with element connection shaped like truncated pyramid (113): Interior partition wall 0.15 m thick panel construction (114): Solid interior partition wall, panel construction 0.15 m thick (115): Light interior partition wall as cross wall, 0.10 m thick (116): Interior solid partition wall made of panels, 0.15 m thick (117): Interior wall crossing point for installation of cross walls, 0.15 m thick (118): Vertical connection joints from two sides within 0.15 m thick interior walls (119): Connection panel shaped like truncated pyramid, from one element to the next within interior walls 0.15 m thick (120): connection wall strip with element joint within interior walls 0.15 m thick (121): Vertical interior wall joints between the two abutting surfaces of 0.15 m thick interior walls and a 0.10 m thick wall (122): Vertical joint at right-angled connection of two interior walls, each 0.15 m thick (123): Light partition wall with 0.15 m thickness at top, terminating within suspended ceiling (124): Fire wall/partition wall between apartments or buildings 0.20 m thick, extending up to top edge of interior bearing ring beam (125): Low interior partition wall, terminating within suspended ceiling of apartment (126): Interior wall 0.15 m thick, height from top surface of bearing beam to bottom side of bearing beam (127): Interior partition wall with 0.15 m thickness extending up to upper of two suspended ceilings installed at different levels (128): Thinnest interior partition wall, 0.10 m thick, of medium height, terminating at upper side of suspended ceiling (129): Thinnest partition wall, 0.10 m thick, up to bottom side of upper, interior floor ring beam (130): 0.15 m thick interior partition wall from upper edge of bare ceiling to bottom edge of bare ceiling (131): Interior wall with height less than room, through elevated ceiling (132): Fire-, outer- or partition wall between apartments, 0.20 m thick, with height from upper edge of lower projecting beam to lower edge of upper projecting beam (133): Partition wall, 0.10 m thick, terminating at upper side of suspended ceiling (134): Fire- or partition wall between apartments with thickness of 0.20 m, height from lower to upper bearing beam

LIST OF IDENTIFICATION LETTERS FOR MEASURES (a): Linear measure of 6.70 m overall in case of rectangular base (a:2—v): Width of 3.30 m overall in case of rectangular base and length and width overall in case of square base (b): Measure of altitude of 4.20 m overall for full story elements (b:2): Measure of altitude of 2.10 m overall for elements with high demand for additional rooms and/or space for technical installation or foundations (b:4): Measure of altitude of 1.05 m overall for foundation elements and for low additional demand for rooms or technical installations (c): Measure of altitude of 0.85 m overall for protector elements for fascia, balcony and terrace (d): Measure of depth of 0.30 m for upper and lower exterior projecting ring beams (e): Length and width of columns and measure of width for bearing beams at top and bottom, as well as length and width of base- and cap plates (0.30 m —variable-)

(f): Clear length between columns (5.50 m —variable-)

(g): Clear (length) and width between columns (2.10 m—variable-) p (h): Measure of depth of 0.15 m for upper and lower interior floor ring beam (i): Clear length between floor beams (5.20 m—variable-)

(k): Clear (length) and width between floor beams (1.80 m—variable-)

(l): Measure of altitude of 0.15 m for upper and lower interior floor ring beams and for exterior projecting ring beams at top and bottom (m): Measure of altitude of lower bearing ring beam without measure of (4) (0.225 m—variable-) p (n): Clear height of columns (3.30 m—variable-)

(o): Measure of altitude of upper bearing ring beam without measure for (1) (0.275 m—variable-)

(p): Clear height from bottom side of upper interior floor beam up to top side of lower interior floor beam (3.525 m—variable-)

(q): Clear height of upper bearing ring beam at outside (0.275 m —variable-)

(r): Clear height for columns (1.20 m—variable-)

(s): clear (length) and width of 2.40 m between floor beams (t): Measure of depth of 0.10 m for small exterior projecting ring beam (variable)

(u): Measure of 0.20 m for continuous exterior cross walls (variable)

(v): Measure of 0.05 m for half of horizontal and vertical joint width between elements and for height of column cap- and bottom plates (w): Depth of stair heads in case of straight flights with measure of 1.21 m (variable)

(x): Height of beam for stair head with measure of 0.30 m (variable)

(y: . . . ): Grid with respect to axes of elements, including smallest measure of 1.70 m, in both (vertical and horizontal) directions (z): Ratio of rise of 0.175 m for landing places and 0.280 m for treads—all stairs uniformly throughout all elements (A): Grid spacing of 1.05 m with respect to height of building, including joints—fascia flat roof with 0.85 m height excluded (B): Grid spacing of 3.40 m for buildings in longitudinal direction, including half of joint width (C): Grid spacing of 3.40 m for width of buildings, including half of joint width

What is claimed is:

1. A building system, including a plurality of interconnected block elements (1–10), each block element (1–10) comprising:

six sides, eight corners, and a rectangular base, all enclosing an open space in the shape of a parallelepiped having a rectangular cross-section on all sides, four column base plates (21) placed within four interior angles of the rectangular base, four upstanding columns (17) being placed on top of each of the four column base plates (21), four side walls (27 and 30) crossing between the four upstanding columns (17) and being laterally supported by the four upstanding columns (17), a lower load-bearing beam (19) having an outside edge and an inside edge, ringing the perimeter of the rectangular base, interconnecting bottoms of the four upstanding columns (17), and serving as a bottom support for the four side walls, a lower outwardly projecting beam (20) being attached to the outside edge of the lower load-bearing beam (19), one of at least one outer building wall and at least one interior fire wall being retained at a bottom thereof by the lower outwardly projecting beam (20), a lower inwardly projecting beam (18) being attached to the inside edge of the lower load-bearing beam (19) at the same height as the lower outwardly projecting beam (18), one of a floor and a ceiling/floor combination being supported by the lower inwardly projecting beam (18), an upper load-bearing beam (15) having an outside edge and an inside edge, being positioned above the lower load-bearing beam (19) at a height of the side wall therebetween, interconnecting tops of the four upstanding columns, and serving as a top support for the four side walls, an upper outwardly projecting beam (14) being attached flush with the top of the outside edge of the upper load-bearing beam (15) and serving as a top retainer for said one of the at least one outer building wall and the at least one interior fire wall, an upper inwardly projecting beam (16) being attached flush with the bottom of the inside edge of the upper load-bearing beam (15) and being spaced from the upper outwardly projecting beam (14), one of a ceiling/roof and a ceiling/floor combination being supported by the upper inwardly projecting beam (16), and four column cap plates (13) placed over the four upstanding columns (17).

2. The building system according to claim 1, wherein, for each of the plurality of interconnected block elements (1–10), said four upstanding columns (17) each have a height less than half the length of the block element.

3. The building system according to claim 1, further comprising:

a foundation placed underneath the plurality of interconnected block elements (1–10).

4. The building system according to claim 1, wherein, for each of the plurality of interconnected block elements (1–10), said rectangular base is square.

5. The building system according to claim 1, wherein, for each of the plurality of interconnected block elements (1–10), each of the four side walls (27 and 30) is square.

6. The building system according to claim 5, wherein, for each of the plurality of interconnected block elements (1–10), said rectangular base is square.

7. The building system according to claim 1, wherein, for each of the plurality of interconnected block elements (1–10), each of the four column cap plates (13) includes means for allowing vertical lifting and transporting of the block element.

8. The building system according to claim 1, wherein, for each of the plurality of interconnected block elements (1–10), each of the four column base plates (21) includes means for allowing vertical stacking of the block element.

9. The building system according to claim 1, wherein, for each of the plurality of interconnected block elements (1–10), said four column caps plates (13) and said four column base plates (21) are made of steel.

10. The building system according to claim 1, wherein, for each of the plurality of interconnected block elements (1–10), each of said four upstanding columns (17) includes, fitted directly below each of the four column cap plates (13), anchor connections at all sides of the column (17).

* * * * *